US010814646B2

(12) United States Patent
Matsumoto et al.

(10) Patent No.: US 10,814,646 B2
(45) Date of Patent: Oct. 27, 2020

(54) LIQUID DISCHARGE APPARATUS, LIQUID DISCHARGE SYSTEM, AND PRINT HEAD

(71) Applicant: SEIKO EPSON CORPORATION, Tokyo (JP)

(72) Inventors: Yusuke Matsumoto, Nagano (JP); Toru Matsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/575,491

(22) Filed: Sep. 19, 2019

(65) Prior Publication Data

US 2020/0086658 A1 Mar. 19, 2020

(30) Foreign Application Priority Data

Sep. 19, 2018 (JP) ..... 2018-174367
Feb. 28, 2019 (JP) ..... 2019-036735
Apr. 26, 2019 (JP) ..... 2019-085825

(51) Int. Cl.
*B41J 3/54* (2006.01)
*B41J 2/025* (2006.01)
*B41J 2/03* (2006.01)

(52) U.S. Cl.
CPC ..... *B41J 3/54* (2013.01); *B41J 2/025* (2013.01); *B41J 2/03* (2013.01)

(58) Field of Classification Search
CPC ..... B41J 3/54; B41J 2/025; B41J 2/03; B41J 2/0455; B41J 2/04563; B41J 2/04541; B41J 2/045; B41J 2/04501; B41J 2/01
See application file for complete search history.

(56) References Cited

U.S. PATENT DOCUMENTS 8,876,236 B2 11/2014 Kondo et al.
9,682,557 B2 6/2017 Owaki
10,103,467 B2 10/2018 Hayashi
2004/0119770 A1 6/2004 Tamura
(Continued)

FOREIGN PATENT DOCUMENTS

JP 2002-337365 A 11/2002
JP 2004-090501 A 3/2004
(Continued)

OTHER PUBLICATIONS

IP.com search (Year: 2020).*
The Extended European Search Report for the corresponding European Patent Application No. 19198365.9 dated Jan. 16, 2020.

*Primary Examiner* — Lisa Soloman
(74) *Attorney, Agent, or Firm* — Global IP Counselors, LLP

(57) ABSTRACT

In a liquid discharge apparatus, a print head includes a supply port to which liquid is supplied; a nozzle plate that includes a nozzle for discharging the liquid; a substrate that includes first side, a second side, a first surface, and a second surface which is different from the first surface; a connector that is provided on the first surface; and an integrated circuit that is provided on the first surface, the substrate is provided between the nozzle plate and the supply port, the connector is provided along the first side, the integrated circuit is provided in a place which is not adjacent to the connector, and a shortest distance between the supply port and the first surface is longer than a shortest distance between the supply port and the second surface.

18 Claims, 30 Drawing Sheets

(56) References Cited

U.S. PATENT DOCUMENTS

| | | | |
|---|---|---|---|
| 2013/0083102 | A1 | 4/2013 | Kondo et al. |
| 2016/0121609 | A1 | 5/2016 | Owaki |
| 2016/0243830 | A1 | 8/2016 | Naito et al. |
| 2017/0173951 | A1 | 6/2017 | Hayashi |
| 2019/0009531 | A1 | 1/2019 | Furukawa |

FOREIGN PATENT DOCUMENTS

| | | | |
|---|---|---|---|
| JP | 2007-083484 | A | 4/2007 |
| JP | 2013-082197 | A | 5/2013 |
| JP | 2016-088084 | A | 5/2016 |
| JP | 2017-113928 | A | 6/2017 |
| JP | 2017-114020 | A | 6/2017 |
| JP | 2018-001647 | A | 1/2018 |

* cited by examiner

| [SIH, SIL] | | [1, 1] LARGE DOT | [1, 0] MIDDLE DOT | [0, 1] SMALL DOT | [0, 0] NON-RECORDING |
|---|---|---|---|---|---|
| S | T1 | H | H | L | L |
| | T2 | H | L | H | L |
| | T3 | L | L | L | H |

FIG. 15

| TERMINAL NUMBER | INPUT SIGNAL |
|---|---|
| 353-1 | GND |
| 353-2 | TH |
| 353-3 | GND |
| 353-4 | LAT |
| 353-5 | GND |
| 353-6 | SCK |
| 353-7 | GND |
| 353-8 | CH |
| 353-9 | GND |
| 353-10 | SI1 |
| 353-11 | GND |
| 353-12 | XHOT |
| 353-13 | CGND1 |
| 353-14 | COM1 |
| 353-15 | CGND2 |
| 353-16 | COM2 |
| 353-17 | CGND3 |
| 353-18 | COM3 |
| 353-19 | CGND4 |
| 353-20 | COM4 |
| 353-21 | CGND5 |
| 353-22 | COM5 |
| 353-23 | CGND6 |
| 353-24 | COM6 |

FIG. 16

| TERMINAL NUMBER | INPUT SIGNAL |
|---|---|
| 363-1 | CGND6 |
| 363-2 | COM6 |
| 363-3 | CGND5 |
| 363-4 | COM5 |
| 363-5 | CGND4 |
| 363-6 | COM4 |
| 363-7 | CGND3 |
| 363-8 | COM3 |
| 363-9 | CGND2 |
| 363-10 | COM2 |
| 363-11 | CGND1 |
| 363-12 | COM1 |
| 363-13 | GND |
| 363-14 | VHV |
| 363-15 | GND |
| 363-16 | SI6 |
| 363-17 | GND |
| 363-18 | SI5 |
| 363-19 | GND |
| 363-20 | SI4 |
| 363-21 | GND |
| 363-22 | SI3 |
| 363-23 | VDD |
| 363-24 | SI2 |

FIG. 26

| TERMINAL NUMBER | INPUT SIGNAL |
|---|---|
| 353-1 | GND |
| 353-2 | TH |
| 353-3 | GND |
| 353-4 | LATa |
| 353-5 | GND |
| 353-6 | SCKa |
| 353-7 | GND |
| 353-8 | CHa |
| 353-9 | GND |
| 353-10 | SI1 |
| 353-11 | CGND1 |
| 353-12 | COM1 |
| 353-13 | CGND2 |
| 353-14 | COM2 |
| 353-15 | CGND3 |
| 353-16 | COM3 |
| 353-17 | CGND4 |
| 353-18 | COM4 |
| 353-19 | CGND5 |
| 353-20 | COM5 |

FIG. 27

| TERMINAL NUMBER | INPUT SIGNAL |
|---|---|
| 363-1 | CGND5 |
| 363-2 | COM5 |
| 363-3 | CGND4 |
| 363-4 | COM4 |
| 363-5 | CGND3 |
| 363-6 | COM3 |
| 363-7 | CGND2 |
| 363-8 | COM2 |
| 363-9 | CGND1 |
| 363-10 | COM1 |
| 363-11 | GND |
| 363-12 | SI5 |
| 363-13 | GND |
| 363-14 | SI4 |
| 363-15 | GND |
| 363-16 | SI3 |
| 363-17 | GND |
| 363-18 | SI2 |
| 363-19 | GND |
| 363-20 | VDD |

FIG. 28

| TERMINAL NUMBER | INPUT SIGNAL |
|---|---|
| 373-1 | CGND6 |
| 373-2 | COM6 |
| 373-3 | CGND7 |
| 373-4 | COM7 |
| 373-5 | CGND8 |
| 373-6 | COM8 |
| 373-7 | CGND9 |
| 373-8 | COM9 |
| 373-9 | CGND10 |
| 373-10 | COM10 |
| 373-11 | GND |
| 373-12 | XHOT |
| 373-13 | GND |
| 373-14 | LATb |
| 373-15 | GND |
| 373-16 | SCKb |
| 373-17 | GND |
| 373-18 | CHb |
| 373-19 | GND |
| 373-20 | SI10 |

FIG. 29

| TERMINAL NUMBER | INPUT SIGNAL |
|---|---|
| 383-1 | GND |
| 383-2 | SI9 |
| 383-3 | GND |
| 383-4 | SI8 |
| 383-5 | VDD |
| 383-6 | SI7 |
| 383-7 | GND |
| 383-8 | SI6 |
| 383-9 | GND |
| 383-10 | VHV |
| 383-11 | CGND10 |
| 383-12 | COM10 |
| 383-13 | CGND9 |
| 383-14 | COM9 |
| 383-15 | CGND8 |
| 383-16 | COM8 |
| 383-17 | CGND7 |
| 383-18 | COM7 |
| 383-19 | CGND6 |
| 383-20 | COM6 |

LIQUID DISCHARGE APPARATUS, LIQUID DISCHARGE SYSTEM, AND PRINT HEAD

The present application is based on, and claims priority from JP Application Serial Number 2018-174367, filed Sep. 19, 2018, JP Application Serial Number 2019-036735, filed Feb. 28, 2019, and JP Application Serial Number 2019-085825, filed Apr. 26, 2019, the disclosures of which are hereby incorporated by reference herein in their entirety.

BACKGROUND

1. Technical Field

The present disclosure relates to a liquid discharge apparatus, a liquid discharge system, and a print head.

2. Related Art

A liquid discharge apparatus, such as an ink jet printer, discharges liquid, such as ink with which a cavity is filled, from a nozzle by driving a piezoelectric element provided in a print head using a driving signal, and forms a letter or an image on a medium. In the liquid discharge apparatus, when malfunction occurs in the print head, there is a problem in that discharge abnormality occurs in which it is not possible to normally discharge the liquid from the nozzle. Furthermore, when the discharge abnormality occurs, discharge accuracy of the liquid discharged from the nozzle is deteriorated, and thus there is a problem in that a quality of the image formed on the medium is deteriorated. The print head is known which has a self-checking function for diagnosing whether or not the discharge accuracy of the liquid is deteriorated by the print head itself.

For example, JP-A-2017-114020 discloses a technology for diagnosing, by a print head itself, whether or not it is possible to form dots which satisfy a normal print quality based on a plurality of signals which are input to the print head.

In addition, JP-A-2004-090501 discloses a technology for diagnosing, by a print head itself, whether or not it is possible to form dots which satisfy a normal print quality based on a detection temperature detected by a temperature detection unit included in the print head.

In addition, JP-A-2002-337365 discloses a technology for coupling a head channel formed on a head main body to a holder channel formed on a head holder through a seal plate in a recording head (print head) in which the head main body having a piezoelectric element and a substrate coupled through a flexible cable is coupled to the head holder that fixes the head main body.

In a liquid discharge apparatus, most of liquid discharged from a liquid nozzle impacts on a medium and forms an image. However, a part of the liquid discharged from the nozzle is misted before impacting on the medium, and floats as liquid mist on an inside of the liquid discharge apparatus. Furthermore, even after the liquid discharged from the nozzle impacts on the medium, there is a case where the liquid floats as the liquid mist again on the inside of the liquid discharge apparatus due to airflow which occurs with movement of a carriage, on which a print head is mounted, or transportation of the medium. The liquid mist, which floats on the inside of the liquid discharge apparatus, is extremely small, and, therefore, is charged due to Lenard effect. As a result, the liquid mist, which floats on the inside of the liquid discharge apparatus, is drawn to a wiring pattern which is formed on the print head and through which various signals are propagated. In addition, the liquid mist, which floats on the inside of the liquid discharge apparatus, is also drawn to a conductive part, such as a terminal, which electrically couples a cable to the print head. Furthermore, when the liquid mist, which floats on the inside of the liquid discharge apparatus, permeates to the inside of the print head and is attached to the wiring pattern or the terminal provided on the inside of the print head, there is a case where short-circuit occurs between wiring patterns and between terminals.

However, JP-A-2017-114020 and JP-A-2004-090501 do not disclose a technology for reducing a risk in which a false operation or a failure is generated due to the short-circuit or the like occurring because the liquid mist, which floats on the inside of the liquid discharge apparatus as described above, adheres to the wiring pattern or the terminal provided on the inside of the print head.

Here, the print head is a device which is electrically controlled and driven. Therefore, the print head includes a connector into which a cable, such as a Flexible Flat Cable (FFC), that propagates an electrical signal for driving the print head is inserted. The connector is fixed to a wiring substrate provided on an inside of the print head such that a cable insertion port, into which the cable is inserted, is exposed. Normally, the connector is provided to perform electrical coupling, and thus the connector does not include a special structure for securing airtightness. Therefore, air is circulated on the inside of the print head from a connector disposition part at which the connector is disposed.

The air, which is circulated on the inside of the print head, does a heat radiation action for reducing rise of the temperature on the inside of the print head in accordance that the inside of the print head is filled with the heat which is generated in accordance that the print head is driven. Therefore, from a point of view of heat radiation on the inside of the print head, there is a case where air is circulated on the inside of the print head by intentionally providing a small gap between walls, which are adjacent to a periphery of the connector, of the print head, thereby performing the heat radiation on the inside of the print head.

However, when air is circulated on the inside of the print head, a problem increases in that the liquid mist, which floats on the inside of the liquid discharge apparatus, permeates to the inside of the print head. Furthermore, when the liquid mist permeates to the inside of the print head, the liquid mist adheres to the wiring pattern or the terminal provided on the inside of the print head, a problem increases in that the short-circuit occurs between wiring patterns and between terminals.

Furthermore, in a so-called serial-type liquid discharge apparatus in which the print head is mounted on the carriage or the like and the liquid is discharged according to reciprocation of the carriage, there is a case where the connector provided in the print head is disposed in a carriage movement direction for a reason that it is desired to reduce a dimension of a depth direction of the carriage on which the print head is mounted. Furthermore, when the connector provided in the print head is disposed in the carriage movement direction, air around the print head is relatively blown into the insertion port of the connector, into which the cable is inserted, in accordance with a carriage reciprocation operation, and, in addition, air is sucked from the insertion port of the connector into which the cable is inserted. As a result, air is further easily circulated from the connector disposition part to the inside of the print head. That is, when the connector provided in the print head is disposed in the carriage movement direction, a problem increases in that ink mist, which floats on the inside of the liquid discharge apparatus, permeates to the inside of the print head.

In addition, a tank, which stores the liquid discharged from the print head, is normally provided at an upper part of the print head included in the liquid discharge apparatus, or in a location separated from the print head. An ink supply port, through which the liquid is supplied from the tank to the print head, is generally disposed at the upper part of the print head regardless of disposition of the tank. Therefore, as disclosed in JP-A-2002-337365, the liquid exists at the upper part of the print head. There is a problem in that the liquid, which is located at the upper part of the print head, leaks out due to, for example, malfunction of a joint part which is a so-called a seal plate provided on a liquid supply path. Furthermore, when the leaked liquid permeates to the inside of the print head, the liquid permeates to a lower part or a narrow part of the print head due to gravity and capillary phenomenon. Furthermore, the liquid, which is leaked due to an effect of inertia in accordance with acceleration by the carriage reciprocation operation, may move on the inside of the print head in a carriage movement direction. When the liquid, which permeates to the inside of the print head, is attached to the wiring pattern or the terminal provided on the inside of the print head, there is also a problem in that the short-circuit occurs between the wiring patterns and the terminals on the inside of the print head.

Furthermore, on the inside of the print head, there is a case where an integrated circuit is disposed in order to perform print head driving control or abnormality detection. When the liquid is attached to the integrated circuit provided on the inside of the print head and the short-circuit occurs in the terminal of the integrated circuit, distortion occurs on a waveform of a signal which is input to the integrated circuit, and, as a result, there is a problem in that abnormality occurs on an operation of the print head. Specifically, when the integrated circuit for detecting abnormality of the print head is disposed on the inside of the print head, there is a problem in that it is not possible to detect the abnormality of the print head for a reason that the integrated circuit does not normally operate. As a result, there is a problem in that a fatal failure occurs in the print head. In addition, even when abnormality does not occur in the print head, there is a problem in that the abnormality is falsely detected. In the case, there is a problem in that an original function of the liquid discharge apparatus is not performed.

In the liquid discharge apparatus, the liquid discharge system, and the print head of the present disclosure, it is possible to solve at least one of problems which are generated because the liquid permeates to the inside of the above-described print head.

SUMMARY

According to an aspect of the present disclosure, there is provided a carriage that reciprocates along a first direction; a print head that is mounted on the carriage; and a digital signal output circuit that outputs a digital signal to the print head, in which the print head includes a supply port to which the liquid is supplied from the liquid accommodation container, a nozzle plate that includes a plurality of nozzles for discharging the liquid, a substrate that includes a first side and a second side, which are provided in parallel to each other, a third side and a fourth side, which are provided in parallel to each other, a first surface, and a second surface which is different from the first surface, and that has a shape in which the first side is orthogonal to the third side and the fourth side, and the second side is orthogonal to the third side and the fourth side, a connector that is provided on the first surface and to which the digital signal is input, and an integrated circuit that is provided on the first surface, that is electrically coupled to the connector, to which the digital signal is input through the connector, and that outputs an abnormality signal which indicates existence/non-existence of abnormality of the print head, the substrate is provided such that, between the nozzle plate and the supply port, the first side and the second side are located along a second direction orthogonal to the first direction and the third side and the fourth side are located along the first direction, the connector is provided along the first side, the integrated circuit is provided in a place which is not adjacent to the connector, and a shortest distance between the supply port and the first surface is longer than a shortest distance between the supply port and the second surface.

In the liquid discharge apparatus, the supply port may be located at a vertically upper part of the substrate.

In the liquid discharge apparatus, the first surface may face a vertically lower part and the second surface may face a vertically upper part.

In the liquid discharge apparatus, the first surface may be orthogonal to a vertical direction.

In the liquid discharge apparatus, a length of the first side may be shorter than a length of the third side.

In the liquid discharge apparatus, a shortest distance between a virtual line, which has an equal distance from the first side and the second side, and the integrated circuit may be shorter than a shortest distance between the first side and the integrated circuit, and the shortest distance between the virtual line and the integrated circuit may be shorter than a shortest distance between the second side and the integrated circuit.

In the liquid discharge apparatus, the print head may include a fixing member that fixes the substrate, the substrate may include a fixing hole into which the fixing member is inserted, and at least a part of the integrated circuit may overlap the fixing member in a direction along the third side.

In the liquid discharge apparatus, the print head may include a discharge module that includes the nozzle plate, the integrated circuit may be located between the substrate and the discharge module, and the substrate and the discharge module may be fixed by an adhesive.

In the liquid discharge apparatus, the print head may include a plurality of flexible wiring substrates which are electrically coupled to the substrate, the substrate may include a plurality of FPC insertion holes into which the plurality of flexible wiring substrates are inserted, a width of each of the plurality of the FPC insertion holes in a direction along the first side may be larger than a width in a direction along width in a direction along the third side, and the plurality of FPC insertion holes may be located in line along the third side.

In the liquid discharge apparatus, the integrated circuit may be located other than between the plurality of FPC insertion holes in the direction along the third side.

In the liquid discharge apparatus, the substrate may include a supply port insertion hole into which the supply port is inserted.

In the liquid discharge apparatus, the integrated circuit may be a surface-mount component.

In the liquid discharge apparatus, the integrated circuit may be electrically coupled to the substrate through a bump electrode.

In the liquid discharge apparatus, the connector may include a fifth side, a sixth side which is orthogonal to the fifth side and is longer than the fifth side, and a plurality of terminals, the plurality of terminals being provided in line in a direction along the sixth side.

In the liquid discharge apparatus, the connector may be provided in the substrate such that the sixth side of the connector is parallel to the first side of the substrate.

In the liquid discharge apparatus, when the abnormality occurs in the print head, the integrated circuit may output the abnormality signal at a high level.

In the liquid discharge apparatus, when the abnormality occurs in the print head, the integrated circuit may output the abnormality signal at a low level.

In the liquid discharge apparatus, the digital signal may include a signal for prescribing liquid discharge timing.

In the liquid discharge apparatus, the digital signal may include a clock signal.

The liquid discharge apparatus may further include a trapezoid waveform signal output circuit that outputs a trapezoid waveform signal which includes a trapezoid waveform having a voltage value larger than the digital signal, and the trapezoid waveform signal may be input to the connector.

In the liquid discharge apparatus, the digital signal may include a signal for prescribing waveform switching timing of the trapezoid waveform included in the trapezoid waveform signal.

In the liquid discharge apparatus, the digital signal may include a signal for prescribing selection of the trapezoid waveform included in the trapezoid waveform signal.

In the liquid discharge apparatus, the integrated circuit may determine the existence/non-existence of the abnormality of the print head.

In the liquid discharge apparatus, the integrated circuit may determine the existence/non-existence of the abnormality of the print head based on the digital signal which is input from the connector.

In the liquid discharge apparatus, the liquid, which is supplied from the liquid accommodation container to the print head, may be ink.

According to another aspect of the present disclosure, there is provided a liquid discharge system including: a print head that discharges liquid; and a digital signal output circuit that outputs a digital signal to the print head, in which the print head includes a supply port to which the liquid is supplied, a nozzle plate that includes a plurality of nozzles for discharging the liquid, a substrate that includes a first side and a second side, which are provided in parallel to each other, a third side and a fourth side, which are provided in parallel to each other, a first surface, and a second surface which is different from the first surface, and that has a shape in which the first side is orthogonal to the third side and the fourth side, and the second side is orthogonal to the third side and the fourth side, a connector that is provided on the first surface and to which the digital signal is input, and an integrated circuit that is provided on the first surface, that is electrically coupled to the connector, to which the digital signal is input through the connector, and that outputs an abnormality signal which indicates existence/non-existence of abnormality of the print head, the substrate is provided between the nozzle plate and the supply port, the connector is provided along the first side, the integrated circuit is provided in a place which is not adjacent to the connector, and a shortest distance between the supply port and the first surface is longer than a shortest distance between the supply port and the second surface.

The liquid discharge system may further include a carriage that reciprocates along a first direction, in which the print head is mounted on the carriage, and the substrate is provided such that the first side and the second side are located along a second direction orthogonal to the first direction, and the third side and the fourth side are located along the first direction.

In the liquid discharge system, the supply port may be located at a vertically upper part of the substrate.

In the liquid discharge system, the first surface may face a vertically lower part and the second surface may face a vertically upper part.

In the liquid discharge system, the first surface may be orthogonal to a vertical direction.

In the liquid discharge system, a length of the first side may be shorter than a length of the third side.

In the liquid discharge system, a shortest distance between a virtual line, which has an equal distance from the first side and the second side, and the integrated circuit may be shorter than a shortest distance between the first side and the integrated circuit, and the shortest distance between the virtual line and the integrated circuit may be shorter than a shortest distance between the second side and the integrated circuit.

In the liquid discharge system, the print head may include a fixing member that fixes the substrate, the substrate may include a fixing hole into which the fixing member is inserted, and at least a part of the integrated circuit may overlap the fixing member in a direction along the third side.

In the liquid discharge system, the print head may include a discharge module that includes the nozzle plate, the integrated circuit may be located between the substrate and the discharge module, and the substrate and the discharge module may be fixed by an adhesive.

In the liquid discharge system, the print head may include a plurality of flexible wiring substrates which are electrically coupled to the substrate, the substrate may include a plurality of FPC insertion holes into which the plurality of flexible wiring substrates are inserted, a width of each of the plurality of the FPC insertion holes in a direction along the first side may be larger than a width in a direction along width in a direction along the third side, and the plurality of FPC insertion holes may be located in line along the third side.

In the liquid discharge system, the integrated circuit may be located other than between the plurality of FPC insertion holes in the direction along the third side.

In the liquid discharge system, the substrate may include a supply port insertion hole into which the supply port is inserted.

In the liquid discharge system, the integrated circuit may be a surface-mount component.

In the liquid discharge system, the integrated circuit may be electrically coupled to the substrate through a bump electrode.

In the liquid discharge system, the connector may include a fifth side, a sixth side which is orthogonal to the fifth side and is longer than the fifth side, and a plurality of terminals, the plurality of terminals being provided in line in a direction along the sixth side.

In liquid discharge system, the connector may be provided in the substrate such that the sixth side of the connector is parallel to the first side of the substrate.

In the liquid discharge system, when the abnormality occurs in the print head, the integrated circuit may output the abnormality signal at a high level.

In the liquid discharge system, when the abnormality occurs in the print head, the integrated circuit may output the abnormality signal at a low level.

In the liquid discharge system, the digital signal may include a signal for prescribing liquid discharge timing.

In the liquid discharge system, the digital signal may include a clock signal.

In the liquid discharge system, a trapezoid waveform signal, which includes a trapezoid waveform having a voltage value larger than the digital signal, may be input to the connector.

In the liquid discharge system, the digital signal may include a signal for prescribing waveform switching timing of the trapezoid waveform included in the trapezoid waveform signal.

In the liquid discharge system, the digital signal may include a signal for prescribing selection of the trapezoid waveform included in the trapezoid waveform signal.

In the liquid discharge system, the integrated circuit may determine the existence/non-existence of the abnormality of the print head.

In the liquid discharge system, the integrated circuit may determine the existence/non-existence of the abnormality of the print head based on the digital signal which is input from the connector.

In the liquid discharge system, the liquid, which is supplied to the print head, may be ink.

According to still another aspect of the present disclosure, there is provided a print head including: a supply port to which liquid is supplied; a nozzle plate that includes a plurality of nozzles for discharging the liquid; a substrate that includes a first side and a second side, which are provided in parallel to each other, a third side and a fourth side, which are provided in parallel to each other, a first surface, and a second surface which is different from the first surface, and that has a shape in which the first side is orthogonal to the third side and the fourth side, and the second side is orthogonal to the third side and the fourth side; a connector that is provided on the first surface and to which the digital signal is input; and an integrated circuit that is provided on the first surface, that is electrically coupled to the connector, to which the digital signal is input through the connector, and that outputs an abnormality signal which indicates existence/non-existence of operation abnormality, in which the substrate is provided between the nozzle plate and the supply port, the connector is provided along the first side, the integrated circuit is provided in a place which is not adjacent to the connector, and a shortest distance between the supply port and the first surface is longer than a shortest distance between the supply port and the second surface.

In the print head, the supply port is located at a vertically upper part of the substrate.

In the print head, the first surface may face a vertically lower part and the second surface may face a vertically upper part.

In the print head, the first surface may be orthogonal to a vertical direction.

In the print head, a length of the first side may be shorter than a length of the third side.

In the print head, a shortest distance between a virtual line, which has an equal distance from the first side and the second side, and the integrated circuit may be shorter than a shortest distance between the first side and the integrated circuit, and the shortest distance between the virtual line and the integrated circuit may be shorter than a shortest distance between the second side and the integrated circuit.

The print head may further include a fixing member that fixes the substrate, the substrate may include a fixing hole into which the fixing member is inserted, and at least a part of the integrated circuit may overlap the fixing member in a direction along the third side.

The print head may further include a discharge module that includes the nozzle plate, the integrated circuit may be located between the substrate and the discharge module, and the substrate and the discharge module may be fixed by an adhesive.

The print head may further include a plurality of flexible wiring substrates which are electrically coupled to the substrate, the substrate may include a plurality of FPC insertion holes into which the plurality of flexible wiring substrates are inserted, a width of each of the plurality of the FPC insertion holes in a direction along the first side may be larger than a width in a direction along width in a direction along the third side, and the plurality of FPC insertion holes may be located in line along the third side.

In the print head, the integrated circuit may be located other than between the plurality of FPC insertion holes in the direction along the third side.

In the print head, the substrate may include a supply port insertion hole into which the supply port is inserted.

In the print head, the integrated circuit may be a surface-mount component.

In the print head, the integrated circuit may be electrically coupled to the substrate through a bump electrode.

In the print head, the connector may include a fifth side, a sixth side which is orthogonal to the fifth side and is longer than the fifth side, and a plurality of terminals, the plurality of terminals being provided in line in a direction along the sixth side.

In the print head, the connector may be provided in the substrate such that the sixth side of the connector is parallel to the first side of the substrate.

In the print head, when the operation abnormality occurs, the integrated circuit may output the abnormality signal at a high level.

In the print head, when the operation abnormality occurs, the integrated circuit may output the abnormality signal at a low level.

In the print head, the digital signal may include a signal for prescribing liquid discharge timing.

In the print head, the digital signal may include a clock signal.

In the print head, a trapezoid waveform signal, which includes a trapezoid waveform having a voltage value larger than the digital signal, may be input to the connector.

In the print head, the digital signal may include a signal for prescribing waveform switching timing of the trapezoid waveform included in the trapezoid waveform signal.

In the print head, the digital signal may include a signal for prescribing selection of the trapezoid waveform included in the trapezoid waveform signal.

In the print head, the integrated circuit may determine the existence/non-existence of the operation abnormality.

In the print head, the integrated circuit may determine the existence/non-existence of the operation abnormality based on the digital signal which is input from the connector.

In the print head, the liquid, which is supplied to the supply port, may be ink.

BRIEF DESCRIPTION OF THE DRAWINGS

FIG. 15 is a diagram illustrating examples of signals respectively input to terminals.

FIG. 16 is a diagram illustrating examples of signals respectively input to terminals.

FIG. 26 is a diagram illustrating examples of signals respectively input to terminals of the third embodiment.

FIG. 27 is a diagram illustrating examples of signals respectively input to terminals of the third embodiment.

FIG. 28 is a diagram illustrating examples of signals respectively input to terminals of the third embodiment.

FIG. 29 is a diagram illustrating examples of signals respectively input to terminals of the third embodiment.

DESCRIPTION OF EXEMPLARY EMBODIMENTS

Hereinafter, preferable embodiments of the present disclosure will be described with reference to the accompanying drawings. The accompanying drawings are used for convenience of description. Meanwhile, the embodiments which will be described below do not unreasonably limit content of the present disclosure disclosed in claims. In addition, all configurations which will be described below are not limited to essential components of the present disclosure.

Hereinafter, an ink jet printer, which forms an image by discharging ink as liquid on a medium P, will be described as an example of a liquid discharge apparatus. Meanwhile, the liquid discharge apparatus is not limited to the ink jet printer, and it is possible to exemplify, for example, a color material discharge apparatus used to manufacture a color filter of a liquid crystal display or the like, an electrode material discharge apparatus used to form an electrode of an organic EL display or a Field Emission Display (FED), a living organism discharge apparatus used to manufacture a biochip, a solid forming apparatus (a so-called 3D printer), a textile printing apparatus, or the like. The liquid discharged from the liquid discharge apparatus in the case is not limited to the ink, and may be, for example, liquid including an electrode material or liquid including living organisms.

1 First Embodiment

1.1 Outline of Liquid Discharge Apparatus

Figure 1:
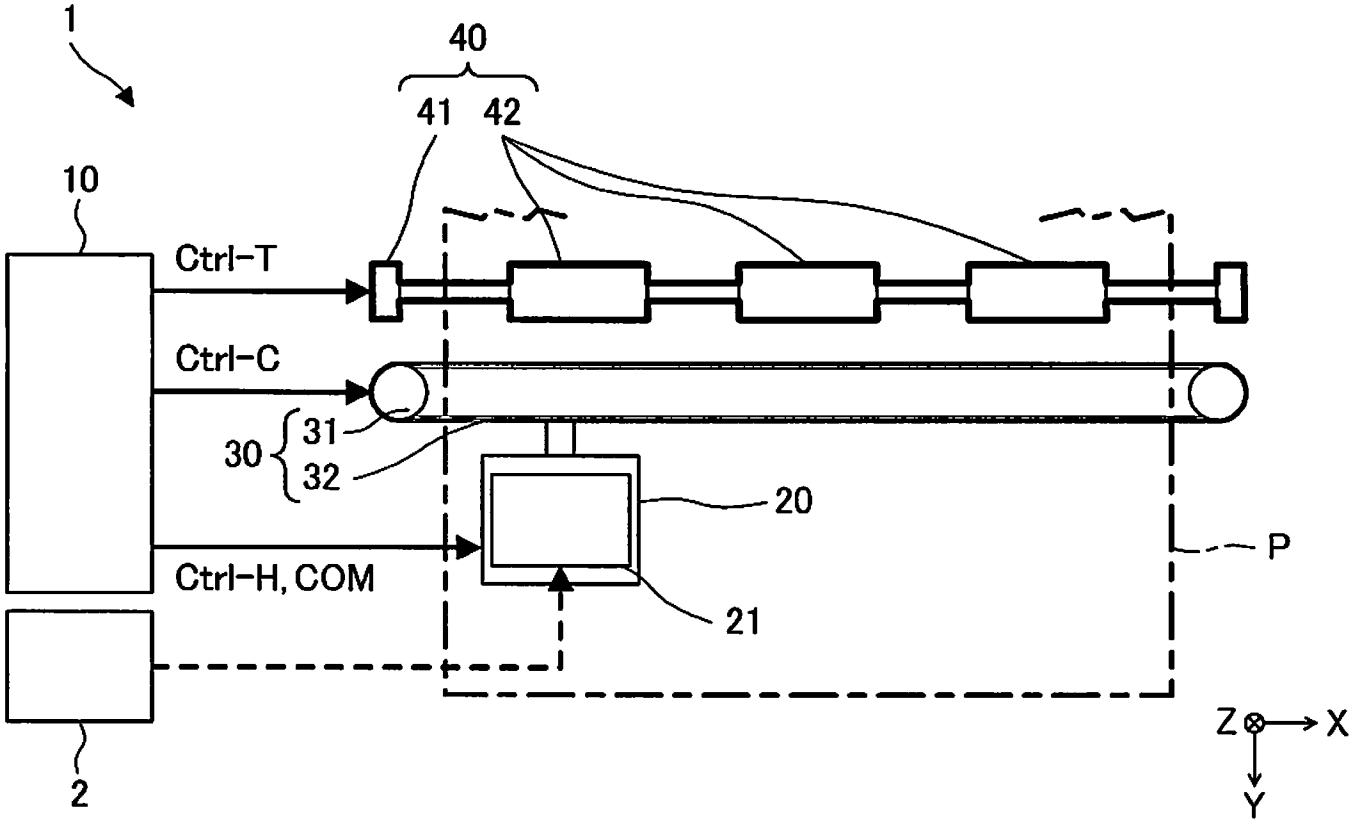
FIG. 1 is a diagram illustrating a schematic configuration of a liquid discharge apparatus.

FIG. 1 is a diagram illustrating a schematic configuration of a liquid discharge apparatus 1.

The liquid discharge apparatus 1 includes a carriage 20 that reciprocates along an X direction, a print head 21 that is mounted on the carriage 20, and a liquid container 2 that supplies the ink as the liquid to the print head 21. Specifically, the liquid discharge apparatus 1 is a serial printing-type ink jet printer that forms an image with respect to a medium P in such a way that the carriage 20, on which the print head 21 for discharging the ink is mounted, reciprocates and the ink is discharged with respect to the medium P which is transported. In the description below, the description will be performed in such a way that a direction in which the carriage 20 reciprocates is set to an X direction, a direction to which the medium P is transported is set to a Y direction, and a direction to which the ink is discharged is set to a Z direction. Meanwhile, the description will be performed in such a way that the X direction, the Y direction, and the Z direction are directions which are orthogonal to each other. In addition, a random printing target, such as printing paper, a resin film, or a fabric, may be used as the medium P. Here, the X direction, in which the carriage 20 reciprocates, is an example of a first direction, and the Y direction which is orthogonal to the X direction is an example of a second direction. In addition, the Z direction is a vertical direction, a −Z direction is an example of a vertically upper part, and a +Z direction is an example of a vertically lower part.

The liquid discharge apparatus 1 includes the liquid container 2, a control mechanism 10, the carriage 20, a movement mechanism 30, and a transport mechanism 40.

A plurality of types of ink discharged to the medium P are stored in the liquid container 2. A color of black, a color of cyan, a color of magenta, a color of yellow, a color of red, a color of gray, and the like are exemplified as colors of the ink stored in the liquid container 2. An ink cartridge, a bursiform ink pack formed of a flexible film, an ink tank enabling supply of the ink, or the like is used as the liquid container 2 which stores the ink. The liquid container 2, which supplies the ink as the liquid to the print head 21, is an example of a liquid accommodation container. In other words, in the embodiment, the liquid, which is supplied from the liquid container 2 to the print head 21, is the ink.

The control mechanism 10 includes, for example, a processing circuit, such as a Central Processing Unit (CPU) or a Field Programmable Gate Array (FPGA), and a memory circuit, such as a semiconductor memory, and controls respective elements of the liquid discharge apparatus 1.

The print head 21 is mounted on the carriage 20. In addition, in a state in which the print head 21 is mounted on the carriage 20, the carriage 20 is fixed to an endless belt 32 included in the movement mechanism 30. Meanwhile, the liquid container 2 may be mounted on the carriage 20.

A control signal Ctrl-H for controlling the print head 21 and one or more driving signals COM for driving the print head 21 are input to the print head 21 from the control mechanism 10. Furthermore, the print head 21 discharges the ink supplied from the liquid container 2 in the Z direction based on the control signal Ctrl-H and the driving signals COM.

The movement mechanism 30 includes a carriage motor 31 and the endless belt 32. The carriage motor 31 operates based on a control signal Ctrl-C input from the control mechanism 10. Furthermore, the endless belt 32 rotates according to an operation of the carriage motor 31. Therefore, the carriage 20 fixed to the endless belt 32 reciprocates in the X direction.

The transport mechanism 40 includes a transport motor 41 and a transport roller 42. The transport motor 41 operates based on a control signal Ctrl-T input from the control mechanism 10. Furthermore, the transport roller 42 rotates according to an operation of the transport motor 41. The medium P is transported in the Y direction in accordance with rotation of the transport roller 42.

As described above, when the liquid discharge apparatus 1 discharges the ink from the print head 21 mounted on the carriage 20 in conjunction with transportation of the medium P by the transport mechanism 40 and reciprocating movement of the carriage 20 by the movement mechanism 30, the ink impacts on a random location of a surface of the medium P, and thus a desired image is formed on the medium P.

1.2 Electrical Configuration of Liquid Discharge Apparatus

Figure 2:
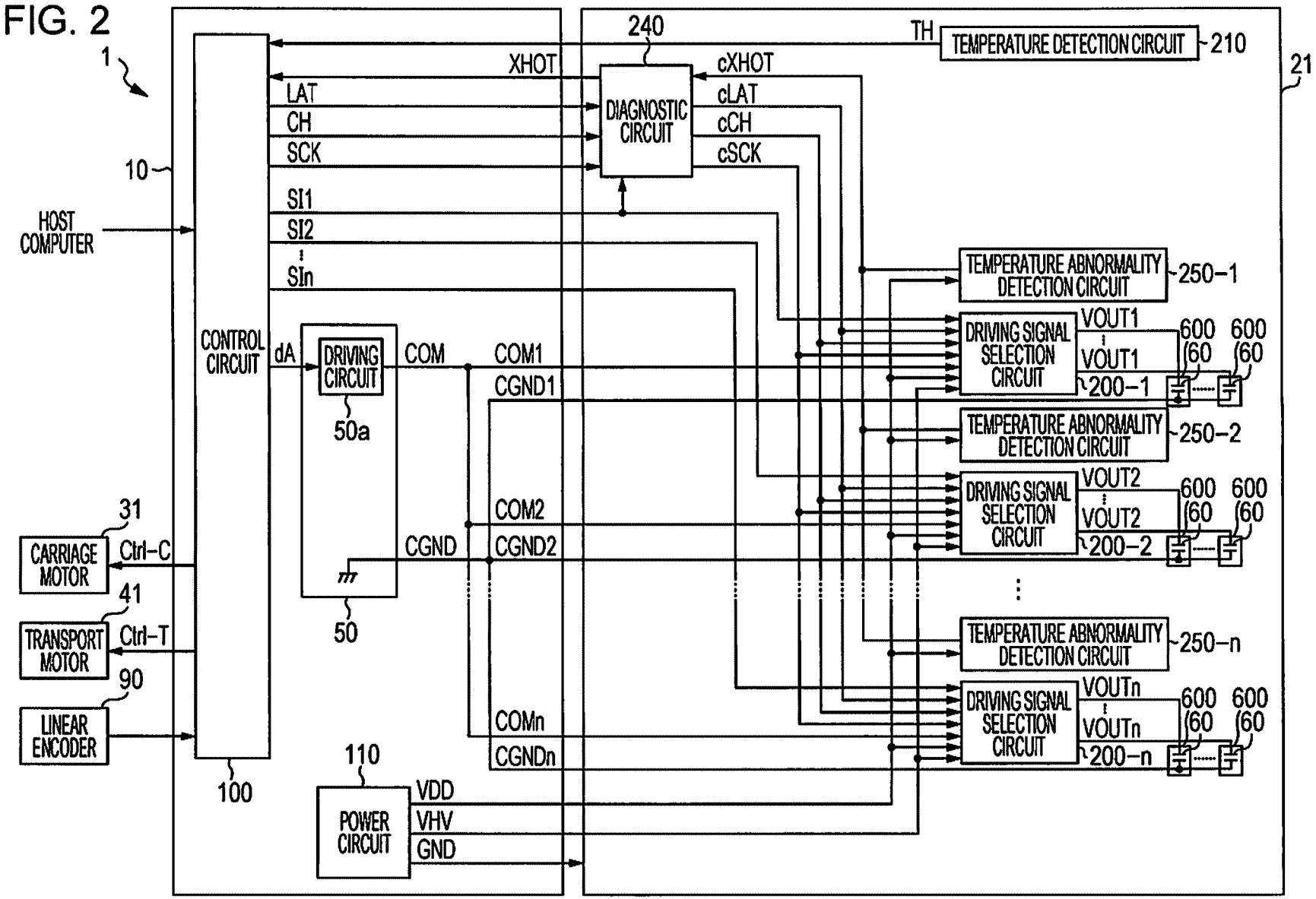
FIG. 2 is a block diagram illustrating an electrical configuration of the liquid discharge apparatus.

FIG. 2 is a block diagram illustrating an electrical configuration of the liquid discharge apparatus 1. The liquid discharge apparatus 1 includes the control mechanism 10, the print head 21, the carriage motor 31, the transport motor 41, and a linear encoder 90. As illustrated in FIG. 2, the control mechanism 10 includes a driving signal output circuit 50, a control circuit 100, and a power circuit 110.

The control circuit 100 includes, for example, a processor such as a micro-controller. Furthermore, the control circuit 100 generates and outputs data and various signals for controlling the liquid discharge apparatus 1 based on various signals such as image data input from a host computer.

Specifically, the control circuit 100 grasps a scanning location of the print head 21 based on a detection signal input from the linear encoder 90. Furthermore, the control circuit 100 outputs the control signal Ctrl-C according to the scanning location of the print head 21 to the carriage motor 31. Therefore, reciprocation of the print head 21 is controlled. In addition, the control circuit 100 outputs the control signal Ctrl-T to the transport motor 41. Therefore, the transportation of the medium P is controlled. Meanwhile, after signal conversion is performed on the control signal Ctrl-C through a not-shown carriage motor driver, the control signal Ctrl-C may be input to the carriage motor 31. In the same manner, after signal conversion is performed on the control signal Ctrl-T through a not-shown transport motor driver, the control signal Ctrl-T may be input to the transport motor 41.

In addition, the control circuit 100 outputs print data signals SI1 to SIn, a change signal CH, a latch signal LAT, and a clock signal SCK, as the control signal Ctrl-H which is a digital signal for controlling the print head 21, to the print head 21 based on the various signals, such as the image data, input from the host computer.

Here, the control circuit 100, which outputs the control signal Ctrl-H that is the digital signal to the print head 21, is an example of a digital signal output circuit. In addition, at least any of the print data signals SI1 to SIn, the change signal CH, the latch signal LAT, and the clock signal SCK, which are included in the control signal Ctrl-H, is an example of the digital signal. In addition, the control circuit 100 may output the control signal Ctrl-H, which is the digital signal, to the print head 21, and is not limited to include one substrate and one circuit. For example, the control circuit 100 may include a plurality of substrates, and may include a plurality of circuits, such as a filter circuit, a buffer circuit, and a relay circuit, in addition to the processor such as the micro-controller. Furthermore, the control circuit 100 may include a plurality of processors such as the micro-controller.

In addition, the control circuit 100 outputs a driving control signal dA, which is the digital signal, to the driving signal output circuit 50.

The driving signal output circuit 50 includes a driving circuit 50*a*. The driving control signal dA is a digital data signal for prescribing a waveform of the driving signal COM, and is input to the driving circuit 50*a*. After digital/analog conversion is performed on the driving control signal dA, the driving circuit 50*a* generates the driving signal COM by performing class D amplification on an analog signal acquired through the conversion. That is, the driving circuit 50*a* generates the driving signal COM by performing class D amplification on a waveform prescribed using the driving control signal dA. Furthermore, the driving signal output circuit 50 outputs the driving signal COM. Meanwhile, the driving control signal dA may be a signal for prescribing the waveform of the driving signal COM, and may be, for example, an analog signal. In addition, the driving circuit 50*a* may be able to amplify the waveform prescribed using the driving control signal dA, and may include, for example, circuits for class A amplification, class B amplification, class AB amplification, and the like.

In addition, the driving signal output circuit 50 outputs a reference voltage signal CGND for indicating a reference potential, for example, a ground potential (0 V) of the driving signal COM. Meanwhile, the reference voltage signal CGND is not limited to a signal of the ground potential, and may be, for example, a signal of a direct current voltage of DC 6 V.

The driving signal COM and the reference voltage signal CGND are output to the print head 21 after branching off in the control mechanism 10. Specifically, the driving signal COM is output to the print head 21 after branching off to n number of driving signals COM1 to COMn, which respectively correspond to n number of driving signal selection circuits 200 that will be described later, in the control mechanism 10. In the same manner, the reference voltage signal CGND is output to the print head 21 after branching off to n number of reference voltage signals CGND1 to CGNDn in the control mechanism 10. Here, the n number of driving signals COM1 to COMn, which are output from the driving signal output circuit 50, may be signals having different waveforms, respectively. In addition, in this case, the driving signal output circuit 50 may include n number of driving circuits 50*a* which respectively generate the driving signals COM1 to COMn having different waveforms.

The power circuit 110 generates and outputs a high voltage signal VHV, a low voltage signal VDD, and a ground signal GND. The high voltage signal VHV is a signal having a voltage of, for example, DC 42 V. In addition, the low voltage signal VDD is a signal having a voltage of, for example, 3.3 V. In addition, the ground signal GND is a signal which indicates a reference potential of the high voltage signal VHV and the low voltage signal VDD, and is a signal of, for example, the ground potential (0 V). The high voltage signal VHV is used for an amplification voltage or the like in the driving signal output circuit 50. In addition, the low voltage signal VDD and the ground signal GND are respectively used for power voltages of various components in the control mechanism 10. In addition, the high voltage signal VHV, the low voltage signal VDD, and the ground signal GND are also output to the print head 21, respectively. Meanwhile, voltages of the high voltage signal VHV, the low voltage signal VDD, and the ground signal GND are not limited to the above-described DC 42 V, DC 3.3 V, and 0 V. In addition, the power circuit 110 may generate and output a plurality of signals other than the high voltage signal VHV, the low voltage signal VDD, and the ground signal GND.

The print head 21 includes n number of driving signal selection circuits 200-1 to 200-*n*, a temperature detection circuit 210, n number of temperature abnormality detection circuits 250-1 to 250-*n*, a plurality of discharge sections 600, and a diagnosis circuit 240.

The print data signal SI1, the change signal CH, the latch signal LAT, and the clock signal SCK are input to the diagnosis circuit 240. The diagnosis circuit 240 diagnoses whether or not it is possible to normally discharge ink in the print head 21 based on the print data signal SI1, the change signal CH, the latch signal LAT, and the clock signal SCK. In other words, the diagnosis circuit 240 determines existence/non-existence of operation abnormality of the print head 21. Furthermore, the diagnosis circuit 240 outputs an abnormality signal XHOT which indicates the existence/non-existence of the operation abnormality of the print head 21. That is, the print head 21 has a function of performing self-diagnosis based on the print data signal SI1, the change signal CH, the latch signal LAT, and the clock signal SCK.

For example, the diagnosis circuit 240 detects respective voltages of the print data signal SI1, the change signal CH, the latch signal LAT, and the clock signal SCK which are input. Furthermore, the diagnosis circuit 240 diagnoses whether or not electrical coupling between the control mechanism 10 and the print head 21 is normal based on the detected voltages. In addition, for example, the diagnosis circuit 240 detects timing at which the print data signal SI1, the change signal CH, the latch signal LAT, and the clock signal SCK are input. Furthermore, the diagnosis circuit 240 diagnoses whether or not waveforms of the print data signal SI1, the change signal CH, the latch signal LAT, and the clock signal SCK, which are input to the print head 21, are normal based on the detected timing of the signals. As above, the diagnosis circuit 240 detects whether or not the print data signal SI1, the change signal CH, the latch signal LAT, and the clock signal SCK, which are input, are normal, and diagnoses whether or not it is possible to normally discharge the ink in the print head 21 based on a result of the detection. That is, the diagnosis circuit 240 diagnoses whether or not it is possible to normally discharge the ink in the print head 21. Furthermore, when the operation abnormality does not occur in the print head 21, the diagnosis circuit 240 outputs the abnormality signal XHOT at one logical level of a high level and a low level. When the operation abnormality occurs in the print head 21, the diagnosis circuit 240 outputs the abnormality signal XHOT at another logical level of the high level and the low level.

When the diagnosis circuit 240 diagnose that the print data signal SI1, the change signal CH, the latch signal LAT, and the clock signal SCK are normal, the diagnosis circuit 240 outputs a change signal cCH, a latch signal cLAT, and a clock signal cSCK. Here, the change signal cCH, the latch signal cLAT, and the clock signal cSCK may be signals having waveforms which are the same as those of the change signal CH, the latch signal LAT, and the clock signal SCK which are input to the diagnosis circuit 240. In addition, the change signal cCH, the latch signal cLAT, and the clock signal cSCK may be signals having waveforms acquired by correcting the change signal CH, the latch signal LAT, and the clock signal SCK. In addition, the change signal cCH, the latch signal cLAT, and the clock signal cSCK may be signals having waveforms which are different from those of the change signal CH, the latch signal LAT, and the clock signal SCK acquired through conversion based on the change signal CH, the latch signal LAT, and the clock signal SCK. The diagnosis circuit 240 includes, for example, one or more Integrated Circuit (IC) apparatuses.

In addition, after the print data signal SI1 in the signals, which are input to the diagnosis circuit 240, branches off in the print head 21, one of the branching signals is input to the diagnosis circuit 240, and another signal is input to a driving signal selection circuit 200-1 which will be described later. The print data signal SI1 is a signal of a high transmission rate, compared to the latch signal LAT and the change signal CH. After the print data signal SI1 branches off in the print head 21, only one of the branching signals is input to the diagnosis circuit 240, and thus it is possible to reduce a possibility that distortion occurs in the waveform of the print data signal SI1 which is input to the driving signal selection circuit 200-1.

The respective driving signal selection circuits 200-1 to 200-*n* perform selection or non-selection on the driving signal COM based on the print data signals SI1 to SIn, the clock signal cSCK, the latch signal cLAT, and the change signal cCH which are input. Therefore, the respective driving signal selection circuits 200-1 to 200-*n* generate driving signals VOUT1 to VOUTn. Furthermore, the respective driving signal selection circuits 200-1 to 200-*n* supply the generated driving signals VOUT1 to VOUTn to piezoelectric elements 60 included in relevant discharge sections 600. The piezoelectric element 60 is displaced when the driving signal VOUT is supplied. Furthermore, an amount of ink corresponding to the displacement is discharged from the discharge section 600.

Specifically, the driving signal COM1, the print data signal SI1, the latch signal cLAT, the change signal cCH, and the clock signal cSCK are input to the driving signal selection circuit 200-1. Furthermore, the driving signal selection circuit 200-1 outputs the driving signal VOUT1 by performing selection or non-selection on the waveform of the driving signal COM1 based on the print data signal SI1, the latch signal cLAT, the change signal cCH, and the clock signal cSCK. The driving signal VOUT1 is supplied to one end of the piezoelectric element 60 of the relevantly provided discharge section 600. In addition, the reference voltage signal CGND1 is supplied to another end of the piezoelectric element 60. Furthermore, the piezoelectric element 60 displaces according to a potential difference between the driving signal VOUT1 and the reference voltage signal CGND1.

In the same manner, a driving signal COMi, a print data signal SIi, the latch signal cLAT, the change signal cCH, and the clock signal cSCK are input to a driving signal selection circuit 200-*i* (i is any one of 1 to n). Furthermore, the driving signal selection circuit 200-*i* outputs a driving signal VOUTi by performing selection or non-selection on a waveform of the driving signal COMi based on the print data signal SIi, the latch signal cLAT, the change signal cCH, and the clock signal cSCK. The driving signal VOUTi is supplied to one end of the piezoelectric element 60 of the relatively provided discharge section 600. In addition, a reference voltage signal CGNDi is supplied to another end of the piezoelectric element 60. Furthermore, the piezoelectric element 60 displaces according to a potential difference between the driving signal VOUTi and the reference voltage signal CGNDi.

Here, the n number of driving signal selection circuits 200-1 to 200-*n* have the same circuit configuration. Therefore, in the description below, when it is not necessary to distinguish between the driving signal selection circuits 200-1 to 200-*n*, there is a case where the driving signal selection circuits 200-1 to 200-*n* are referred to as the driving signal selection circuit 200. In addition, in this case, the driving signals COM1 to COMn, which are input to the driving signal selection circuit 200, are referred to as the driving signal COM, and the print data signals SI1 to Sin are referred to as the print data signal SI. In addition, the driving signals VOUT1 to VOUTn, which are output from the driving signal selection circuit 200, are referred to as the driving signal VOUT. The respective driving signal selection circuits 200-1 to 200-*i* are formed as, for example, an IC apparatus.

The temperature detection circuit 210 includes a not-shown temperature sensor such as a thermistor. The temperature sensor detects a temperature of the print head 21. Furthermore, the temperature detection circuit 210 generates a temperature signal TH which is an analog signal including temperature information of the print head 21, and outputs the temperature signal TH to the control circuit 100.

The temperature abnormality detection circuits 250-1 to 250-*n* are provided to correspond to the respective driving signal selection circuits 200-1 to 200-*n*. Furthermore, the temperature abnormality detection circuits 250-1 to 250-*n* diagnose existence/non-existence of temperature abnormality of the relevant driving signal selection circuits 200-1 to 200-*n*, and output digital abnormality signals cXHOT which indicate whether or not temperatures of the relevant driving signal selection circuits 200-1 to 200-*n* are abnormal. Specifically, the respective temperature abnormality detection circuits 250-1 to 250-*n* diagnose whether or not the temperatures of the relevant driving signal selection circuits 200-1 to 200-*n* are abnormal. Furthermore, when it is determined that the temperatures of the relevant driving signal selection circuits 200-1 to 200-*n* are normal, the respective temperature abnormality detection circuits 250-1 to 250-*n* generate the abnormality signal cXHOT at an H level and output the abnormality signal cXHOT to the diagnosis circuit 240. In addition, when it is determined that the temperatures of the relevant driving signal selection circuits 200-1 to 200-*n* are abnormal, the respective temperature abnormality detection circuits 250-1 to 250-*n* generate the abnormality signal XHOT at an L level and output the abnormality signal XHOT to the diagnosis circuit 240. Meanwhile, the logical level of the abnormality signal cXHOT is an example. For example, when it is determined that the temperature of the print head 21 is normal, the temperature abnormality detection circuit 250 may generate the abnormality signal cXHOT at the L level. When it is determined that the temperature of the print head 21 is abnormal, the temperature abnormality detection circuit 250 may generate the abnormality signal cXHOT at the H level.

According to the logical level of the abnormality signal cXHOT which is input, when the temperatures of the respective driving signal selection circuits 200-1 to 200-*n* are normal, the diagnosis circuit 240 outputs the abnormality signal XHOT at any one logical level of the high level and the low level to the control circuit 100, and, when the temperatures of the respective driving signal selection circuits 200-1 to 200-*n* are abnormal, the diagnosis circuit 240 outputs the abnormality signal XHOT at another logical level of the high level and the low level to the control circuit 100. That is, the diagnosis circuit 240 determines the operation abnormality of the print head 21 based on the logical level of the abnormality signal cXHOT which is input. Meanwhile, the diagnosis circuit 240 may output the abnormality signal cXHOT, which is input, as the abnormality signal XHOT.

The control circuit 100 performs various processes, such as stop of the operation of the liquid discharge apparatus 1 and correction of the waveform of the driving signal COM, according to the temperature signal TH and the abnormality signal XHOT, which are input. That is, the abnormality signal XHOT is a signal which indicates the existence/non-existence of the operation abnormality of the print head 21 and the driving signal selection circuits 200-1 to 200-*n*. Therefore, it is possible to increase a discharge accuracy of the ink from the discharge section 600, and it is possible to prevent, in a print state, the operation abnormality, a failure, and the like of the print head 21 and the driving signal selection circuits 200-1 to 200-*n* from occurring. That is, the diagnosis, performed by the temperature abnormality detection circuits 250-1 to 250-*n*, of whether or not the temperatures of the print head 21 and the driving signal selection circuits 200-1 to 200-*n* are abnormal, is one of the self-diagnosis of the print head 21. Meanwhile, the respective temperature abnormality detection circuits 250-1 to 250-*n* may be formed as, for example, IC apparatuses. In addition, as described above, the respective temperature abnormality detection circuits 250-1 to 250-*n* are provided to correspond to the respective driving signal selection circuits 200-1 to 200-*n*. Therefore, the respective driving signal selection circuits 200-1 to 200-*n* and the relevant temperature abnormality detection circuits 250-1 to 250-*n* may be formed as one IC apparatus.

Here, in the above-described liquid discharge apparatus 1, a configuration, which includes the print head 21 and the control circuit 100 that outputs the control signal Ctrl-H for controlling an operation of the print head 21, corresponds to a liquid discharge system which discharges the liquid.

1.3 Example of Waveform of Driving Signal

Here, an example of the waveform of the driving signal COM, which is generated and output by the driving signal output circuit 50, and an example of the waveform of the driving signal VOUT, which is supplied to the piezoelectric element 60, will be described with reference to FIGS. 3 and 4.

Figure 3:
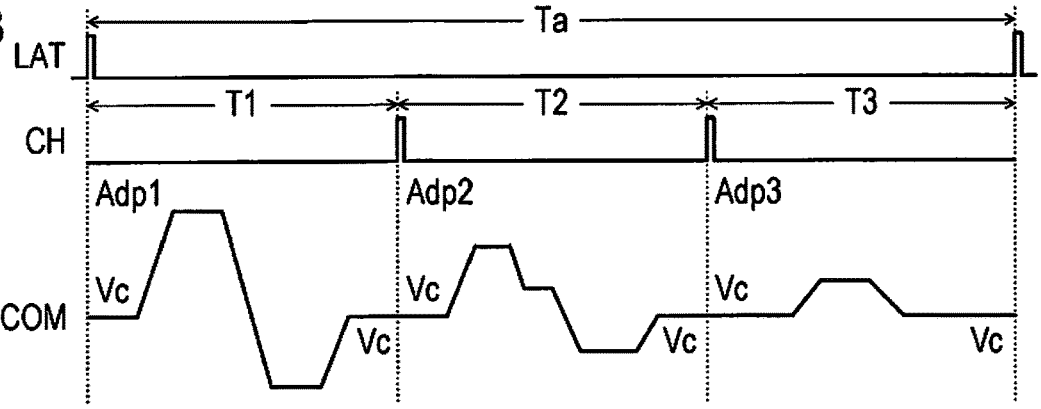
FIG. 3 is a diagram illustrating an example of a waveform of a driving signal.

FIG. 3 is a diagram illustrating the example of the waveform of the driving signal COM. As illustrated in FIG. 3, the driving signal COM is a waveform acquired by succeeding a trapezoid waveform Adp1 disposed in a period T1 from when the latch signal LAT rises to when the change signal CH rises, a trapezoid waveform Adp2 disposed in a period T2 until the change signal CH subsequently rises after the period T1, and a trapezoid waveform Adp3 disposed in a period T3 until the latch signal LAT subsequently rises after the period T2. Furthermore, when the trapezoid waveform Adp1 is supplied to one end of the piezoelectric element 60, an intermediate amount of ink is discharged from the discharge section 600 corresponding to the piezoelectric element 60. In addition, when the trapezoid waveform Adp2 is supplied to one end of the piezoelectric element 60, a small amount, which is less than the intermediate amount, of ink is discharged from the discharge section 600 corresponding to the piezoelectric element 60. In addition, when the trapezoid waveform Adp3 is supplied to one end of the piezoelectric element 60, the ink is not discharged from the discharge section 600 corresponding to the piezoelectric element 60. Here, the trapezoid waveform Adp3 is a waveform for preventing ink viscosity from increasing by slightly vibrating the ink in a vicinity of a nozzle opening section of the discharge section 600.

Here, a cycle Ta, from when the latch signal LAT illustrated in FIG. 3 rises to when the latch signal LAT subsequently rises, corresponds to a print cycle at which a new dot is formed on the medium P. That is, the latch signal LAT is also a signal for prescribing ink discharge timing. In other words, the latch signal LAT serves both as a signal for performing the self-diagnosis of the print head 21 and a signal for prescribing the ink discharge timing. In addition, the change signal CH is also a signal for prescribing waveform switching timing of the trapezoid waveforms Adp1, Adp2, and Adp3 included in the driving signal COM. In other words, the change signal CH serves both as the signal for performing the self-diagnosis of the print head 21 and a signal for prescribing waveform switching timing of the driving signal COM.

Meanwhile, all voltages at timings, at which the respective trapezoid waveforms Adp1, Adp2, and Adp3 start and end, are common to a voltage Vc. That is, the respective trapezoid waveforms Adp1, Adp2, and Adp3 are waveforms which start with the voltage Vc and end with the voltage Vc. Meanwhile, the driving signal COM may be, at the cycle Ta, a signal having a waveform acquired by succeeding one or two trapezoid waveforms or may be a signal having a waveform acquired by succeeding four or more trapezoid waveforms.

Here, the driving signal COM is a signal of a high voltage amplified by the high voltage signal VHV. That is, the driving signal COM has vibration of a larger voltage value than those of the print data signals SI1 to SIn, the change signal CH, the latch signal LAT and the clock signal SCK which are included in the control signal Ctrl-H, and includes the trapezoid waveforms Adp1, Adp2, and Adp3. The driving signal COM is an example of the trapezoid waveform signal, and the trapezoid waveforms Adp1, Adp2, and Adp3 included in the driving signal COM are examples of the trapezoid waveform. Furthermore, the driving signal output circuit 50 or the driving circuit 50*a*, which outputs the driving signal COM, is an example of a trapezoid waveform signal output circuit.

Figure 4:
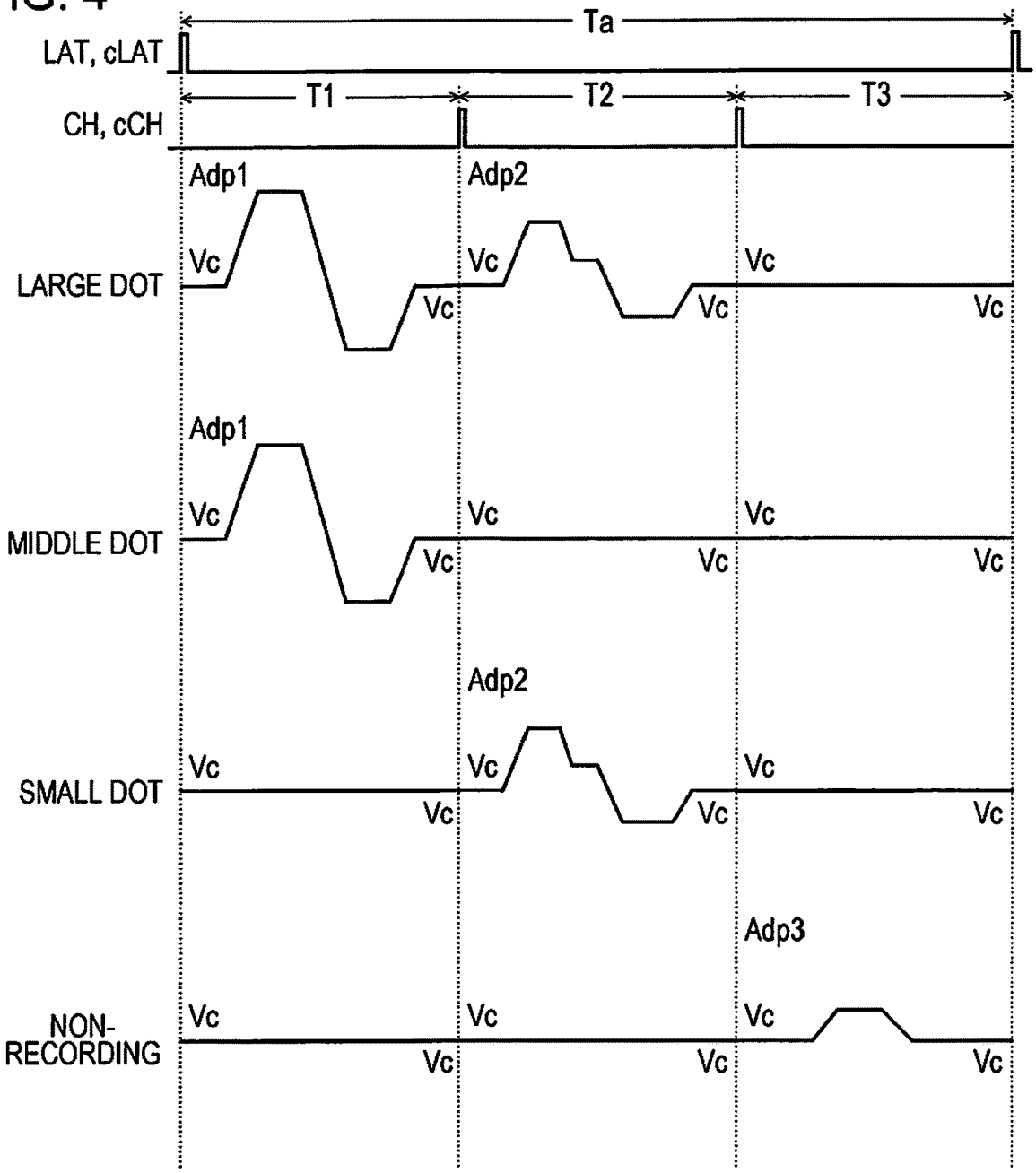
FIG. 4 is a diagram illustrating an example of a waveform of a driving signal.

FIG. 4 is a diagram illustrating an example of a waveform of the driving signal VOUT corresponding to each of a "large dot", a "middle dot", a "small dot", and a "non-recording".

As illustrated in FIG. 4, the driving signal VOUT corresponding to the "large dot" has a waveform acquired by succeeding, at the cycle Ta, the trapezoid waveform Adp1 disposed in the period T1, the trapezoid waveform Adp2 disposed in the period T2, and a voltage waveform disposed in the period T3 to be fixed at the voltage Vc. When the driving signal VOUT is supplied to one end of the piezoelectric element 60, an intermediate amount of ink and a small amount of ink are discharged from the discharge section 600 corresponding to the piezoelectric element 60 at the cycle Ta. Therefore, the ink impacts and combines with each other on the medium P, and thus the large dot is formed.

The driving signal VOUT corresponding to the "middle dot" is a waveform acquired by succeeding, at the cycle Ta, the trapezoid waveform Adp1 disposed in the period T1 and a voltage waveforms disposed in the periods T2 and T3 to be fixed at the voltage Vc. When the driving signal VOUT is supplied to one end of the piezoelectric element 60, an intermediate amount of ink is discharged from the discharge section 600 corresponding to the piezoelectric element 60 at the cycle Ta. Therefore, the ink impacts on the medium P, and thus a middle dot is formed.

The driving signal VOUT corresponding to the "small dot" is a waveform acquired by succeeding, at the cycle Ta, the voltage waveforms disposed in the periods T1 and T3 to be fixed at the voltage Vc and the trapezoid waveform Adp2 disposed in the period T2. When the driving signal VOUT is supplied to one end of the piezoelectric element 60, a small amount of ink is discharged from the discharge section 600 corresponding to the piezoelectric element 60 at the cycle Ta. Therefore, the ink impacts on the medium P, and thus the small dot is formed.

The driving signal VOUT corresponding to the "non-recording" is a waveform acquired by succeeding, at the cycle Ta, the voltage waveforms disposed in the periods T1 and T2 to be fixed at the voltage Vc and the trapezoid waveform Adp3 disposed in the period T3. When the driving signal VOUT is supplied to one end of the piezoelectric element 60, the ink in the vicinity of the nozzle opening section of the discharge section 600 corresponding to the piezoelectric element 60 only slightly vibrates at the cycle Ta, and thus the ink is not discharged. Therefore, the ink is not impacted on the medium P and the dot is not formed.

Here, the voltage waveform fixed at the voltage Vc is a waveform having a voltage, in which an immediately before voltage Vc is maintained by a capacity component of the piezoelectric element 60, when none of the trapezoid waveforms Adp1, Adp2, and Adp3 is selected as the driving signal VOUT. Therefore, when none of the trapezoid waveforms Adp1, Adp2, and Adp3 is selected as the driving signal VOUT, the voltage waveform fixed at the voltage Vc is supplied, as the driving signal VOUT, to the piezoelectric element 60.

Meanwhile, the driving signal COM and the driving signal VOUT, which are illustrated in FIGS. 3 and 4, are only examples, and a combination of various waveforms may be used according to a movement speed of the carriage 20 on which the print head 21 is mounted, a physical property of the ink supplied to the print head 21, a material of the medium P, and the like.

1.4 Configuration and Operation of Driving Signal Selection Circuit

Figure 5:
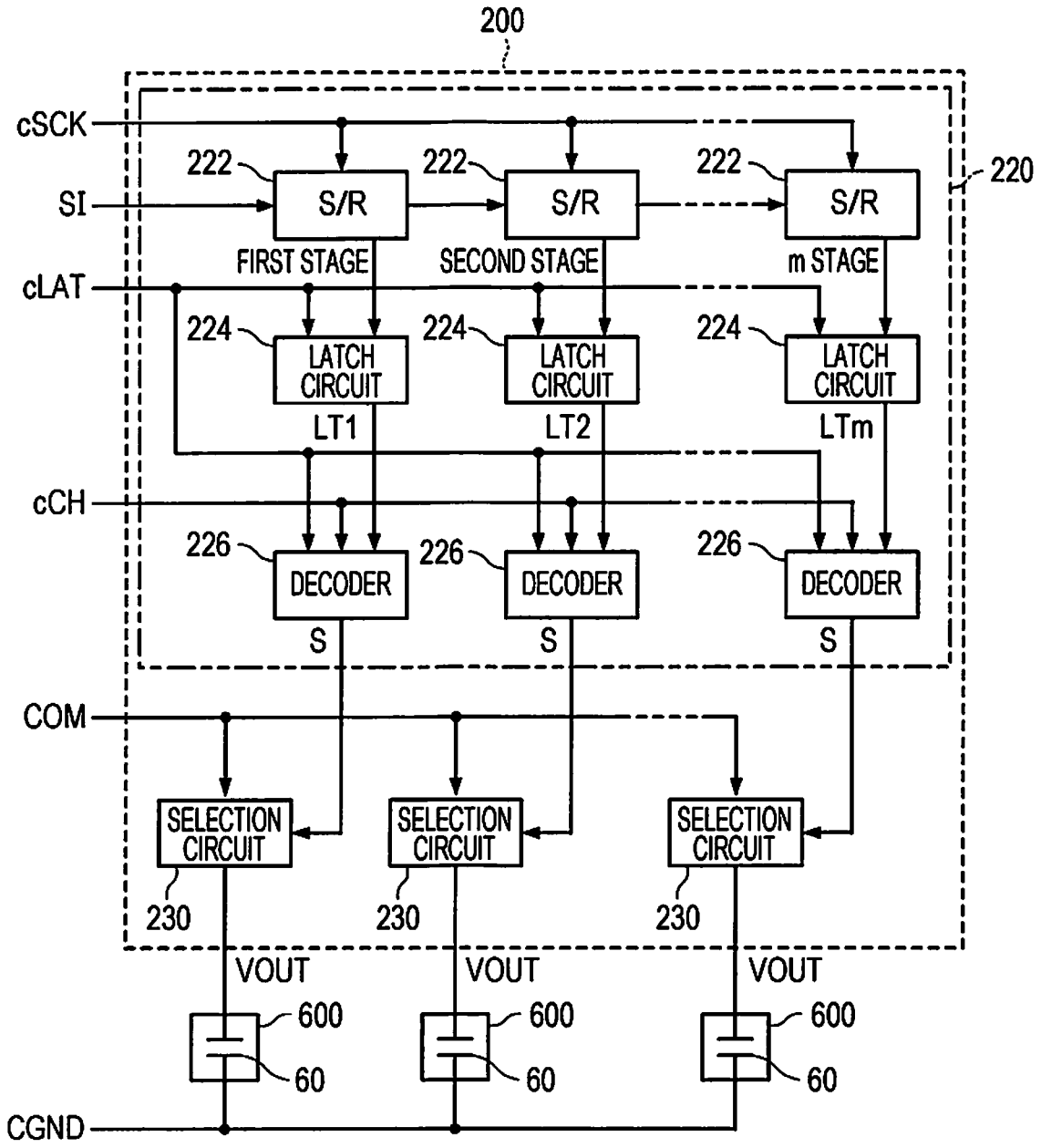
FIG. 5 is a diagram illustrating a configuration of a driving signal selection circuit.

Subsequently, a configuration and an operation of the driving signal selection circuit 200 will be described with reference to FIGS. 5 to 8. FIG. 5 is a diagram illustrating a configuration of the driving signal selection circuit 200. As illustrate in FIG. 5, the driving signal selection circuit 200 includes a selection control circuit 220 and a plurality of selection circuits 230.

The print data signal SI, the latch signal cLAT, the change signal cCH, and the clock signal cSCK are input to the selection control circuit 220. In addition, in the selection control circuit 220, a set of a shift register (S/R) 222, a latch circuit 224, and a decoder 226 is provided to correspond to each of the plurality of discharge sections 600. That is, the driving signal selection circuit 200 includes sets of the shift register 222, the latch circuit 224, and the decoder 226, the number of sets being the same as a total number m of the relevant discharge sections 600. Here, the print data signal SI is also a signal for prescribing waveform selection of the trapezoid waveforms Adp1, Adp2, and Adp3 included in the driving signal COM. That is, the print data signal SI1 in the print data signal SI serves both as the signal for performing the self-diagnosis of the print head 21 and the signal for prescribing the waveform selection of the driving signal COM. In addition, the clock signal SCK and the clock signal cSCK prescribe timing at which the print data signal SI is input to the selection control circuit 220. That is, the clock signal SCK serves both as the signal for performing the self-diagnosis of the print head 21 and a clock signal SCK for inputting the print data signal SI.

Specifically, the print data signal SI is a signal synchronized with the clock signal SCK, and is a total 2 m-bit signal including 2-bit print data [SIH, SIL] for selecting any of the "large dot", the "middle dot", the "small dot", and the "non-recording" with respect to each of the m number of discharge sections 600. The print data signal SI is maintained in the shift register 222 for each 2-bit print data [SIH, SIL] included in the print data signal SI to be correspond to the discharge section 600. Specifically, the stage shift registers 222 in m stages corresponding to the discharge sections 600 are cascade coupled to each other, and the serially-input print data signal SI is sequentially transmitted to a subsequent stage according to the clock signal cSCK. Meanwhile, in FIG. 5, in order to distinguish the shift registers 222, a first stage, a second stage, . . . , an m-th stage are sequentially described from upstream to which the print data signal SI is input. Here, the print data signal SI may be a signal which includes, in the 2-bit print data [SIH, SIL], the print data [SIH] corresponding to each of the m number of discharge sections 600 in serial and which includes, subsequent to the print data [SIH] corresponding to each of the m number of discharge sections 600, the print data [SIL] corresponding to each of the m number of discharge sections 600 in serial.

Each of the m number of latch circuits 224 latches the 2-bit print data [SIH, SIL] maintained in each of the m number of shift register 222 when the latch signal cLAT rises.

Each of the m number of decoders 226 decodes the 2-bit print data [SIH, SIL] latched by each of the m number of latch circuits 224. Furthermore, the decoder 226 outputs a selection signal S for each of the periods T1, T2, and T3 prescribed by the latch signal cLAT and the change signal cCH.

Figures 6, 7:
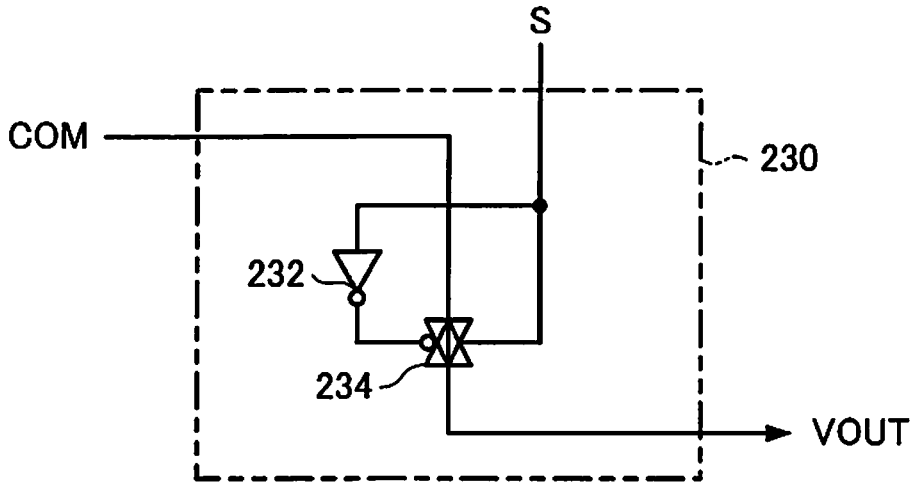
FIG. 6 is a table illustrating decoding content of a decoder.
FIG. 7 is a diagram illustrating a configuration of a selection circuit corresponding to one discharge section.

FIG. 6 is a table illustrating decoding content of the decoder 226. The decoder 226 outputs the selection signal S according to the latched 2-bit print data [SIH, SIL]. For example, when the 2-bit print data [SIH, SIL] is [1, 0], the decoder 226 outputs the selection signal S while setting the logical level of the selection signal to H, H, and L levels in the respective periods T1, T2, and T3.

The selection circuits 230 are provided to correspond to the respective discharge sections 600. That is, the number of selection circuits 230 included in the driving signal selection circuit 200 is the same as the total number m of the relevant discharge sections 600. FIG. 7 is a diagram illustrating a configuration of the selection circuit 230 corresponding to one discharge section 600. As illustrated in FIG. 7, the selection circuit 230 includes an inverter 232 which is a NOT circuit and a transfer gate 234.

The selection signal S is input to a positive control end, to which a round mark is not attached, in the transfer gate 234, and is input to a negative control end, to which the round mark is attached, in the transfer gate 234 by being logically inverted by the inverter 232. In addition, the driving signal COM is supplied to an input end of the transfer gate 234. Specifically, when the selection signal S is at the H level, the transfer gate 234 conducts (on) between the input end and the output end. When the selection signal S is at the L level, the transfer gate 234 does not conduct (off) between the input end and the output end. Furthermore, the driving signal VOUT is output from the output end of the transfer gate 234.

Figure 8:
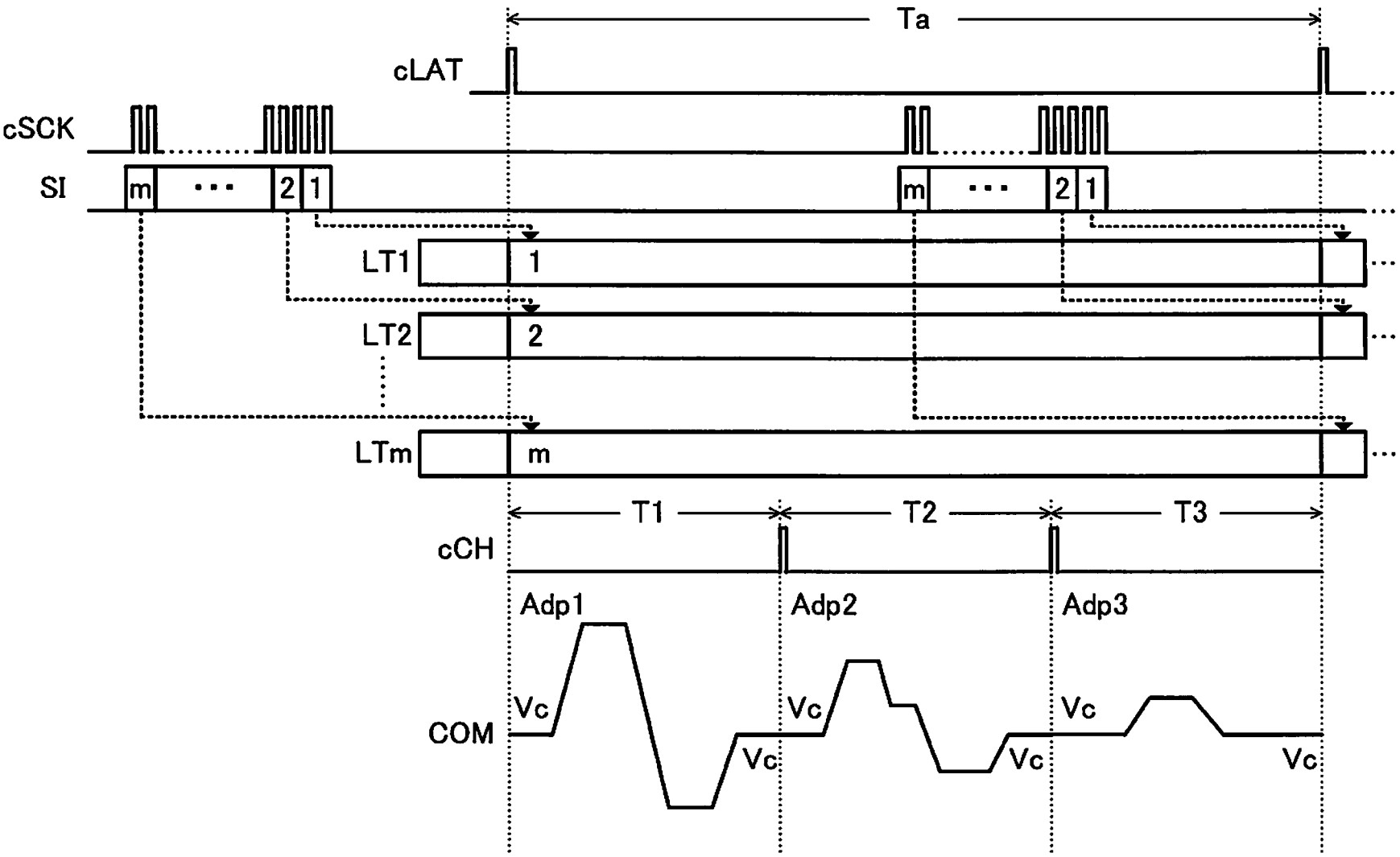
FIG. 8 is a diagram illustrating an operation of the driving signal selection circuit.

Here, an operation of the driving signal selection circuit 200 will be described with reference to FIG. 8. FIG. 8 is a diagram illustrating the operation of the driving signal selection circuit 200. The print data signal SI is serially input in synchronization with the clock signal cSCK, and is sequentially transmitted in the shift registers 222 corresponding to the discharge sections 600. Furthermore, when the input of the clock signal cSCK stops, the 2-bit print data [SIR, SIL] corresponding to each of the discharge sections 600 is maintained in each of the shift registers 222. Meanwhile, the print data signal SI is input in order which corresponds to the discharge sections 600 at the m-th stage, . . . , the second stage, and the first stage of the shift registers 222.

Furthermore, when the latch signal cLAT rises, the respective latch circuits 224 simultaneously latch the 2-bit print data [SIH, SIL] maintained in the shift registers 222. Meanwhile, in FIG. 8, LT1, LT2, . . . , LTm indicate the 2-bit print data [SIH, SIL] latched by the latch circuits 224 corresponding to the first stage, the second stage, . . . , the m-th stage shift registers 222.

The decoder 226 outputs the logical levels of the selection signal S with the content illustrated in FIG. 6 in the respective periods T1, T2, T3 according to the size of the dot prescribed by the latched 2-bit print data [SIH, SIL].

Specifically, when the print data [SIR, SIL] is [1, 1], the decoder 226 sets the selection signal S to H, H, and L levels in the periods T1, T2, and T3. In this case, the selection circuit 230 selects the trapezoid waveform Adp1 in the period T1, selects the trapezoid waveform Adp2 in the period T2, and does not select the trapezoid waveform Adp3 in the period T3. As a result, the driving signal VOUT corresponding to the "large dot" illustrated in FIG. 4 is generated.

In addition, when the print data [SIH, SIL] is [1, 0], the decoder 226 sets the selection signal S to H, L, and L levels in the periods T1, T2, and T3. In this case, the selection circuit 230 selects the trapezoid waveform Adp1 in the period T1, does not selects the trapezoid waveform Adp2 in the period T2, and does not select the trapezoid waveform Adp3 in the period T3. As a result, the driving signal VOUT corresponding to the "middle dot" illustrated in FIG. 4 is generated.

In addition, when the print data [SIH, SIL] is [0, 1], the decoder 226 sets the selection signal S to L, H, and L levels in the periods T1, T2, and T3. In this case, the selection circuit 230 does not select the trapezoid waveform Adp1 in the period T1, selects the trapezoid waveform Adp2 in the period T2, and does not select the trapezoid waveform Adp3 in the period T3. As a result, the driving signal VOUT corresponding to the "small dot" illustrated in FIG. 4 is generated.

In addition, when the print data [SIH, SIL] is [0, 0], the decoder 226 sets the selection signal S to L, L, and H levels in the periods T1, T2, and T3. In this case, the selection circuit 230 does not select the trapezoid waveform Adp1 in the period T1, does not select the trapezoid waveform Adp2 in the period T2, and selects the trapezoid waveform Adp3 in the period T3. As a result, the driving signal VOUT corresponding to the "non-recording" illustrated in FIG. 4 is generated.

As above, the driving signal selection circuit 200 selects the waveform of the driving signal COM based on the print data signal SI, the latch signal cLAT, the change signal cCH, and the clock signal cSCK, and outputs the driving signal VOUT. That is, in the driving signal selection circuit 200, the driving signal VOUT is generated through the selection or non-selection of the waveform of the driving signal COM.

1.5 Configuration of Temperature Abnormality Detection Circuit

Figure 9:
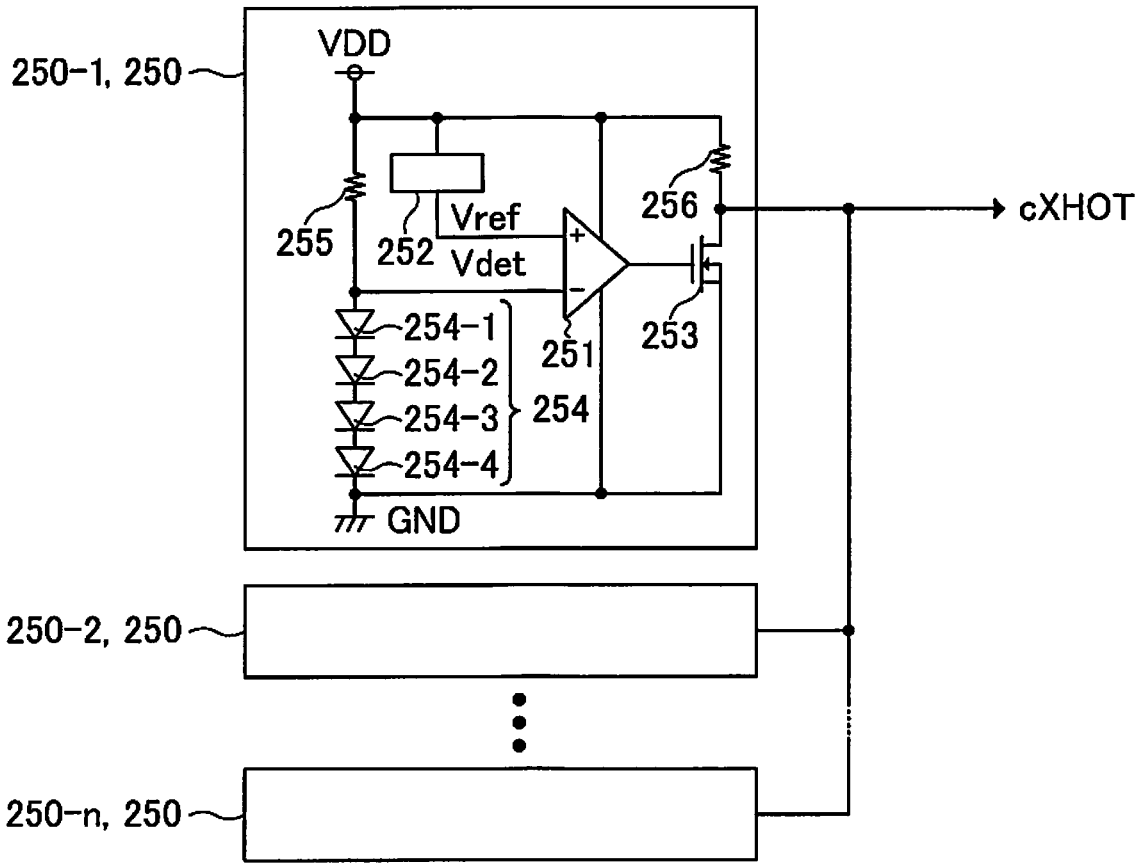
FIG. 9 is a diagram illustrating a configuration of a temperature abnormality detection circuit.

Subsequently, the temperature abnormality detection circuits 250-1 to **250-*n* will be described with reference to FIG. 9. FIG. 9 is a diagram illustrating configurations of the temperature abnormality detection circuits 250-1 to 250-*n*. As illustrated in FIG. 9, the temperature abnormality detection circuit 250-1 includes a comparator 251, a reference voltage output circuit 252, a transistor 253, a plurality of diodes 254, and resistors 255 and 256. Meanwhile, all the temperature abnormality detection circuits 250-1 to 250-*n* have the same configuration. Therefore, in FIG. 9, detailed configurations of the temperature abnormality detections circuit 250-2 to 250-*n*** are not illustrated in the drawing.

The low voltage signal VDD is input to the reference voltage output circuit 252. The reference voltage output circuit 252 generates a voltage Vref by transforming the low voltage signal VDD, and supplies the voltage Vref to a + side input terminal of the comparator 251. The reference voltage output circuit 252 includes, for example, a voltage regulator circuit or the like. Meanwhile, the voltage Vref may be generated based on Band Gap Reference (BGR) of the integrated circuit apparatus included in the temperature abnormality detection circuit 250-1.

The plurality of diodes 254 are coupled to each other in series. Furthermore, the low voltage signal VDD is supplied to an anode terminal of the diode 254, which is located on a highest potential side of the plurality of diodes 254 which are coupled in series, through the resistor 255, and the ground signal GND is supplied to a cathode terminal of the diode 254 which is located on a lowest potential side. Specifically, the temperature abnormality detection circuit 250 includes diodes 254-1, 254-2, 254-3, and 254-4 as the plurality of diodes 254. The low voltage signal VDD is supplied to an anode terminal of the diode 254-1 through the resistor 255, and the anode terminal of the diode 254-1 is coupled to a − side input terminal of the comparator 251. A cathode terminal of the diode 254-1 is coupled to an anode terminal of the diode 254-2. A cathode terminal of the diode 254-2 is coupled to an anode terminal of the diode 254-3. A cathode terminal of the diode 254-3 is coupled to an anode terminal of the diode 254-4. The ground signal GND is supplied to a cathode terminal of the diode 254-4. A voltage Vdet, which is the sum of forward voltages of the plurality of respective diodes 254, is supplied to a− side input terminal of the comparator 251 by the resistor 255 and the plurality of diodes 254, which are formed as described above. Meanwhile, the number of plurality of diodes 254 included in the temperature abnormality detection circuit 250 is not limited to four.

The comparator 251 operates due to potential difference between the low voltage signal VDD and the ground signal GND. Furthermore, the comparator 251 compares the voltage Vref supplied to the + side input terminal with the voltage Vdet supplied to the − side input terminal, and outputs a signal, based on a result of the comparison, from the output terminal.

The low voltage signal VDD is supplied to a drain terminal of the transistor 253 through the resistors 256. In addition, the transistor 253 includes a gate terminal coupled to the output terminal of the comparator 251 and a source terminal to which the ground signal GND is supplied. A voltage supplied to the drain terminal, which is coupled as above, of the transistor 253 is output, as the abnormality signal cXHOT, from the temperature abnormality detection circuit 250.

A voltage value of the voltage Vref generated by the reference voltage output circuit 252 is lower than the voltage Vdet which is acquired when the temperatures of the plurality of diodes 254 are included in a prescribed range. In this case, the comparator 251 outputs a signal at the L level. Therefore, control is performed such that the transistor 253 is off, and, as a result, the temperature abnormality detection circuit 250 outputs the abnormality signal cXHOT at the H level.

The forward voltage of the diode 254 has a characteristic of being lowered when the temperature rises. Therefore, when the temperature abnormality occurs in the print head 21, the temperature of the diode 254 rises, and thus the voltage Vdet lowers in accordance therewith. Furthermore, when the voltage Vdet is lower than the voltage Vref because the temperature rises, the output signal of the comparator 251 changes from the L level to the H level. Therefore, control is performed such that the transistor 253 is on. As a result, the temperature abnormality detection circuit 250 outputs the abnormality signal cXHOT at the L level. That is, when the control is performed such that the transistor 253 is on or off based on the temperature of the driving signal selection circuit 200, the temperature abnormality detection circuit 250 outputs, as the abnormality signal cXHOT at the H level, the low voltage signal VDD supplied as a pull-up voltage of the transistor 253, and outputs, as the abnormality signal cXHOT at the L level, the ground signal GND.

Here, as illustrated in FIG. 9, wiring, through which the abnormality signal cXHOT is output from each of the temperature abnormality detection circuits 250-1 to **250-*n*, is commonly coupled. Therefore, wired-OR connection is performed on the temperature abnormality detection circuits 250-1 to 250-*n* with each other. Therefore, when the temperature abnormality occurs in any of the temperature abnormality detection circuits 250-1 to 250-*n*, the abnormality signal cXHOT, which indicates the temperature abnormality, is input to the diagnosis circuit 240**.

1.6 Configuration of Print Head

Subsequently, a configuration of the print head 21 will be described. Meanwhile, in the description below, description is performed while it is assumed that the print head 21 includes six number of driving signal selection circuits 200-1 to 200-6. Therefore, in the print head 21 of the first embodiment, the six number of print data signals SI1 to SI6, the six number of driving signals COM1 to COM6, and the six number of reference voltage signals CGND1 to CGND6, which correspond to the six number of driving signal selection circuits 200-1 to 200-6, respectively, are input.

Figure 10:
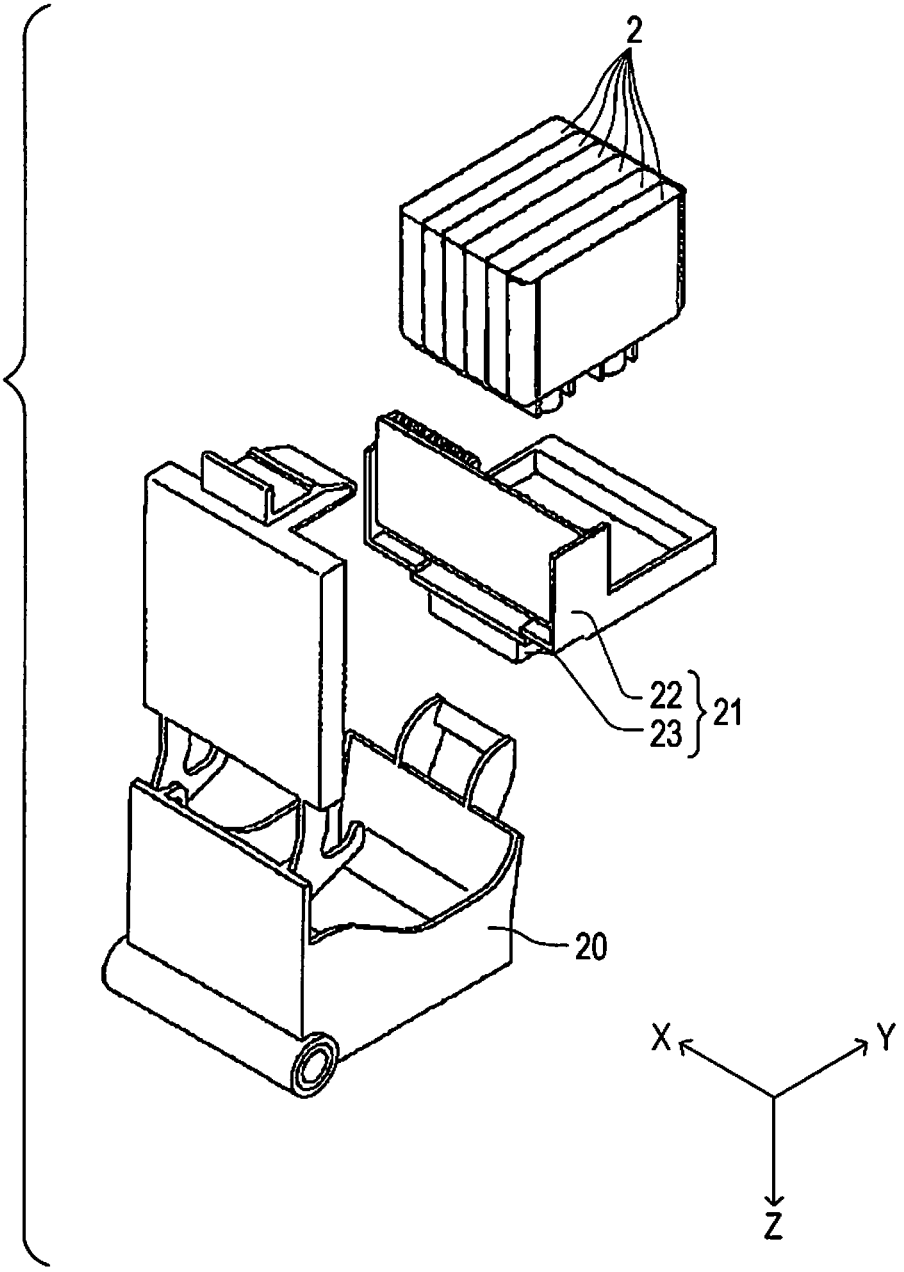
FIG. 10 is a diagram schematically illustrating a print head mounted on a carriage.

FIG. 10 is a diagram schematically illustrating the print head 21 mounted on the carriage 20. As illustrated in FIG. 10, the print head 21 is mounted in the +Z direction of the carriage 20. In addition, the liquid container 2 is mounted in the −Z direction of the print head 21. The print head 21 is coupled to the liquid container 2. Therefore, the ink stored in the liquid container 2 is supplied to the print head 21. The print head 21 includes an ink supply unit 22 to which the liquid container 2 is coupled, and a head substrate unit 23 which is provided in the +Z direction of the ink supply unit 22 and which includes a plurality of nozzles 651 for discharging the ink supplied form the liquid container 2 through the ink supply unit 22.

Figure 11:
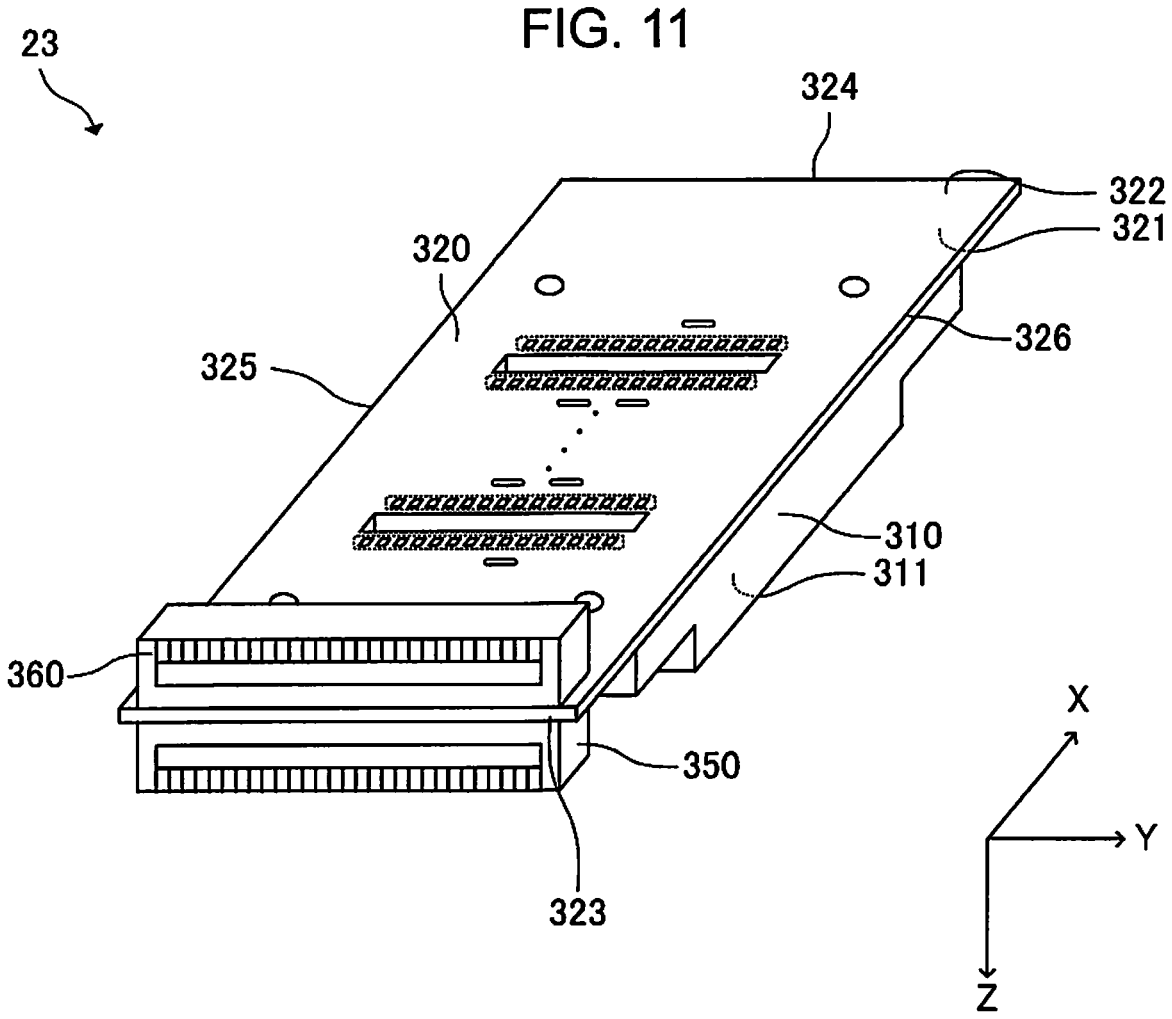
FIG. 11 is a perspective diagram illustrating a configuration of a head substrate unit.

FIG. 11 is a perspective diagram illustrating a configuration of the head substrate unit 23. As illustrated in FIG. 11, the head substrate unit 23 includes a head 310 and a substrate 320. In addition, an ink discharge surface 311, which is formed with the plurality of discharge sections 600, is located on a surface at the vertically lower part, which is the +Z direction, of the head 310. Meanwhile, the ink supply unit 22 is located on an upper side (−Z direction side) of the substrate 320.

Figure 12:
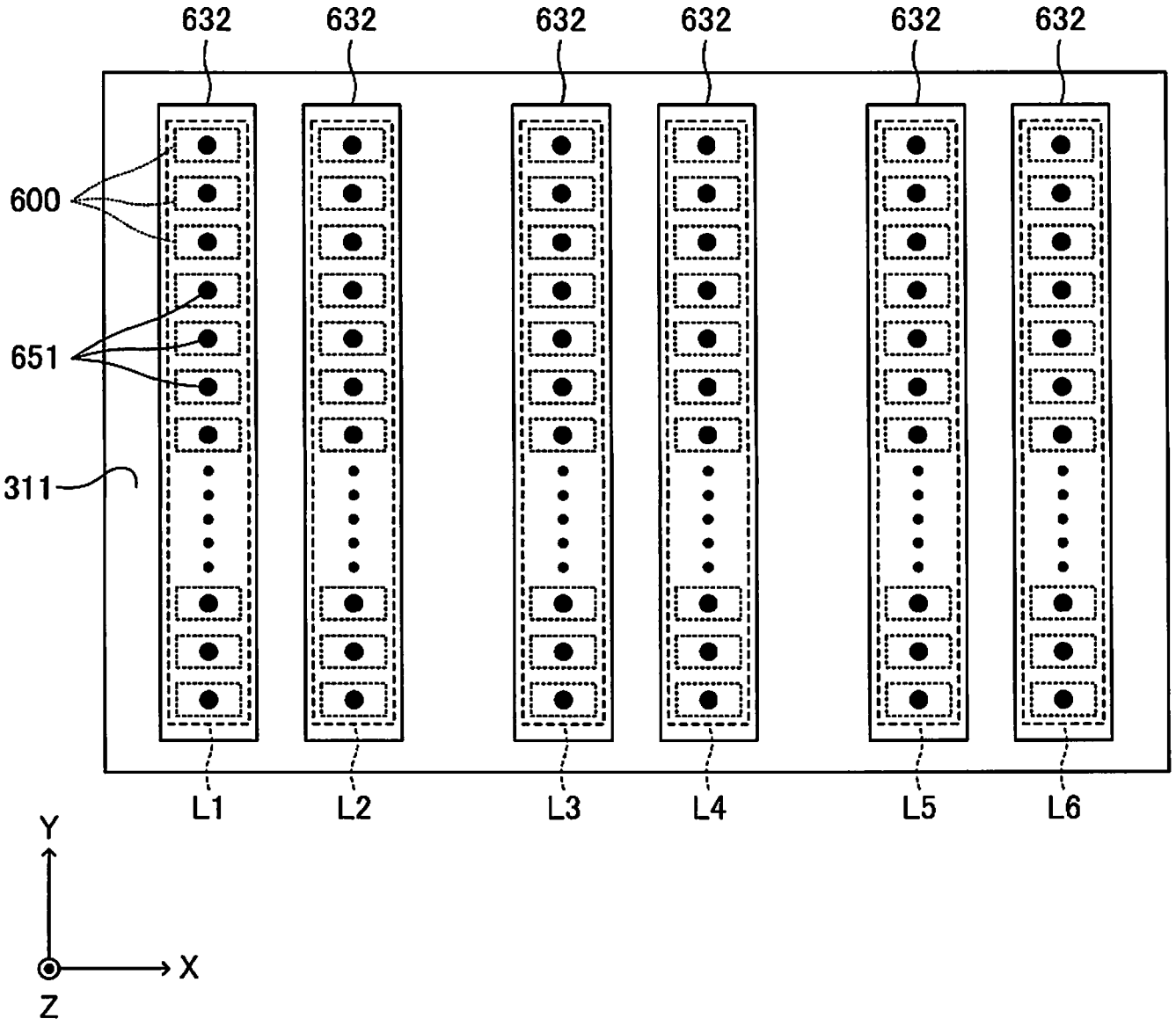
FIG. 12 is a plan diagram illustrating an ink discharge surface.

FIG. 12 is a plan diagram illustrating the ink discharge surface 311. As illustrated in FIG. 12, on the ink discharge surface 311, six number of nozzle plates 632, which each include the plurality of nozzles 651 for discharging the ink, are provided in line along the X direction. In addition, in each of the nozzle plates 632, the nozzles 651 are provided in line along the Y direction. Therefore, nozzle columns L1 to L6 are formed on the ink discharge surface 311. Meanwhile, in FIG. 12, in the nozzle columns L1 to L6 formed on the respective nozzle plates 632, the nozzles 651 are provided in one column along the Y direction. However, the nozzles 651 may be provided in line in two or more columns along the Y direction.

The nozzle columns L1 to L6 are provided to correspond to the respective driving signal selection circuits 200-1 to 200-6. Specifically, the driving signal VOUT1, which is output by the driving signal selection circuit 200-1, is supplied to one ends of the piezoelectric elements 60 included in the plurality of discharge sections 600 provided in the nozzle column L1. In addition, the reference voltage signal CGND1 is supplied to another ends of the piezoelectric elements 60. In the same manner, the driving signal VOUT2, which is output by the driving signal selection circuit 200-2, is supplied to one ends of the piezoelectric elements 60 included in the plurality of discharge sections 600 provided in the nozzle column L2, and the reference voltage signal CGND2 is supplied to another ends of the piezoelectric elements 60. In the same manner, the driving signal VOUT3, which is output by the driving signal selection circuit 200-3, is supplied to one ends of the piezoelectric elements 60 included in the plurality of discharge sections 600 provided in the nozzle column L3, and the reference voltage signal CGND3 is supplied to the another ends of the piezoelectric elements 60. In the same manner, the driving signal VOUT4, which is output by the driving signal selection circuit 200-4, is supplied to one ends of the piezoelectric elements 60 included in the plurality of discharge sections 600 provided in the nozzle column L4, and the reference voltage signal CGND4 is supplied to the another ends of the piezoelectric elements 60. In the same manner, the driving signal VOUT5, which is output by the driving signal selection circuit 200-5, is supplied to one ends of the piezoelectric elements 60 included in the plurality of discharge sections 600 provided in the nozzle columns L5, and the reference voltage signal CGND5 is supplied to the another ends of the piezoelectric elements 60. In the same manner, the driving signal VOUT6, which is output by the driving signal selection circuit 200-6, is supplied to one ends of the piezoelectric elements 60 included in the plurality of discharge sections 600 provided in the nozzle columns L6, and the reference voltage signal CGND6 is supplied to the another ends of the piezoelectric elements 60.

Figure 13:
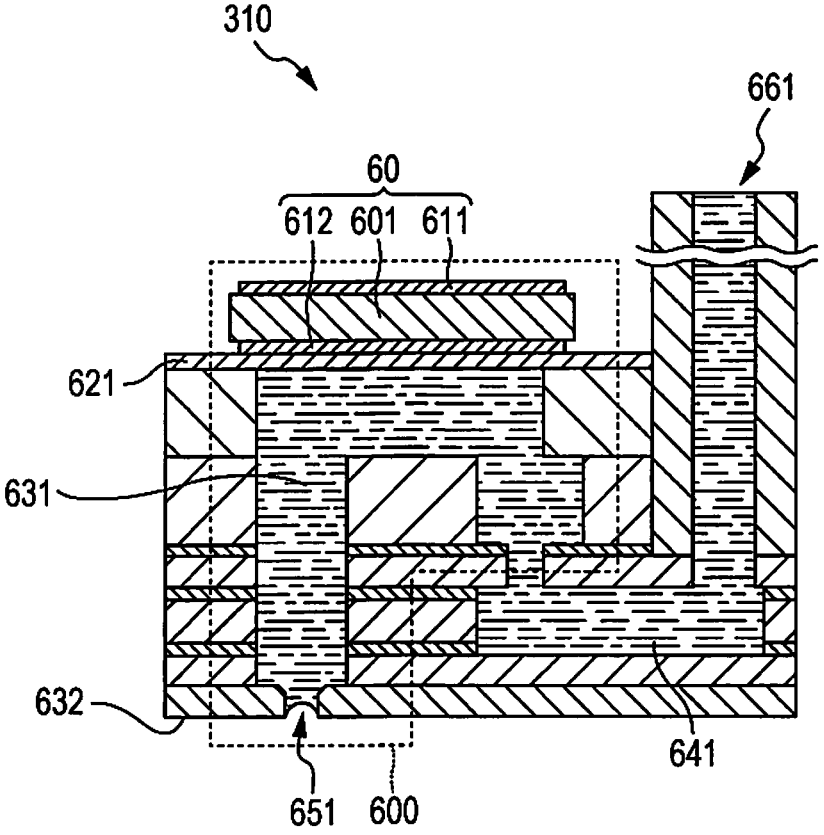
FIG. 13 is a diagram illustrating a schematic configuration of the discharge section.

Subsequently, a configuration of the discharge section 600 included in the head 310 will be described with reference to FIG. 13. FIG. 13 is a diagram illustrating a schematic configuration of one of the plurality of discharge sections 600 included in the head 310. As illustrated in FIG. 13, the head 310 includes the discharge section 600 and a reservoir 641.

The reservoir 641 is provided in each of the nozzle columns L1 to L6. Furthermore, the ink is introduced from an ink supply port 661 to the reservoir 641.

The discharge section 600 includes a piezoelectric element 60, a vibration plate 621, a cavity 631, and a nozzle 651. The vibration plate 621 varies in accordance with displacement of the piezoelectric element 60 provided on an upper surface in FIG. 13. Furthermore, the vibration plate 621 functions as a diaphragm which enlarges/reduces an internal volume of the cavity 631. An inside of the cavity 631 is filled with the ink. Furthermore, the cavity 631 functions as a pressure chamber in which the internal volume changes according to the displacement of the piezoelectric element 60. The nozzle 651 is an opening section which is formed on the nozzle plate 632 and which communicates with the cavity 631. Furthermore, the nozzle 651 communicates with the cavity 631, and discharges the ink on the inside of the cavity 631 according to the change in the internal volume of the cavity 631.

The piezoelectric element 60 has a structure in which a piezoelectric substance 601 is sandwiched between a pair of electrodes 611 and 612. In the piezoelectric substance 601 of the structure, according to a voltage which is supplied to the electrodes 611 and 612, central parts of the electrodes 611 and 612 and the vibration plate 621 are bent in upper and lower directions with respect to both end parts in FIG. 13. Specifically, the driving signal VOUT is supplied to the electrode 611, and the reference voltage signal CGND is supplied to the electrode 612. Furthermore, when the voltage of the driving signal VOUT becomes high, the central part of the piezoelectric element 60 is bent in the upper direction. When the voltage of the driving signal VOUT becomes low, the central part of the piezoelectric element 60 is bent in the lower direction. That is, when the piezoelectric element 60 is bent in the upper direction, the internal volume of the cavity 631 is enlarged. Therefore, the ink is drawn from the reservoir 641. In addition, when the piezoelectric element 60 is bent in the lower direction, the internal volume of the cavity 631 is reduced. Therefore, an amount of ink according to a degree of reduction in the internal volume of the cavity 631 is discharged from the nozzle 651. As above, the nozzle 651 discharges the ink based on the driving signal COM which is the basis of the driving signal VOUT and the driving signal VOUT.

Meanwhile, the piezoelectric element 60 is not limited to the illustrated structure, and may be a type which is capable of discharging the ink in accordance with the displacement of the piezoelectric element 60. In addition, the piezoelectric element 60 is not limited to flexural vibration, and may have a configuration using longitudinal vibration. Here, the head 310, which includes the nozzle plate 632, the ink supply port 661, the reservoir 641, and the cavity 631, is an example of a discharge module.

Returning to FIG. 11, the substrate 320 includes a side 323 and a side 324, which are provided in parallel to each other, a side 325 and a side 326, which are provided in parallel to each other, a surface 321, and a surface 322 which is different from the surface 321. The substrate 320 has a shape in which the side 323 is orthogonal to the side 325 and the side 326, and in which the side 324 is orthogonal to the side 325 and the side 326. Specifically, the substrate 320 includes the surface 321 and the surface 322 which is different from the surface 321, and has a substantially rectangular shape formed with the side 323, the side 324 which faces the side 323 in the X direction, the side 325, and the side 326 which faces the side 325 in the Y direction. In addition, the surface 321 and the surface 322 of the substrate 320 are surfaces which are located to face each other through a base material of the substrate 320, in other words, the surface 321 and the surface 322 are front and back surfaces of the substrate 320. Furthermore, the substrate 320 is provided such that the surface 321 is in the +Z direction and the surface 322 is in the −Z direction in the print head 21 and the head substrate unit 23 included in the print head 21. In other words, the surface 321 faces the vertically lower part and the surface 322 faces the vertically upper part. In this case, it is preferable that the surface 321 of the substrate 320 is orthogonal to the Z direction which is the vertical direction. Here, the surface 321 of the substrate 320 is an example of a first surface, and the surface 322 which is different from the surface 321 is an example of a second surface. In addition, the side 323 is an example of a first side, the side 324 is an example of a second side, the side 325 is an example of a third side, and the side 326 is an example of a fourth side.

In the print head 21 and the head substrate unit 23, the substrate 320 is provided on an opposite side of the ink discharge surface 311, from which the ink is discharged, with respect to the nozzle plate 632, that is, the substrate 320 is provided such that the surface 321 is on the side of the nozzle plate 632. A first connector 350 and a second connector 360 are provided in the substrate 320. The first connector 350 is provided along the side 323 on a side of the surface 321 of the substrate 320. Furthermore, at least any of the print data signals SI1 to SIn, the change signal CH, the latch signal LAT, and the clock signal SCK is input to the first connector 350. In addition, the second connector 360 is provided along the side 323 on a side of the surface 322 of the substrate 320. Furthermore, at least any of the print data signals SI1 to SIn, the change signal CH, the latch signal LAT, and the clock signal SCK is input to the second connector 360. Meanwhile, details of the signals, which are input to the print head 21 and the head substrate unit 23 through the first connector 350 and the second connector 360, will be described later. Here, the first connector 350 is an example of a connector.

Figure 14:
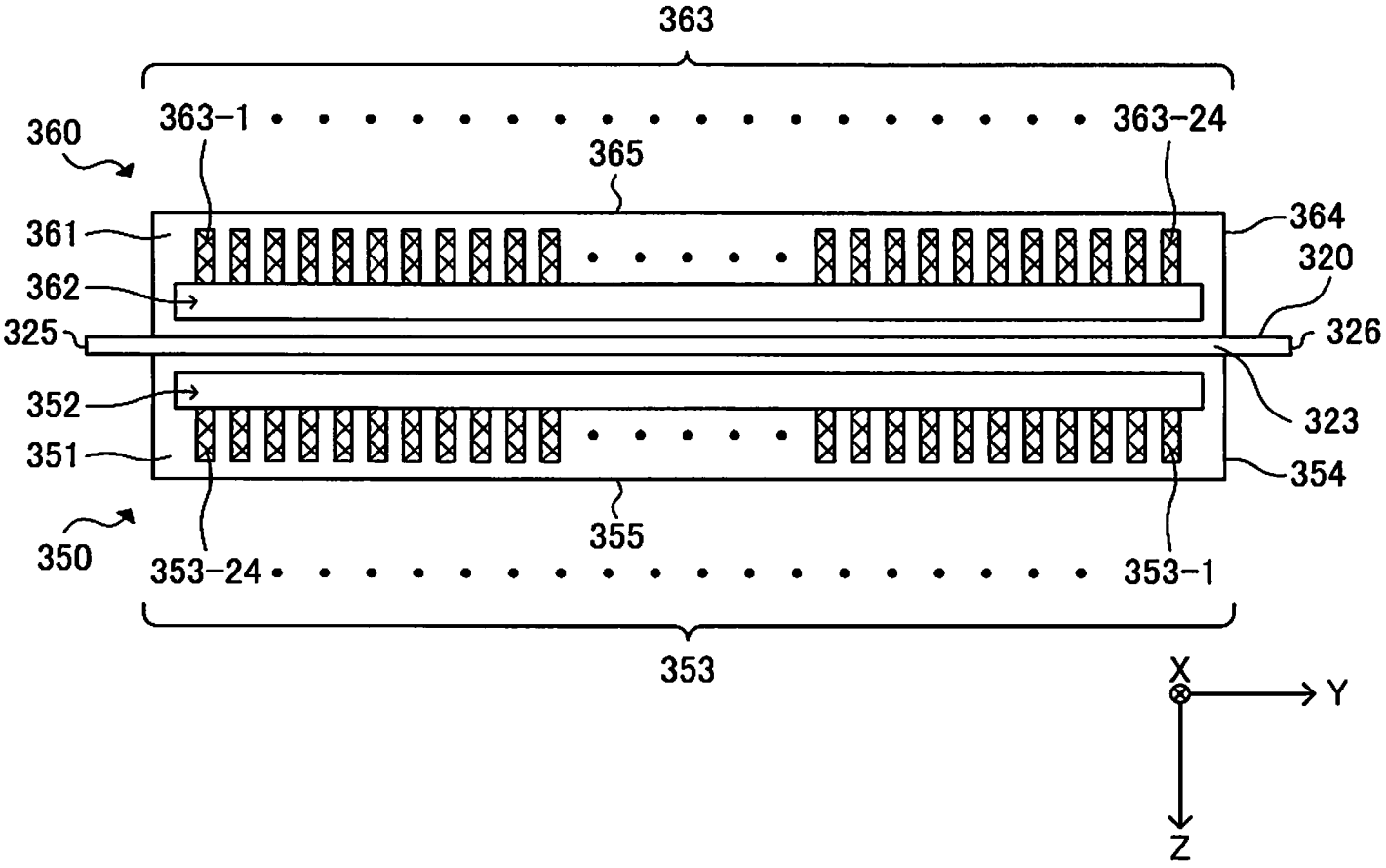
FIG. 14 is a diagram illustrating configurations of a first connector and a second connector.

Subsequently, configurations of the first connector 350 and the second connector 360 will be described with reference to FIG. 14. FIG. 14 is a diagram illustrating the configurations of the first connector 350 and the second connector 360.

The first connector 350 has a substantially rectangular parallelepiped shape including a plurality of sides having a side 354 and a side 355, which is orthogonal to the side 354 and is longer than the side 354, and a plurality of surfaces which are formed by the plurality of sides. Furthermore, the first connector 350 is provided in the substrate 320 such that the side 355 of the first connector 350 is parallel to the side 323 of the substrate 320. The first connector 350 includes a housing 351, a cable attachment section 352, and a plurality of terminals 353. The cable attachment section 352 is a long and narrow opening along the side 355. A not-shown cable, which electrically couples the control mechanism 10 to the print head 21, is attached to the cable attachment section 352. In addition, the plurality of terminals 353 are provided in line in a direction along the side 355. Furthermore, when the cable is attached to the cable attachment section 352, the plurality of respective terminals included in the cable are electrically coupled to the plurality of respective terminals 353 included in the first connector 350. Therefore, various signals, which are output from the control mechanism 10, are input to the print head 21 and the head substrate unit 23. Meanwhile, in the first embodiment, description is performed while it is assumed that 24 number of terminals 353 are provided in parallel along the side 323 in the first connector 350. Here, there is a case where the 24 number of terminals 353, which are provided in parallel, are sequentially referred to as terminals 353-1, 353-2, . . . , 353-24 from a side of the side 326 toward a side of the side 325 in the direction along the side 323. In addition, the side 354 is an example of a fifth side, and the side 355 is an example of a sixth side.

The second connector 360 has a substantially rectangular parallelepiped shape including a plurality of sides having a side 364 and a side 365, which is orthogonal to the side 364 and is longer than the side 364, and a plurality of surfaces which are formed by the plurality of sides. Furthermore, the second connector 360 is provided in the substrate 320 such that the side 365 of the second connector 360 is parallel to the side 323 of the substrate 320. The second connector 360 includes a housing 361, a cable attachment section 362, and a plurality of terminals 363. The cable attachment section 362 is a long and narrow opening along the side 365. A not-shown cable, which electrically couples the control mechanism 10 to the print head 21, is attached to the cable attachment section 362. The plurality of terminals 363 are provided in line in the direction along the side 323. Furthermore, when the cable is attached to the cable attachment section 362, the plurality of respective terminals included in the cable are electrically coupled to the plurality of respective terminals 363 included in the second connector 360. Therefore, various signals, which are output by the control mechanism 10, are input to the print head 21 and the head substrate unit 23. Meanwhile, in the first embodiment, description is performed while it is assumed that 24 number of terminals 363 are provided in parallel along the side 323 in the second connector 360. Here, there is a case where the 24 number of terminals 363, which are provided in parallel, are sequentially referred to as terminals 363-1, 363-2, . . . , 363-24 from the side of the side 325 toward the side of the side 326 in the direction along the side 323.

Subsequently, examples of signals which are input to each of the first connector 350 and the second connector 360 will be described with reference to FIGS. 15 and 16. FIG. 15 is a diagram illustrating examples of signals respectively input to the terminals 353. In addition, FIG. 16 is a diagram illustrating examples of signals respectively input to the terminals 363.

As illustrated in FIG. 15, the print data signal SI1 for controlling discharge of the ink, the change signal CH, the latch signal LAT, the clock signal SCK, the temperature signal TH, the abnormality signal XHOT, and the plurality of ground signals GND are input to terminals 353-1 to 353-12. In addition, the driving signals COM1 to COM6 for driving the piezoelectric elements 60 and the reference voltage signals CGND1 to CGND6 are input to terminals 353-13 to 353-24. That is, a control signal of the low voltage and a signal, which indicates a reference potential of the control signal, are input to the plurality of terminals 353 provided on the side of the side 326 of the first connector 350, and a driving signal of the high voltage and a signal, which indicates a reference potential of the driving signal, are input to the plurality of terminals 353 provided on the side of the side 325 of the first connector 350. As above, when the terminals, to which the signal of the high voltage is input, and the terminals, to which the signal of the low voltage is input, are separately provided in the first connector 350, it is possible to reduce a problem in that the signal of the high voltage interferes in the control signal which is the signal of the low voltage.

Furthermore, the terminals, to which the ground signal GND is input, are located between the terminals 353 to which the print data signal SI1, the change signal CH, the latch signal LAT, the clock signal SCK, the temperature signal TH, and the abnormality signal XHOT are respectively input. Specifically, the terminal 353-3, to which the ground signal GND is input, is located between the terminal 353-2, to which the temperature signal TH is input, and the terminal 353-4 to which the latch signal LAT is input. In addition, the terminal 353-5, to which the ground signal GND is input, is located between the terminal 353-4, to which the latch signal LAT is input, and the terminal 353-6 to which the clock signal SCK is input. In addition, the terminal 353-7, to which the ground signal GND is input, is located between the terminal 353-6, to which the clock signal SCK is input, and the terminal 353-8 to which the change signal CH is input. In addition, the terminal 353-9, to which the ground signal GND is input, is located between the terminal 353-8, to which the change signal CH is input, and the terminal 353-10 to which the print data signal SI1 is input. In addition, the terminal, 353-11 to which the ground signal GND is input, is located between the terminal 353-10, to which the print data signal SI1 is input, and the terminal 353-12 to which the abnormality signal XHOT is input.

As described above, each of the print data signal SI1, the change signal CH, the latch signal LAT, and the clock signal SCK serves both as the signal for performing the self-diagnosis of the print head 21 in the diagnosis circuit 240 and various control signals for controlling the discharge of the ink. When the terminal 353, to which the ground signal GND that is a signal of the reference potential is input, is located between the terminals 353 to which the important signals are input, it is possible to reduce a problem in that the print data signal SI1, the change signal CH, the latch signal LAT, and the clock signal SCK interfere in each other.

As illustrated in FIG. 16, the driving signals COM1 to COM6 for driving the piezoelectric elements 60 and the reference voltage signals CGND1 to CGND6 are input to the terminals 363-1 to 363-12. In addition, the high voltage signal VHV, which is the signal of the high voltage, is input to the terminal 363-14. In addition, the print data signals SI2 to SI6 for controlling the discharge of the ink, the low voltage signal VDD which is the signal of the low voltage, and the plurality of ground signals GND are input to the terminals 363-15 to 363-24. That is, the control signal of the low voltage and a signal, which indicates the reference potential of the control signal, are input to the plurality of terminals 363 provided on the side of the side 326 of the second connector 360, and the driving signal of the high voltage and a signal, which indicates the reference potential of the driving signal, are input to the plurality of terminals 363 provided on the side of the side 325 of the second connector 360. As above, when the terminals, to which the signal of the high voltage is input, and the terminals, to which the signal of the low voltage is input, are separately provided in the second connector 360, it is possible to reduce a problem in that the high voltage signal interferes in the signal of the low voltage.

Figure 17:
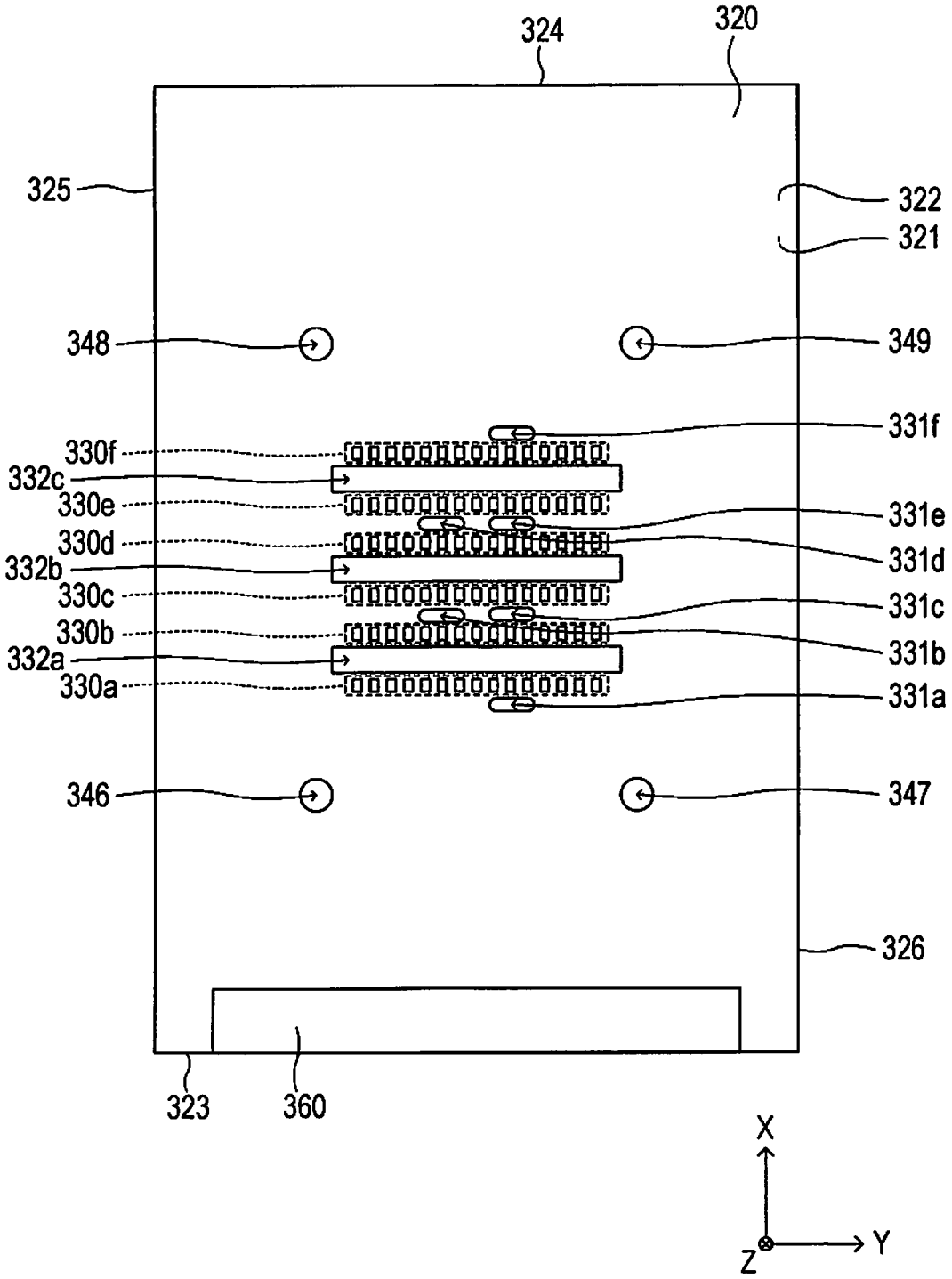
FIG. 17 is a plan diagram illustrating a case where a substrate is viewed from a surface.
Figure 18:
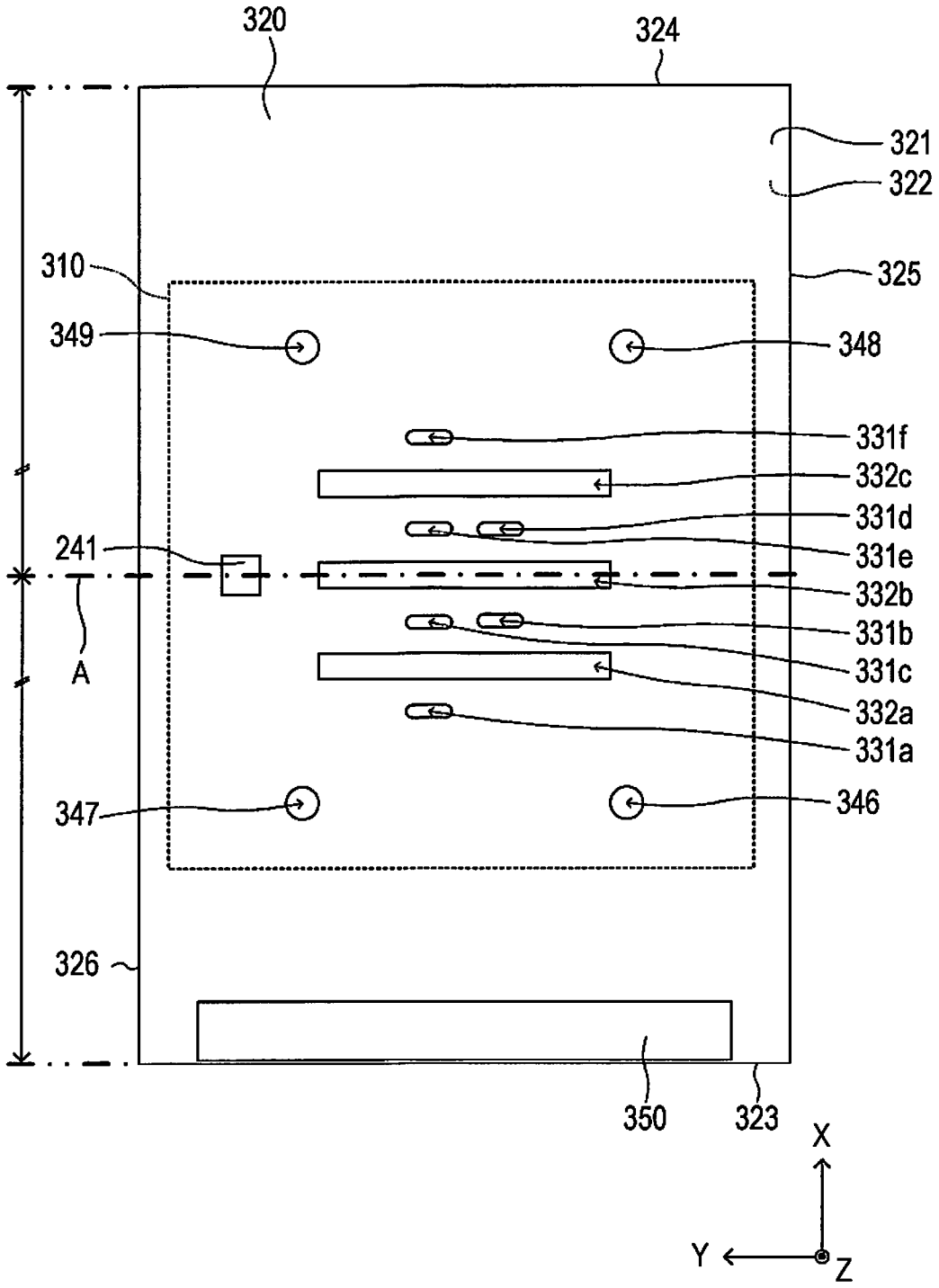
FIG. 18 is a plan diagram illustrating a case where the substrate is viewed from a surface.
Figure 19:
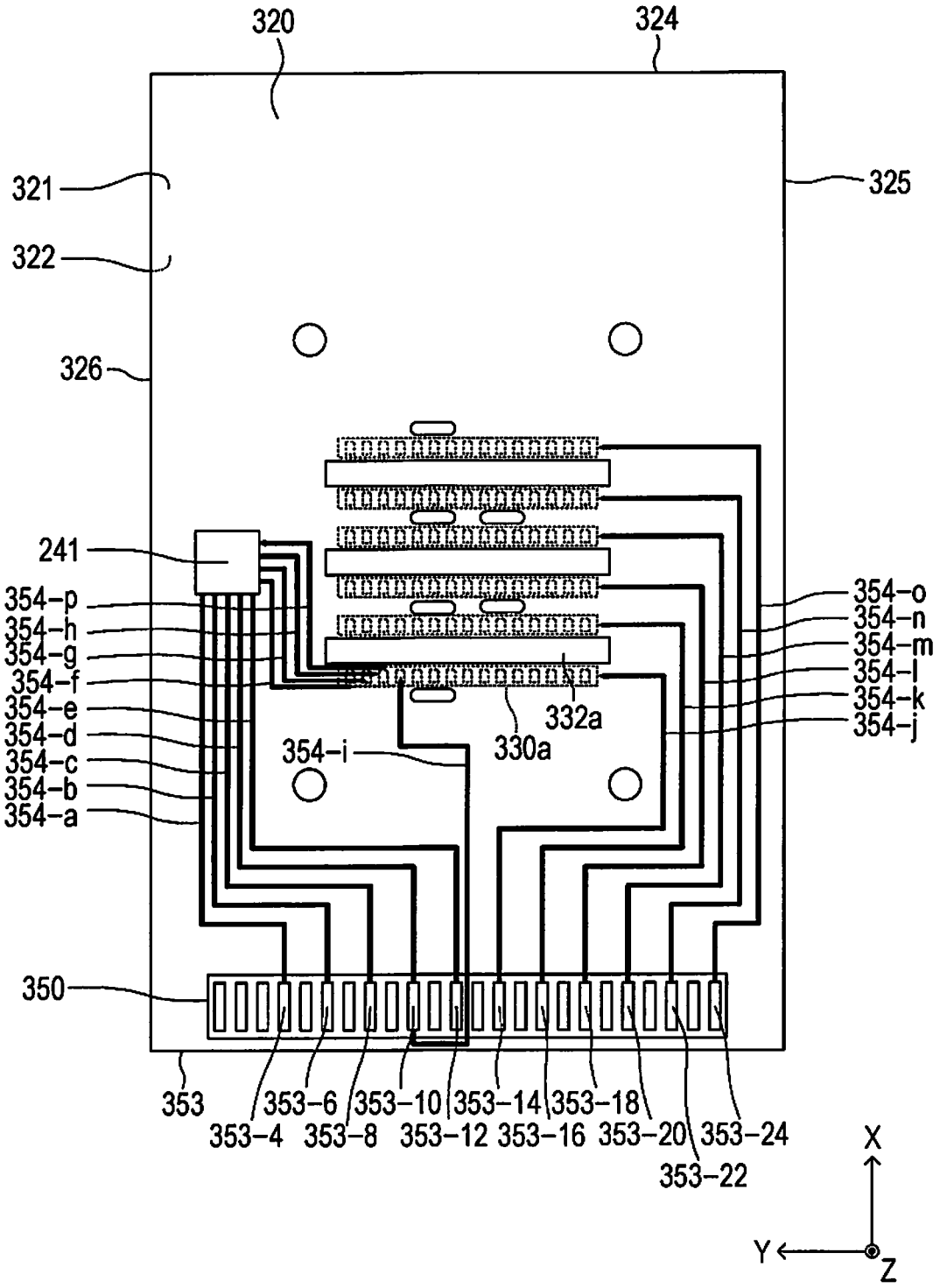
FIG. 19 is a diagram illustrating an example of wiring formed on the surface of the substrate.

Subsequently, a configuration of the substrate 320, on which the first connector 350 and the second connector 360 are mounted, will be described with reference to FIGS. 17 to 19. As illustrated in FIGS. 17 to 19, the substrate 320 is provided in such a way that the side 323 and the side 324 are located along the Y direction, which is orthogonal to the X direction, and the side 325 and the side 326 are located along the X direction. Furthermore, in the substrate 320, a length of the side 323 is shorter than a length of the side 325.

FIG. 17 is a plan diagram illustrating a case where the substrate 320 is viewed from the surface 322. In addition, FIG. 18 is a plan diagram illustrating a case where the substrate 320 is viewed from the surface 321. Meanwhile, in FIG. 18, a location of the head 310 provided on the side of the surface 321 of the substrate 320 is illustrated using broken lines.

As illustrated in FIGS. 17 and 18, the surface 322 of the substrate 320 includes electrode groups 330*a* to 330*f* to which a flexible wiring substrate (Flexible Printed Circuits (FPC)) 335, which will be described later, is electrically coupled, ink supply path insertion holes 331*a* to 331*f* into which ink channels 25 for introducing the ink to the discharge sections 600 corresponding to the respective nozzle columns L1 to L6 from the ink supply ports 661 is inserted, and the FPC insertion holes 332*a* to 332*c* into which the flexible wiring substrates 335 are inserted. Here, the ink supply path insertion holes 331*a* to 331*f* and the FPC insertion holes 332*a* to 332*c* are through holes which pass through the surface 321 the surface 322 of the substrate 320.

Figure 20:
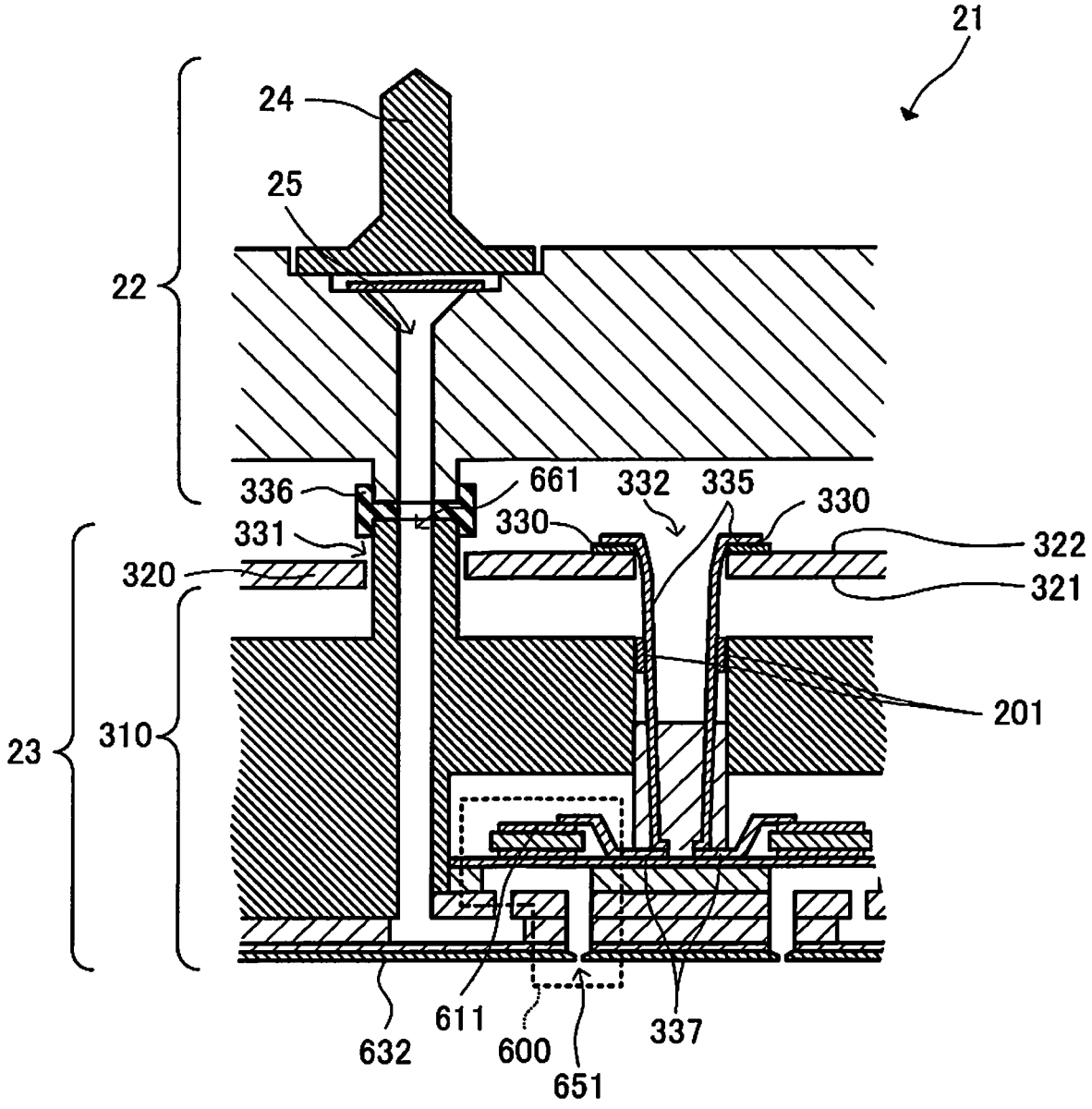
FIG. 20 is a diagram illustrating a cross section of a print head.

Each of the electrode groups 330*a* to 330*f* includes a plurality of electrodes disposed to be parallel to the side 323 which is the Y direction, and is disposed to be parallel to the side 325 which is the X direction. Specifically, the electrode group 330*a* includes a plurality of electrodes provided in parallel along the Y direction. In addition, the electrode group 330*b* is located on a side of the side 324 of the electrode group 330*a*, and includes a plurality of electrodes provided in parallel along the Y direction. In addition, the electrode group 330*c* is located on the side of the side 324 of the electrode group 330*b*, and includes a plurality of electrodes provided in parallel along the Y direction. In addition, the electrode group 330*d* is located on the side of the side 324 of the electrode group 330*c*, and includes a plurality of electrodes provided in parallel along the Y direction. In addition, the electrode group 330*e* is located on the side of the side 324 of the electrode group 330*d*, and includes a plurality of electrodes provided in parallel along the Y direction. In addition, the electrode group 330*f* is located on the side of the side 324 of the electrode group 330*e*, and includes a plurality of electrodes provided in parallel along the Y direction. Furthermore, the flexible wiring substrate 335 illustrated in FIG. 20 is electrically coupled to each of the electrode groups 330*a* to 330*f*. That is, the print head 21 includes the plurality of flexible wiring substrates 335 which are electrically coupled to the substrate 320.

Each of the FPC insertion holes 332*a* to 332*c* is an insertion hole into which the substrate 320 is inserted, and a width of each of the FPC insertion holes 332*a* to 332*c* in a direction parallel to the side 323 which is the Y direction is larger than a width in a direction parallel to the side 325 which is the X direction. Furthermore, the respective FPC insertion holes 332*a* to 332*c* are located in line to be parallel to the side 325 which is the X direction. The flexible wiring substrates 335 are inserted into the respective FPC insertion holes 332*a* to 332*c* which are located as above. Specifically, the FPC insertion hole 332*a* is located between the electrode group 330*a* and the electrode group 330*b* in the X direction. Furthermore, the flexible wiring substrates 335, which are electrically coupled to the respective electrode groups 330*a* and 330*b*, are inserted into the FPC insertion hole 332*a*. In addition, the FPC insertion hole 332*b* is located between the electrode group 330*c* and the electrode group 330*d* in the X direction. Furthermore, the flexible wiring substrate 335, which are electrically coupled to the respective electrode groups 330*c* and 330*d*, are inserted into the FPC insertion hole 332*b*. In addition, the FPC insertion hole 332*c* is located between the electrode group 330*e* and the electrode group 330*f* in the X direction. Furthermore, the flexible wiring substrates 335, which are electrically coupled to the respective electrode groups 330*e* and 330*f*, are inserted into the FPC insertion hole 332*c*.

The ink supply path insertion hole 331*a* is located on a side of the side 323 of the electrode group 330*a* in the X direction. In addition, the ink supply path insertion holes 331*b* and 331*c* are located between the electrode group 330*b* and the electrode group 330*c* in the X direction, and are located in line along the Y direction such that the ink supply path insertion hole 331*b* is on the side of the side 325 and the ink supply path insertion hole 331*c* is on the side of the side 326. The ink supply path insertion holes 331*d* and 331*e* is located between the electrode group 330*d* and the electrode group 330*e* in the X direction, and is located in line along the Y direction such that the ink supply path insertion hole 331*d* is on the side of the side 325 and the ink supply path insertion hole 331*e* is on the side of the side 326. The ink supply path insertion hole 331*f* is located on the side of the side 324 of the electrode group 330*f* in the X direction.

Ink channels 25, which introduce the ink from the ink supply port 661 toward the discharge sections 600 corresponding to the respective nozzle columns L1 to L6, are inserted into the respective ink supply path insertion holes 331*a* to 331*f* which are provided as above.

Here, a relationship between the flexible wiring substrates 335, which are inserted into the FPC insertion holes 332*a* to 332*c*, the ink channels 25, which are inserted into the ink supply path insertion holes 331*a* to 331*f*, and the substrate 320 will be described with reference to FIG. 20. FIG. 20 is a diagram illustrating a cross section of the print head 21 when cutting is performed such that the print head 21 includes at least any of the FPC insertion holes 332*a* to 332*c* or at least any of the ink supply path insertion holes 331*a* to 331*f*. Meanwhile, in description with reference to FIG. 20, the FPC insertion holes 332*a* to 332*c* are simply referred to as the FPC insertion hole 332, the ink supply path insertion holes 331*a* to 331*f* are simply referred to as the ink supply path insertion hole 331, and the electrode groups 330*a* to 330*f* are simply referred to as the electrode group 330.

As illustrated in FIG. 20, the flexible wiring substrate 335 is inserted into the FPC insertion hole 332. The flexible wiring substrate 335 has one end coupled to the electrode group 330 and another end coupled to one end of the electrode wiring 337. Furthermore, another end of the electrode wiring 337 is coupled to the electrode 611 of the piezoelectric element 60. In addition, an integrated circuit apparatus 201 is mounted on the flexible wiring substrate 335 in a Chip On Film (COF) manner. The integrated circuit apparatus 201 includes the driving signal selection circuit 200 and the temperature abnormality detection circuit 250. Furthermore, when the print data signal SI1, the change signal CH, the latch signal LAT, the clock signal SCK, and the driving signal COM are input to the integrated circuit apparatus 201 through the electrode group 330, the driving signal selection circuit 200 included in the integrated circuit apparatus 201 generates the driving signal VOUT. Furthermore, the integrated circuit apparatus 201 supplies the generated driving signal VOUT to the electrode 611 of the piezoelectric element 60 through the electrode wiring 337. Here, although not shown in FIG. 20, the integrated circuit apparatus 201 is provided on the surface 321 of the substrate 320 in a space formed between the substrate 320 and the head 310. Meanwhile, the space may be, for example, a space formed in such a way that the substrate 320 is supported by a fixing member inserted into fixing holes 347 to 349 which will be described later. In addition, the space may be a space formed in such a way that the head 310 includes a recession at a part of a surface for fixing the substrate 320.

In addition, as illustrated in FIG. 20, the print head 21 includes the ink supply unit 22 provided at an upper part of the print head 21 in the Z direction, and a head substrate unit 23 provided at a lower part of the ink supply unit 22 in the Z direction.

The ink supply unit 22 includes an ink introduction section 24 at the upper part in the Z direction. A top end of the ink introduction section 24 may be considered as the ink supply port, similarly to the ink supply port 661. The above-described liquid container 2 is coupled to the ink introduction section 24. Furthermore, when the liquid container 2 is coupled to the ink introduction section 24, the ink stored in the liquid container 2 is supplied to the ink supply unit 22 of the print head 21. That is, the ink introduction section 24, which supplies the ink to the print head 21, is provided at the upper part of the print head 21. Furthermore, the ink, which is supplied to the ink supply unit 22, is supplied to the head substrate unit 23 through the ink channel 25 formed on the inside of the ink supply unit 22, a packing 336, and the ink supply port 661. Here, the ink channel 25 is not limited to a shape illustrated in FIG. 20. The ink channel 25 may supply the ink from the liquid container 2 to the ink supply port 661, and, for example, may be formed obliquely with respect to the vertical direction which is the Z direction. In addition, the packing 336 reduces a problem in that the ink leaks at a coupling section between the ink supply unit 22 and the head substrate unit 23.

The ink supplied from the ink supply unit 22 to the ink channel 25 is supplied to the discharge section 600 through the ink channel formed in the head 310. At this time, the ink supply path insertion hole 331 of the substrate 320 is inserted into the ink channel. In other words, the ink supply port 661 is located on a side of the surface 322 of the substrate 320, and the discharge section 600 is located on a side of the surface 321 of the substrate 320. Furthermore, the ink supplied to the discharge section 600 is discharged from the nozzle 651. That is, the substrate 320 is located between the nozzle plate 632, on which the nozzle 651 is formed, and the ink introduction section 24, and is located between the nozzle plate 632, on which the nozzle 651 is formed, and the ink supply port 661.

As above, in the print head 21, the ink introduction section 24, to which the ink is supplied from the liquid container 2, is located at a vertically upper part of the substrate 320 on the side of the surface 322 of the substrate 320. That is, a shortest distance between the ink introduction section 24 and the surface 321 is longer than a shortest distance between the ink introduction section 24 and the surface 322. Here, the ink introduction section 24 is an example of a supply port to which the ink is supplied from the liquid container 2. In addition, in the broad sense, the ink supply port 661 included in the head substrate unit 23 also supplies the ink to the print head 21, and is located at the vertically upper part of the substrate 320 on the side of the surface 322 of the substrate 320, similarly to the ink introduction section 24. That is, a shortest distance between the ink supply port 661 and the surface 321 is longer than a shortest distance between the ink supply port 661 and the surface 322. Therefore, the ink supply port 661 is also an example of the supply port to which the ink is supplied from the liquid container 2. Furthermore, the ink supply path insertion hole 331 of the substrate 320, to which the ink channel that communicates with the ink introduction section 24 and the ink supply port 661 is inserted, is an examples of a supply port insertion hole.

Returning to FIGS. 17 and 18, the substrate 320 includes fixing holes 346 to 349 for fixing the substrate 320 included in the print head 21 to the head 310 including the nozzle plates 632. The fixing holes 346 to 349 are through holes which pass through the surface 321 and the surface 322 of the substrate 320. Furthermore, not-shown fixing members are inserted into the fixing holes 346 to 349. That is, the print head 21 includes the fixing members for fixing the nozzle plates 632 to the substrate 320, and the substrate 320 includes the fixing holes 346 to 349 into which the fixing members are inserted. Furthermore, the substrate 320 is fixed to the head 310 including the nozzle plates 632 through the fixing members. Meanwhile, it is possible to use, for example, screws as the fixing members which fixe the substrate 320 to the head 310 including the nozzle plates 632. Specifically, when the screws are inserted into the fixing holes 346 to 349 and the screws are tightened, the substrate 320 is fixed to the head 310 including the nozzle plates 632. In addition, the substrate 320 may be fixed to the head 310 including the nozzle plates 632 in such a way that the head 310 includes projection sections as the fixing members, the projection sections are inserted into the fixing holes 346 to 349, and the projection sections are fitted to the fixing holes 346 to 349 of the substrate 320. Furthermore, the substrate 320 may be fixed to the head 310 including the nozzle plates 632 using the above-described screws and the projection sections at the same time.

The fixing holes 346 and 347 are located on the side of the side 323 of the ink supply path insertion hole 331*a* in the X direction, and are provided in line along the Y direction such that the fixing hole 346 is on the side of the side 325 and the fixing hole 347 is on the side of the side 326. In addition, the fixing holes 348 and 349 are located on the side of the side 324 of the ink supply path insertion hole 331*f* in the X direction, and are provided in line along the Y direction such that the fixing hole 348 is on the side of the side 325 and the fixing hole 349 is on the side of the side 326.

As illustrated in FIG. 18, the integrated circuit apparatus 241, the first connector 350, and the head 310 are provided on the surface 321 of the substrate 320. The integrated circuit apparatus 241 includes the diagnosis circuit 240 illustrated in FIG. 2. Furthermore, the integrated circuit apparatus 241 diagnoses whether or not it is possible to normally discharge the ink from the nozzle 651 based on the latch signal LAT, the change signal CH, the print data signal SI1, and the clock signal SCK. In other words, the integrated circuit apparatus 241 determines the existence/non-existence of the operation abnormality of the print head 21 based on the latch signal LAT, the change signal CH, the print data signal SI1, and the clock signal SCK, which are the digital signals input from the first connector 350. In addition, the abnormality signal cXHOT is input to the integrated circuit apparatus 241 from the temperature abnormality detection circuits 250-1 to 250-*n*. Furthermore, the integrated circuit apparatus 241 determines the existence/non-existence of the temperature abnormality of the print head 21 based on the abnormality signal cXHOT. Furthermore, the integrated circuit apparatus 241 outputs the abnormality signal XHOT which indicates whether or not it is possible to normally discharge the ink from the nozzle 651, and, in addition, which indicates the existence/non-existence of the operation abnormality of the print head 21 based on the existence/non-existence of the temperature abnormality of the print head 21.

That is, the integrated circuit apparatus 241 is provided on the surface 321 of the substrate 320, and is electrically coupled to the first connector 350 through the first connector 350. The digital signal including the latch signal LAT, the change signal CH, the print data signal SI1, the clock signal SCK, and the like are input to the integrated circuit apparatus 241, and the integrated circuit apparatus 241 outputs the abnormality signal XHOT which indicates the existence/non-existence of the operation abnormality of the print head 21. The integrated circuit apparatus 241 is an example of an integrated circuit.

In addition, the integrated circuit apparatus 241 is a surface-mount component provided on the surface 321 of the substrate 320. In other words, terminals and electrodes included in the integrated circuit apparatus 241 are not inserted into the surface 322 of the substrate 320. In this case, the integrated circuit apparatus 241 and the substrate 320 may be electrically coupled to each other, for example, through bump electrodes.

As above, in the print head 21, the head 310 and the integrated circuit apparatus 241 including the diagnosis circuit 240 are provided on the surface 321 of the substrate 320. That is, a shortest distance between the surface 321 of the substrate 320, on which the integrated circuit apparatus 241 including the diagnosis circuit 240 is provided, the head 310, and the nozzle plate 632 included in the head 310 is shorter than a shortest distance between the surface 322 of the substrate 320, the head 310, and the nozzle plate 632 included in the head 310. In addition, in other words, the substrate 320 is provided such that the surface 322 becomes upstream an ink discharge direction and the surface 321 becomes downstream the ink discharge direction along the Z direction, which is a discharge direction to which the ink is discharged, in the print head 21, and the integrated circuit apparatus 241 including the diagnosis circuit 240 and the head 310 are provided on the surface 321 which is provided downstream the discharge direction.

Furthermore, the integrated circuit apparatus 241 is provided, on the side of the surface 321 of the substrate 320, at a place, which is not adjacent to the first connector 350, on the side of the side 326 rather than any area of the FPC insertion holes 332*a* to 332*c*. In other words, the integrated circuit apparatus 241 is located other than between the FPC insertion holes 332*a* to 332*c* in the Y direction. In addition, it is preferable that the integrated circuit apparatus 241 is provided in the vicinity of a central part of the substrate 320 in a direction along the X direction in which the carriage 20 reciprocates. Specifically, with regard to the integrated circuit apparatus 241, a shortest distance between a virtual line A, which has an equal distance from the side 323 and the side 324, and the integrated circuit apparatus 241 is shorter than a shortest distance between the side 323 and the integrated circuit apparatus 241, and a shortest distance between the virtual line A and the integrated circuit apparatus 241 is shorter than a shortest distance between the side 324 and the integrated circuit apparatus 241.

In addition, as illustrated in FIG. 18, the integrated circuit apparatus 241 is provided between the substrate 320 and the head 310. Specifically, as illustrated in FIG. 18, when the print head 21 is viewed from the Z direction, the integrated circuit apparatus 241 is provided in a space formed by the substrate 320 and the head 310 in a location which overlaps the head 310. Meanwhile, the space formed by the he substrate 320 and the head 310 is not limited to the space formed by only the substrate 320 and the head 310, and may be, for example, a space formed to include the substrate 320, the head 310, and an adhesive for fixing the head 310 to the substrate 320. In other words, the integrated circuit apparatus 241 is located between the substrate 320 and the head 310, and the substrate 320 and the head 310 a fixed by the adhesive.

Here, an example of a wiring pattern, which is provided on the surface 321 of the substrate 320 and which propagates the latch signal LAT, the change signal CH, the print data signal SI1, the clock signal SCK, and the abnormality signal XHOT, will be described with reference to FIG. 19. FIG. 19 is a diagram illustrating an example of wiring formed on the surface 321 of the substrate 320. Meanwhile, in FIG. 19, a part of the wiring pattern formed on the substrate 320 is omitted. In addition, in FIG. 19, the electrode groups 330*a* to 330*f* formed on the surface 322 of the substrate 320 are illustrated using broken lines.

As illustrated in FIG. 19, wirings 354-*a* to 354-*p* are provided on the surface 321 of the substrate 320.

The terminal 353-4 is electrically coupled to the wiring 354-*a*. After the latch signal LAT, which is input from the terminal 353-4, is propagated through the wiring 354-*a*, the latch signal LAT is input to the integrated circuit apparatus 241. That is, the wiring 354-*a* couples the terminal 353-4 to the integrated circuit apparatus 241, and the latch signal LAT is propagated therethrough.

The terminal 353-6 is electrically coupled to the wiring 354-*b*. After the clock signal SCK, which is input from the terminal 353-6, is propagated through the wiring 354-*b*, the clock signal SCK is input to the integrated circuit apparatus 241. That is, the wiring 354-*b* couples the terminal 353-6 to the integrated circuit apparatus 241, and the clock signal SCK is propagated therethrough.

The terminal 353-8 is electrically coupled to the wiring 354-*c*. After the change signal CH, which is input from the terminal 353-8, is propagated through the wiring 354-*c*, the change signal CH is input to the integrated circuit apparatus 241. That is, the wiring 354-*c* couples the terminal 353-8 to the integrated circuit apparatus 241, and the change signal CH is propagated therethrough.

The terminal 353-10 is electrically coupled to the wiring 354-*d*. After the print data signal SI1, which is input from the terminal 353-10, is propagated through the wiring 354-*d*, the print data signal SI1 is input to the integrated circuit apparatus 241. That is, the wiring 354-*d* couples the terminal 353-10 to the integrated circuit apparatus 241, and the print data signal SI1 is propagated therethrough.

The integrated circuit apparatus 241 diagnoses whether or not it is possible to normally discharge the ink in the print head 21 based on the latch signal LAT, the change signal CH, the print data signal SI1, and the clock signal SCK which are input. In other words, the integrated circuit apparatus 241 determines the existence/non-existence of the operation abnormality of the print head 21. Furthermore, when the integrated circuit apparatus 241 diagnoses that it is possible to normally discharge the ink in the print head 21, the integrated circuit apparatus 241 outputs the latch signal LAT, the clock signal SCK, and the change signal CH, which are input, as the latch signal cLAT, the clock signal cSCK, and the change signal cCH, to the electrode groups 330*a* to 330*f*, respectively. Specifically, not-shown terminals of the integrated circuit apparatus 241 are electrically coupled to the respective wirings 354-*f* to 354-*h*. After the latch signal cLAT, the clock signal cSCK, and the change signal cCH, which are output from the integrated circuit apparatus 241, are respectively propagated through the respective wirings 354-*f* to 354-*h*, the latch signal cLAT, the clock signal cSCK, and the change signal cCH are input to any of the electrodes included in the electrode group 330*a* through not-shown via or the like. Meanwhile, FIG. 19 illustrates only the wirings 354-*f* to 354-*h*, through which the latch signal cLAT, the clock signal cSCK, and the change signal cCH that are input to the electrode group 330*a* are propagated, and does not illustrate a wiring pattern through which the latch signal cLAT, the clock signal cSCK, and the change signal cCH that are output from the integrated circuit apparatus 241 and are input to the respective electrode groups 330*b* to 330*f* are propagated.

In addition, any of the electrodes included in the electrode group 330*a* is electrically coupled to the not-shown terminal of the integrated circuit apparatus 241 through the wiring 354-*p*. The abnormality signal cXHOT, which is output from the temperature abnormality detection circuit 250, is propagated through the wiring 354-*p*. Furthermore, the abnormality signal cXHOT is input to the integrated circuit apparatus 241.

The integrated circuit apparatus 241 generates the abnormality signal XHOT according to the existence/non-existence of the temperature abnormality of the print head 21 based on the abnormality signal cXHOT and the existence/non-existence of the operation abnormality of the print head 21 based on the latch signal LAT, the change signal CH, the print data signal SI1, and the clock signal SCK. The abnormality signal XHOT, which is output from the integrated circuit apparatus 241, is propagated through the wiring 354-*e* which is electrically coupled to the terminal 353-12. Furthermore, after the abnormality signal XHOT is propagated through the wiring 354-*d*, abnormality signal XHOT is input to the terminal 353-12. That is, the wiring 354-*e* couples the terminal 353-12 to the integrated circuit apparatus 241, and the abnormality signal XHOT is propagated therethrough.

Furthermore, as illustrated in FIG. 19, the terminal 353-10 is also electrically coupled to the wiring 354-*i*. After the print data signal SI1, which is input from the terminal 353-10, is propagated through the wiring 354-*i*, the print data signal SI1 is input to any of the electrodes included in the electrode group 330*a* through the not-shown via or the like.

The terminal 353-14, to which the driving signal COM1 is input, is electrically coupled to the wiring 354-*j*. After the driving signal COM1, which is input from the terminal 353-14, is propagated through the wiring 354-*j*, the driving signal COM1 is input to any one of the electrodes included in the electrode group 330*a* through the not-shown via or the like. In the same manner, the respective terminals 353-16, 353-18, 353-20, 353-22, and 353-24, to which the driving signals COM2 to COM6 are input, are electrically coupled to the respective wirings 354-*k* to 354-*o*. Furthermore, after the respective driving signals COM2 to COM6 are propagated through the wirings 354-*k* to 354-*o*, the respective driving signals COM2 to COM6 are input to any of the electrodes included in each of the electrode groups 330*b* to 330*f* through not-shown via or the like.

In the print head 21 formed as above, a plurality of signals including the driving signals COM1 to COM6, the reference voltage signals CGND1 to CGND6, the print data signals SI1 to SI6, the latch signal LAT, the change signal CH, and the clock signal SCK, which are output from the control mechanism 10, are input to the print head 21 through the first connector 350. Furthermore, the driving signals COM1 to COM6 and the reference voltage signals CGND1 to CGND6, which are input to the first connector 350, are input to the respective electrode groups 330*a* to 330*f* through the wirings 354-*j* to 354-*o*.

In addition, the latch signal LAT, the change signal CH, and the clock signal SCK, which are input to the first connector 350, are input to the integrated circuit apparatus. 241 through the wirings 354-*a* to 354-*c*. In this case, the wirings 354-*a* to 354-*c*, through which the latch signal LAT, the change signal CH, and the clock signal SCK are respectively propagated, are formed only on the surface 321 which is a surface on a side of the ink discharge surface 311 of the substrate 320. In other words, a via wiring, which electrically couples the surface 321 to the surface 322, is not formed in the wiring pattern through which the latch signal LAT, the change signal CH, and the clock signal SCK are respectively propagated.

In addition, the print data signal SI1, which is input to the first connector 350, braches off on the surface 321 of the substrate 320. Furthermore, one signal of the branching print data signal SI1 is input to the integrated circuit apparatus 241 through the wiring 354-*d* formed on the surface 321, and another signal of the branching print data signal SI1 is input to the electrode group 330*a* through the wiring 354-*i* which is formed on the surface 321 and the surface 322 of the substrate 320.

The integrated circuit apparatus 241 performs the self-diagnosis of the print head 21 based on the latch signal LAT, the change signal CH, the clock signal SCK, and the print data signal SI1 which are input. Furthermore, the integrated circuit apparatus 241 detects voltages, timings, and the like of the print data signal SI1, the change signal CH, the latch signal LAT, and the clock signal SCK. When it is diagnosed that a result of the detection is in a normal range, the integrated circuit apparatus 241 outputs the change signal cCH, the latch signal cLAT, and the clock signal cSCK. The change signal cCH, the latch signal cLAT, and the clock signal cSCK, which are output from the integrated circuit apparatus 241, are respectively input to the electrode groups 330*a* to 330*f* through the wirings 354-*f* to 354-*h* formed on the surface 321 and the surface 322 of the substrate 320.

In addition, the temperature signal TH is input to the first connector 350 from the temperature detection circuit 210 illustrated in FIG. 2 through a not-shown wiring pattern formed on the surface 321 and the surface 322 of the substrate 320. Meanwhile, the temperature detection circuit 210 which outputs the temperature signal TH may be provided on any of the surface 321 and the surface 322 of the substrate 320, and may be provided on the inside of the head 310.

The driving signals COM1 to COM6, the reference voltage signals CGND1 to CGND6, the high voltage signal VHV, and the low voltage signal VDD, which are input to the second connector 360, are input to the respective electrode groups 330*a* to 330*f* through the not-shown wiring pattern formed on the surface 321 and the surface 322 of the substrate 320.

In addition, the respective print data signals SI2 to SI6 which are input to the second connector 360 are input to the respective electrode groups 330*b* to 330*f* through the not-shown wiring pattern formed on the surface 321 and the surface 322 of the substrate 320.

The various signals which are input to the respective electrode groups 330*a* to 330*f* are input to the driving signal selection circuits 200-1 to 200-6 corresponding to the respective nozzle columns L1 to L6 through the flexible wiring substrate 335 electrically coupled to each of the electrode groups 330*a* to 330*f*. Furthermore, the driving signal selection circuits 200-1 to 200-6 generate the driving signals VOUT1 to VOUT6 based on the input signals, and supply the driving signals VOUT1 to VOUT6 to the piezoelectric elements 60 included in the respective nozzle columns L1 to L6. Therefore, the driving signals VOUT are supplied to the piezoelectric elements 60 included in the plurality of discharge sections 600 based on the various signals which are input to the first connector 350 and the second connector 360.

1.7 Effects

In the liquid discharge apparatus 1, the liquid discharge system, and the print head 21 according to the first embodiment, the substrate 320 includes the side 323 and the side 324 located to be parallel to the Y direction orthogonal to the X direction in which the carriage 20 reciprocates. Furthermore, the first connector 350 is provided along the side 323. Therefore, it is possible to reduce a dimension of a depth direction of the carriage 20. In the case, even when ink mist permeates to the inside of the print head 21 from a vicinity of the first connector 350, a problem in that the ink mist adheres to the integrated circuit apparatus 241 is reduced by providing the integrated circuit apparatus 241 in a location separated from the first connector 350. Furthermore, when the integrated circuit apparatus 241 is provided in the location separated from the first connector 350, a problem in that the ink stored in the vicinity of the first connector 350 adheres to the integrated circuit apparatus 241 is reduced due to capillary phenomenon which occurs in the plurality of terminals 353 included in the first connector 350.

In addition, in the liquid discharge apparatus 1, the liquid discharge system, and the print head 21 according to the first embodiment, a shortest distance between the ink introduction section 24, through which the ink is supplied from the liquid container 2 to the print head 21, the ink supply port 661, and the surface 321 of the substrate 320 is longer than a shortest distance between the ink introduction section 24, the ink supply port 661, and the surface 322 of the substrate 320. That is, the ink introduction section 24 and the ink supply port 661 are located on the side of the surface 322 of the substrate 320 in the print head 21. In contrast, the integrated circuit apparatus 241 and the first connector 350, which inputs the print data signal SI1, the change signal CH, the latch signal LAT, and the clock signal SCK that are the digital signals to the integrated circuit apparatus 241, are located on the side of the surface 321 of the substrate 320. Therefore, even when, in the ink introduction section 24 and the ink supply port 661, the ink leaks to the print head 21 from the liquid container 2, a problem in that the leaked ink adheres to the integrated circuit apparatus 241 is reduced.

As above, in the liquid discharge apparatus 1, the liquid discharge system, and the print head 21 according to the first embodiment, it is possible to reduce a problem in that a false operation of the integrated circuit apparatus 241 occurs because the ink adheres to the integrated circuit apparatus 241 in a problem in that the ink permeates to the inside of the print head 21.

Furthermore, in the liquid discharge apparatus 1, the liquid discharge system, and the print head 21 according to the first embodiment, the ink introduction section 24 and the ink supply port 661 are located on the upper part of the print head 21 in the vertical direction, the surface 321 of the substrate 320 faces the vertically lower part, and the surface 322 faces the vertically upper part. When the ink leaks from the liquid container 2 into the print head 21 in the ink introduction section 24 and the ink supply port 661, the ink permeates to the vertically lower part by gravity. Even in the case, the permeation of the ink is disturbed by the substrate 320, and thus a problem in that the ink adheres to the integrated circuit apparatus 241 is reduced. Therefore, it is possible to reduce generation of the false operation of the integrated circuit apparatus 241 because the ink adheres to the integrated circuit apparatus 241. In this case, when the surface 321 of the substrate 320 is orthogonal to the vertical direction, the problem in that the ink permeates to the side of the surface 321 is further reduced. Therefore, the problem in that the ink adheres to the integrated circuit apparatus 241 is further reduced. Accordingly, it is possible to further reduce a problem in that the false operation occurs in the integrated circuit apparatus 241 because the ink adheres to the integrated circuit apparatus 241.

In addition, in the liquid discharge apparatus 1, the liquid discharge system, and the print head 21 according to the first embodiment, the length of the side 323 is shorter than the length of the side 325. That is, the first connector 350 is provided along the side 323 which is a short side of the substrate 320. Therefore, it is possible to further separate a distance between the integrated circuit apparatus 241 and the first connector 350. Therefore, even when the ink mist permeates to the inside of the print head 21 from the vicinity of the first connector 350 and even when the ink leaks, the integrated circuit apparatus 241 and the first connector 350 are separated at a distance, and thus a problem in that the ink mist or the leaked ink adhere to the integrated circuit apparatus 241 is reduced. Accordingly, it is possible to reduce the problem in that the false operation occurs in the integrated circuit apparatus 241 because the ink mist or the leaked ink adheres to the integrated circuit apparatus 241.

In addition, in the liquid discharge apparatus 1, the liquid discharge system, and the print head 21 according to the first embodiment, the shortest distance between the virtual line A, which has an equal distance from the side 323 and the side 324, and the integrated circuit apparatus 241 is shorter than the shortest distance between the side 323 and the integrated circuit apparatus 241, and the shortest distance between the virtual line A and the integrated circuit apparatus 241 is shorter than the shortest distance between the side 324 and the integrated circuit apparatus 241. That is, the integrated circuit apparatus 241 is provided in a vicinity of a central part between the side 323 and the side 324 on the substrate 320. Therefore, even when the ink mist permeates to the inside of the print head 21 from the vicinity of the first connector 350 or even when the ink is leaks, the integrated circuit apparatus 241 and the first connector 350 are separated at a distance, and thus the problem in that the ink mist or the leaked ink adheres to the integrated circuit apparatus 241 is further reduced. Accordingly, it is possible to reduce the problem in that the false operation occurs in the integrated circuit apparatus 241 because the ink mist or the leaked ink adheres to the integrated circuit apparatus 241.

In addition, in the liquid discharge apparatus 1, the liquid discharge system, and the print head 21 according to the first embodiment, the integrated circuit apparatus 241 is located between the substrate 320 and the head 310, and the substrate 320 and the head 310 are fixed through the adhesive. That is, the integrated circuit apparatus 241 is provided at a space closed by the adhesive between the substrate 320 and the head 310. Therefore, even when the ink mist permeates to the inside of the print head 21 from the vicinity of the first connector 350 or even when the ink is leaks, the problem in that the ink mist or the leaked ink adhere to the integrated circuit apparatus 241 is further reduced. Accordingly, it is possible to further reduce the problem in that the false operation occurs in the integrated circuit apparatus 241 because the ink mist or the leaked ink adheres to the integrated circuit apparatus 241.

In addition, in the liquid discharge apparatus 1, the liquid discharge system, and the print head 21 according to the first embodiment, the integrated circuit apparatus 241 is the surface-mount component. Therefore, the terminal for inputting the various signals to the integrated circuit apparatus 241, and the electrode are not located on the side of the surface 322 of the substrate 320. Therefore, even when the ink leaks from the liquid container 2 to the print head 21 in the ink introduction section 24 and the ink supply port 661, the problem in that the leaked ink adheres to the integrated circuit apparatus 241 is reduced. Accordingly, it is possible to further reduce the problem in that the false operation occurs in the integrated circuit apparatus 241 because the ink mist or the leaked ink adheres to the integrated circuit apparatus 241. In this case, when the integrated circuit apparatus 241 is electrically coupled to the substrate 320 through the bump electrode, a problem in that the ink mist and the leaked ink permeate between the integrated circuit apparatus 241 and the substrate 320 is reduced. Accordingly, it is possible to further reduce the problem in that the false operation occurs in the integrated circuit apparatus 241 because the ink mist or the leaked ink adheres to the integrated circuit apparatus 241.

In addition, in the liquid discharge apparatus 1, the liquid discharge system, and the print head 21 according to the first embodiment, the problem in that the leaked ink and the ink mist adhere to the integrated circuit apparatus 241 for detecting the abnormality of the print head 21 is reduced, and thus it is possible to further reduce the problem in that the false operation occurs in the integrated circuit apparatus 241. Therefore, even in a circuit configuration in which the integrated circuit apparatus 241 determines the existence/non-existence of the abnormality of the print head 21, it is possible to reduce a problem in that a fetal fault occurs in the print head 21 because it is not possible to detect the abnormality when the abnormality occurs in the print head 21 because the integrated circuit apparatus 241 does not normally operate, and it is possible to reduce a problem in that the abnormality is falsely detected even when the abnormality does not occur in the print head 21.

2 Second Embodiment

Subsequently, a liquid discharge apparatus 1, a liquid discharge system, and a print head 21 of a second embodiment will be described. Meanwhile, when the liquid discharge apparatus 1, the liquid discharge system, and the print head 21 of the second embodiment are described, the same reference symbols are attached to the components which are the same as in the first embodiment, and description thereof will not be repeated or simplified. Meanwhile, in the liquid discharge apparatus 1, the liquid discharge system, and the print head 21 of the second embodiment, a disposition of the integrated circuit apparatus 241 provided in the substrate 320 of the print head 21 is different from the first embodiment.

Figure 21:
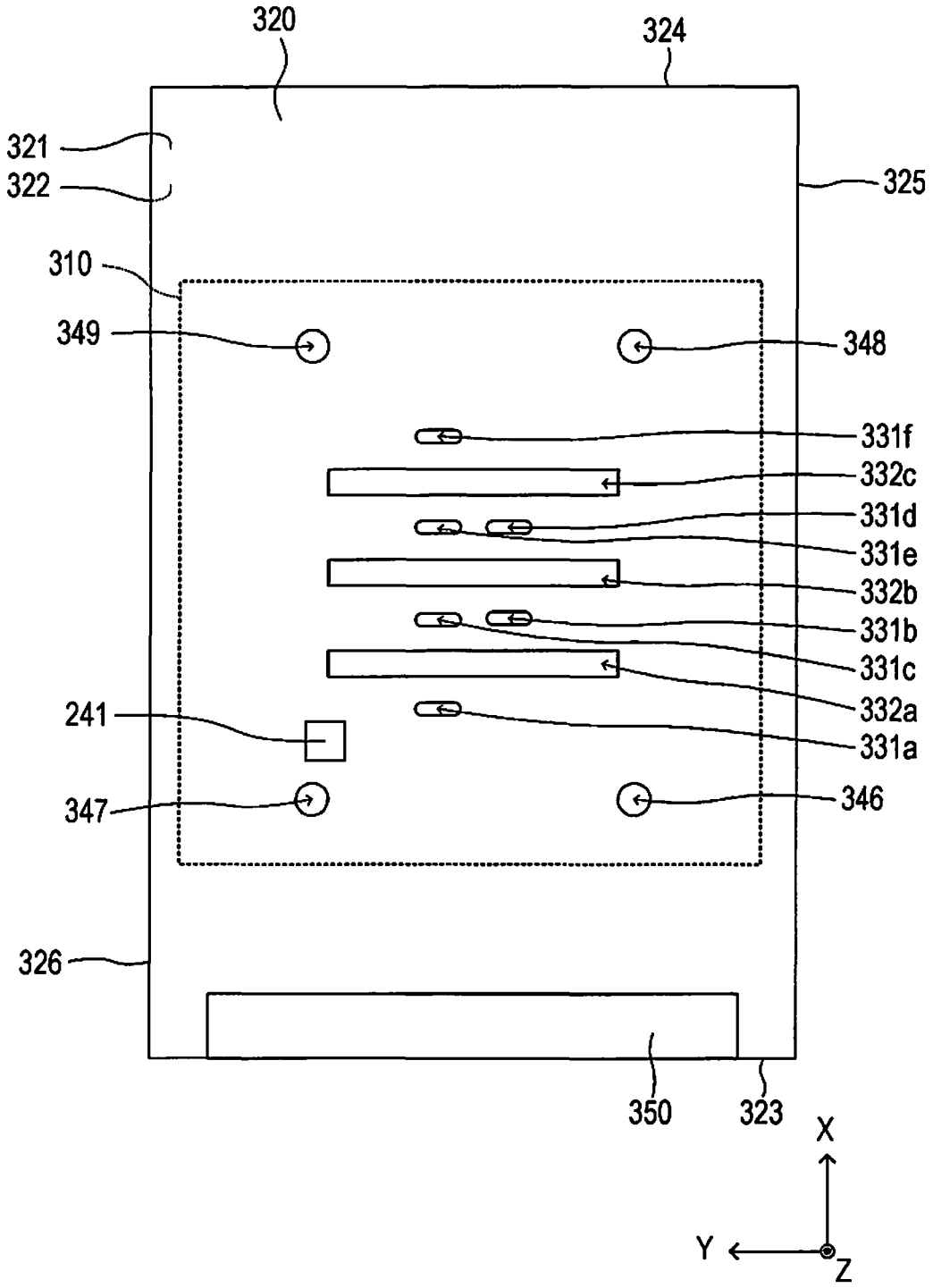
FIG. 21 is a plan diagram illustrating a case where a substrate is viewed from a surface of a second embodiment.

FIG. 21 is a plan diagram illustrating a case where the substrate 320 included in the head substrate unit 23 included in the print head 21 is viewed from the surface 321 in a second embodiment. As illustrated in FIG. 21, in the print head 21 of the second embodiment, at least a part of the integrated circuit apparatus 241 is provided in a location overlapping the fixing hole 347, to which the fixing member is inserted, in the X direction along the side 325 or the side 326. That is, in the print head 21 of the second embodiment, at least a part of the integrated circuit apparatus 241 overlaps the fixing member in the X direction.

More specifically, on the substrate 320, the first connector 350, the fixing hole 347, and the integrated circuit apparatus 241 are located in order of the first connector 350, the fixing hole 347, and the integrated circuit apparatus 241 in the X direction along the side 325 or the side 326, and at least a part of the integrated circuit apparatus 241 overlaps the fixing member which is inserted into the fixing hole 347. In other words, the fixing hole 347 is located between the first connector 350 and at least a part of the integrated circuit apparatus 241. That is, the location of the integrated circuit apparatus 241 is a location which is not adjacent to the first connector 350.

Therefore, it is possible to reduce the problem in that the ink mist, which permeates from the vicinity of the first connector 350, adheres to the integrated circuit apparatus 241 due to the fixing member located between the first connector 350 and the integrated circuit apparatus 241. In addition, it is possible to reduce the problem in that the ink stored in the vicinity of the first connector 350 is transmitted to the integrated circuit apparatus 241 by inertia associated with acceleration of the carriage due to capillary phenomenon which occurs in the plurality of terminals 353 included in the first connector 350.

Meanwhile, in FIG. 21, the integrated circuit apparatus 241 is located in the vicinity of the fixing hole 347. However, at least a part of the integrated circuit apparatus 241 may be provided in the location overlapping the fixing member which is inserted into the fixing hole 347 in the direction along the side 325 or the side 326 and, for example, may be provided at a central part of the substrate 320.

3 Third Embodiment

Subsequently, a liquid discharge apparatus 1, a liquid discharge system, and a print head 21 of a third embodiment will be described. Meanwhile, when the liquid discharge apparatus 1, the liquid discharge system, and the print head 21 of the third embodiment are described, the same reference symbols are attached to the components which are the same as in the first embodiment and the second embodiment, and description thereof will not be repeated or simplified. Meanwhile, the liquid discharge apparatus 1, the liquid discharge system, and the print head 21 of the third embodiment are different from those of the first embodiment and the second embodiment in a fact that the print head 21 includes four connectors electrically coupled to the control mechanism 10.

Figure 22:
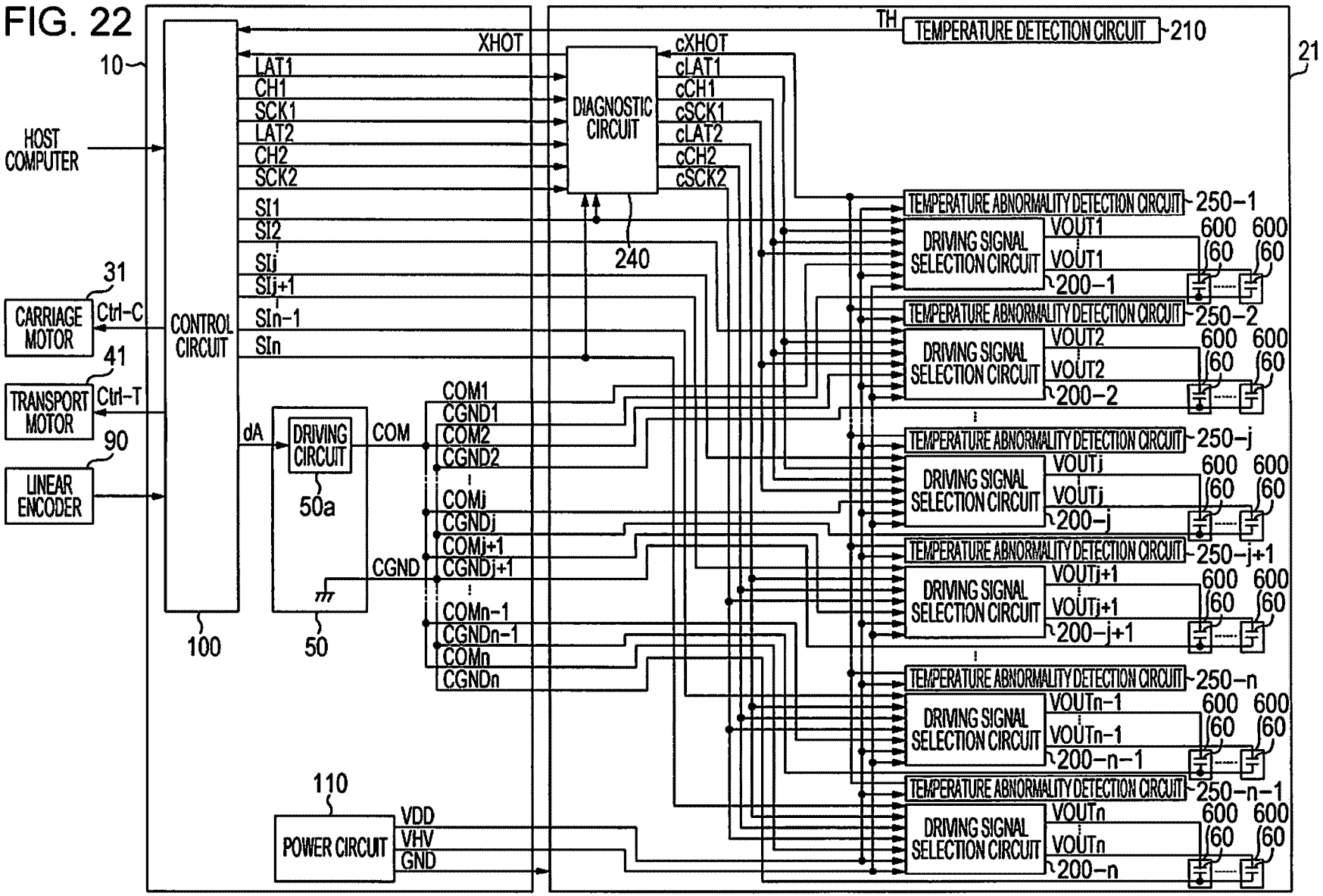
FIG. 22 is a block diagram illustrating an electrical configuration of a liquid discharge apparatus of a third embodiment.

FIG. 22 is a block diagram illustrating an electrical configuration of a liquid discharge apparatus 1 of the third embodiment. As illustrated in FIG. 22, a control circuit 100 of the third embodiment generates two latch signals LATa and LATb for prescribing ink discharge timing, two change signals CHa and CHb for prescribing timing at which a waveform of a driving signal COM is switched, two clock signals SCKa and SCKb for inputting a print data signal SI, and outputs the generated signals to the print head 21. Here, each of the two latch signals LATa and LATb, the two change signals CHa and CHb, and the two clock signals SCKa and SCKb functions as a signal for performing self-diagnosis of the print head 21.

The latch signals LATa and LATb, the change signals CHa and CHb, the clock signals SCKa and SCKb, and print data signals SI1 and Sin are input to a diagnosis circuit 240 included in the print head 21. Furthermore, the diagnosis circuit 240 diagnoses whether or not it is possible for the print head 21 to normally discharge ink based on the latch signals LATa and LATb, the change signals CHa and CHb, the clock signals SCKa and SCKb, and the print data signals SI1 and Sin.

Specifically, the diagnosis circuit 240 performs the diagnosis of whether or not it is possible for the print head 21 to normally discharge ink based on the print data signal SI1, the change signal CHa, the latch signal LATa, and the clock signal SCKa. Furthermore, when it is determined that it is possible for the print head 21 to normally discharge the ink, the diagnosis circuit 240 outputs a change signal cCHa, a latch signal cLATa, and a clock signal cSCKa. In addition, the diagnosis circuit 240 performs the diagnosis of whether or not it is possible for the print head 21 to normally discharge ink based on the print data signal SIn, the change signal CHb, the latch signal LATb, and the clock signal SCKb. Furthermore, when it is determined that it is possible for the print head 21 to normally discharge the ink, the diagnosis circuit 240 outputs a change signal cCHb, a latch signal cLATb, and a clock signal cSCKb. The change signal cCHa, the latch signal cLATa, and the clock signal cSCKa, which are output from the diagnosis circuit 240, are input to any of n number of driving signal selection circuits 200, and the change signal cCHb, the latch signal cLATb, and the clock signal cSCKb are input to any of another n number of driving signal selection circuits 200.

In addition, the diagnosis circuit 240 generates an abnormality signal XHOT based on a result of the diagnosis of whether or not it is possible for the print head 21 to normally discharge the ink, and outputs the abnormality signal XHOT to the control circuit 100.

The driving signal selection circuit 200 generates driving signals VOUT1 to VOUTn based on any of the print data signals SI1 to SIn, which are output from the diagnosis circuit 240, one of the change signals cCHa and cCHb, one of the latch signals cLATa and cLATb, and one of the clock signals cSCKa and cSCKb.

Subsequently, a configuration of the print head 21 of the third embodiment will be described. Meanwhile, description will be performed while it is assumed that the print head 21 of the third embodiment includes ten number of driving signal selection circuits 200-1 to 200-10. Therefore, ten number of print data signals SI1 to SI10, ten number of driving signals COM1 to COM10, and ten number of reference voltage signals CGND1 to CGND10, which correspond to the respective ten number of driving signal selection circuits 200-1 to 200-10, are input to the print head 21 of the third embodiment.

Figure 23:
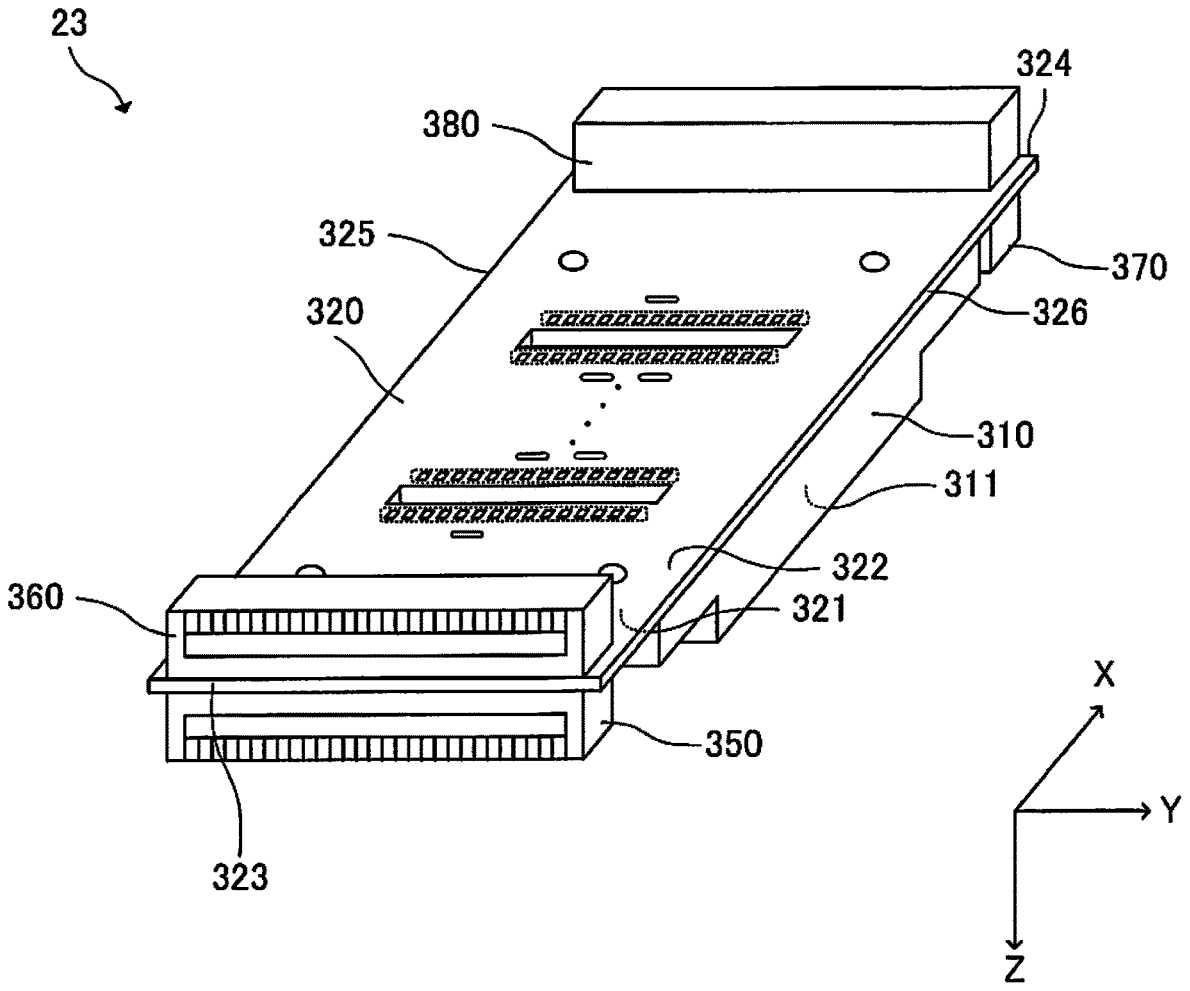
FIG. 23 is a perspective diagram illustrating a configuration of a print head of the third embodiment.
Figure 24:
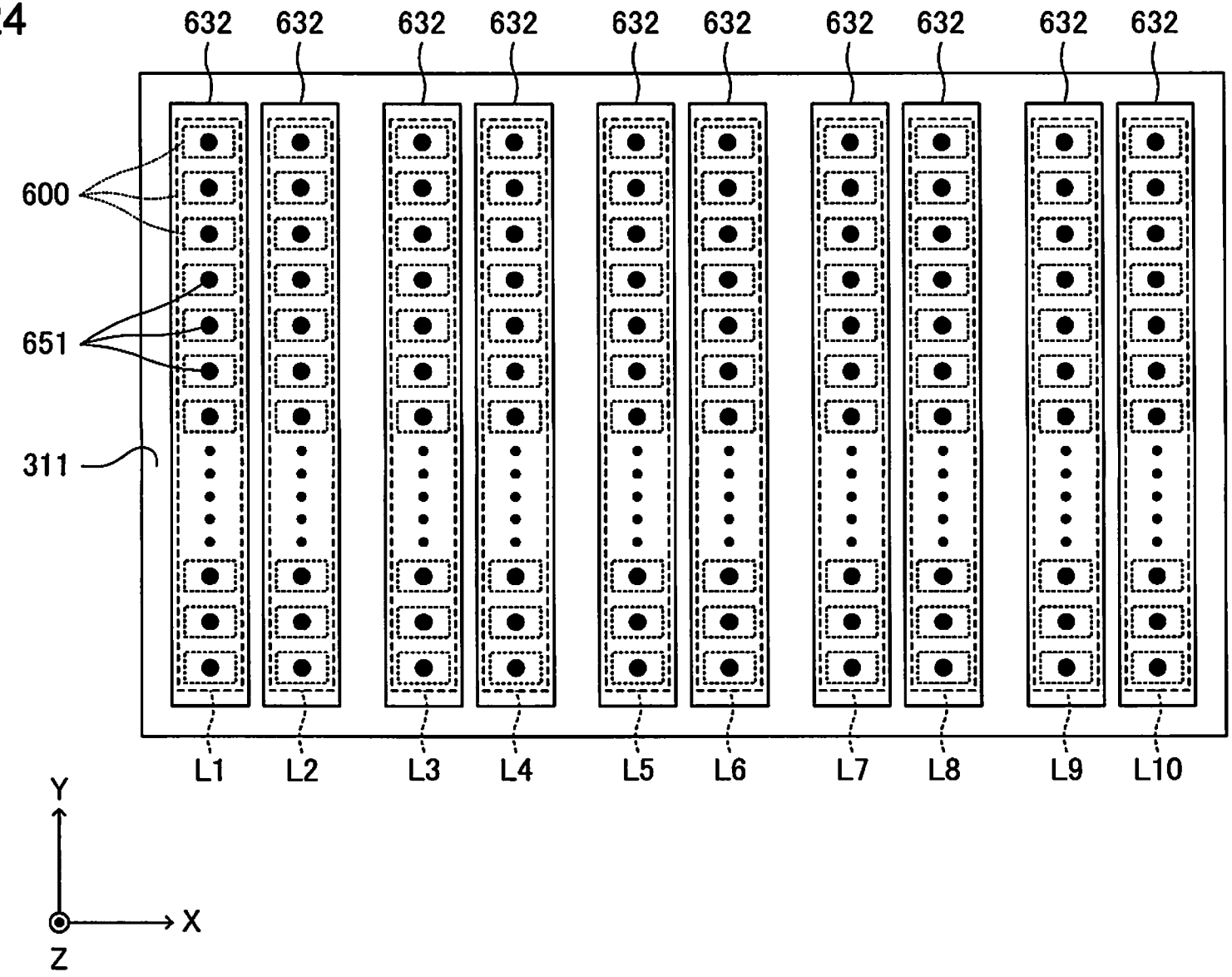
FIG. 24 is a plan diagram illustrating an ink discharge surface of the third embodiment.

FIG. 23 is a perspective diagram illustrating a configuration of a head substrate unit 23 of the third embodiment. As illustrated in FIG. 23, the head substrate unit 23 includes a head 310 and a substrate 320. In addition, FIG. 24 is a plan diagram illustrating an ink discharge surface 311 of the head 310 of the third embodiment. As illustrated in FIG. 24, on the ink discharge surface 311 of the third embodiment, ten number of nozzle plates 632, which each are formed with a plurality of nozzles 651 along the X direction, are provided in line. In addition, nozzle columns L1 to L10, which are provided in line along the X direction, are formed in the respective nozzle plates 632. The respective nozzle columns L1 to L10 are provided to correspond to the respective driving signal selection circuits 200-1 to 200-10.

Returning to FIG. 23, the substrate 320 has a substantially rectangular shape formed with a surface 321 and a surface 322 which faces the surface 321, a side 323, a side 324 which faces the side 323 in the X direction, a side 325, and a side 326 which faces the side 325 in the Y direction. In other words, the substrate 320 includes the side 323, the side 324 which is different from the side 323, the side 325 which is orthogonal to the side 323 and the side 324, and the side 326 which is different from the side 325 that is orthogonal to the side 323 and the side 324.

A first connector 350, a second connector 360, a third connector 370, and a fourth connector 380 are provided in the substrate 320. The first connector 350 is provided on a side of the surface 321 of the substrate 320 along the side 323. In addition, the second connector 360 is provided on a side of the surface 322 of the substrate 320 along the side 323. Meanwhile, the first connector 350 and the second connector 360 of the third embodiment are different from those of the first embodiment only in a fact that the number of a plurality of terminals included in each of the first connector 350 and the second connector 360 is 20, and the other configurations are the same as in the first embodiment. Therefore, detailed description of the first connector 350 and the second connector 360 of the third embodiment will not be repeated. Meanwhile, there is a case where the 20 number of terminals 353, which are provided in parallel in the first connector 350 of the third embodiment, are sequentially referred to as terminals 353-1, 353-2, . . . , 353-20 toward the side 325 from the side 326 in the direction along the side 323. In the same manner, there is a case where the 20 number of terminals 363, which are provided in parallel in the second connector 360 of the third embodiment, are sequentially referred to as terminals 363-1, 363-2, . . . , 363-20 toward the side 326 from the side 325 in the direction along the side 323.

The third connector 370 is provided on the side of the surface 321 of the substrate 320 along the side 324. In addition, the fourth connector 380 is provided on the side of the surface 322 of the substrate 320 along the side 324.

Figure 25:
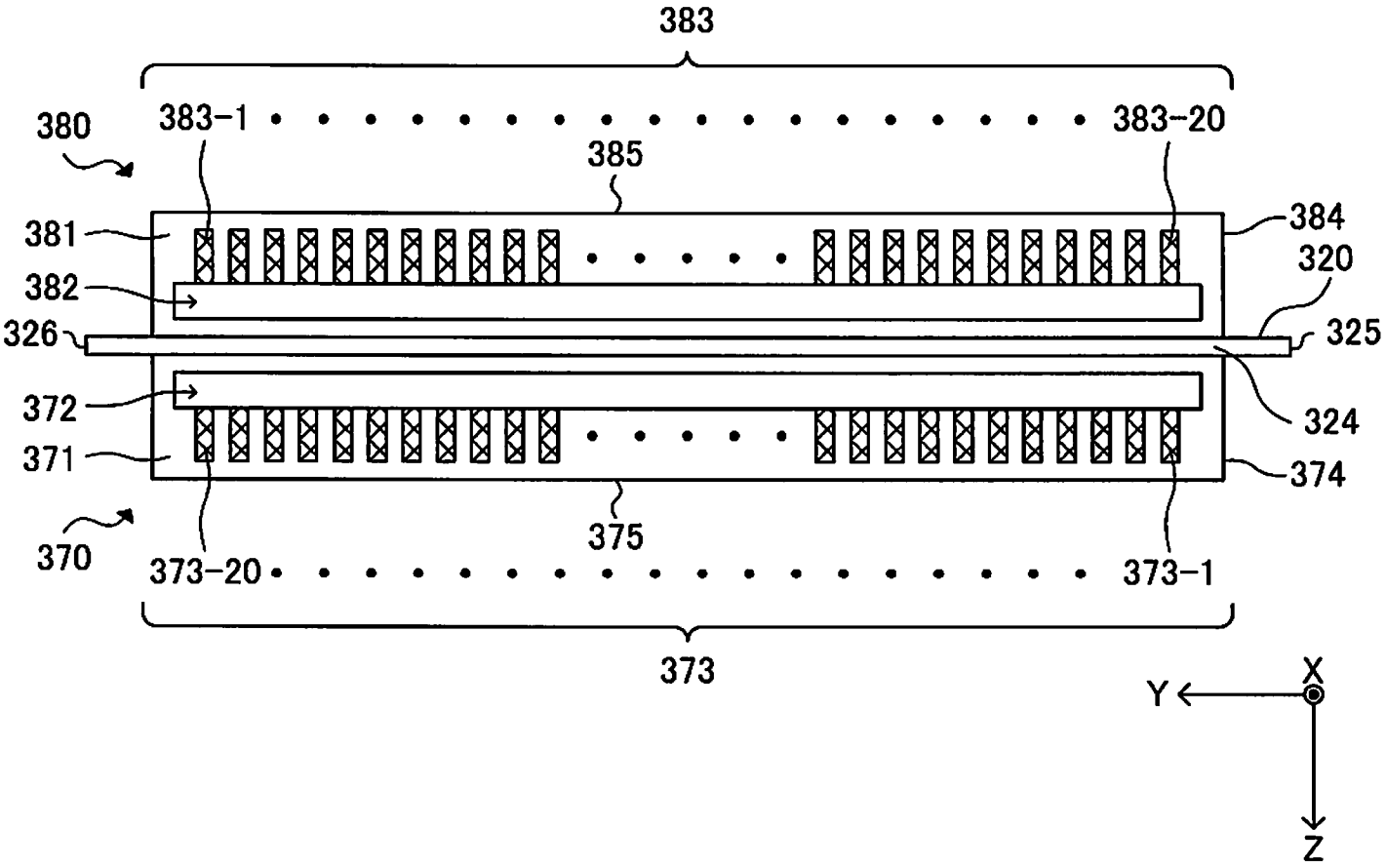
FIG. 25 is a diagram illustrating configurations of a third connector and a fourth connector.

Configurations of the third connector 370 and the fourth connector 380 will be described with reference to FIG. 25. FIG. 25 is a diagram illustrating the configurations of the third connector 370 and the fourth connector 380. The third connector 370 has a substantially rectangular parallelepiped shape which includes a plurality of sides including a side 374 and a side 375 that is orthogonal to the side 374 and is longer than the side 374, and which includes a plurality of surfaces formed by the plurality of sides. Furthermore, the third connector 370 is provided in the substrate 320 such that the side 375 of the third connector 370 is parallel to the side 324 of the substrate 320. The third connector 370 includes a housing 371, a cable attachment section 372, and a plurality of terminals 373. A not-shown cable, which electrically couples the control mechanism 10 to the print head 21, is attached to the cable attachment section 372. In addition, the plurality of terminals 373 are provided in parallel along the side 324. Furthermore, when the cable is attached to the cable attachment section 372, the plurality of respective terminals included in the cable are electrically coupled to the plurality of respective terminals 373 included in the third connector 370. Therefore, the various signals output from the control mechanism 10 are input to the print head 21. Meanwhile, in the embodiment, description is performed while it is assumed that the 20 number of terminals 373 are provided in parallel along the side 324 in the third connector 370. In addition, there is a case where the 20 number of terminals 373 provided in parallel are sequentially referred to as terminals 373-1, 373-2, . . . , 373-20 toward as side of the side 326 from a side of the side 325 in a direction along the side 324.

The fourth connector 380 has a substantially rectangular parallelepiped shape which includes a plurality of sides including a side 384 and a side 385 that is orthogonal to the side 384 and is longer than the side 384, and which includes a plurality of surfaces formed by the plurality of sides. Furthermore, the fourth connector 380 is provided in the substrate 320 such that the side 385 of the fourth connector 380 is parallel to the side 324 of the substrate 320. The fourth connector 380 includes a housing 381, a cable attachment section 382, and a plurality of terminals 383. A not-shown cable, which electrically couples the control mechanism 10 to the print head 21, is attached to the cable attachment section 382. In addition, the plurality of terminals 383 are provided in parallel along the side 324. Furthermore, when the cable is attached to the cable attachment section 382, the plurality of respective terminals included in the cable are electrically coupled to the plurality of respective terminals 383 included in the fourth connector 380. Therefore, the various signals output by the control mechanism 10 are input to the print head 21. Meanwhile, in the embodiment, description is performed while it is assumed that the 20 number of terminals 383 are provided in parallel along the side 324 in the fourth connector 380. In addition, there is a case where the 20 number of terminals 383 provided in parallel are sequentially referred to as terminals 383-1, 383-2, . . . , 383-20 toward the side of the side 326 from the side of the side 325 in the direction along the side 324.

Subsequently, examples of the signals respectively input to the first connector 350, the second connector 360, the third connector 370, and the fourth connector 380 will be described with reference to FIGS. 26 to 29. FIG. 26 is a diagram illustrating examples of signals respectively input to the terminals 353 of the third embodiment. In addition, FIG. 27 is a diagram illustrating examples of signals respectively input to the terminals 363 of the third embodiment. In addition, FIG. 28 is a diagram illustrating examples of signals respectively input to the terminals 373 of the third embodiment. In addition, FIG. 29 is a diagram illustrating examples of signals respectively input to the terminals 383 of the third embodiment.

As illustrated in FIG. 26, the print data signal SI1 for controlling discharge of the ink, the change signal CHa, the latch signal LATa, the clock signal SCKa, the temperature signal TH, and a plurality of ground signals GND are input to the terminals 353-1 to 353-10. In addition, the driving signals COM1 to COM5 for driving piezoelectric elements 60 and the reference voltage signals CGND1 to CGND5 are input to the terminals 353-11 to 353-20. That is, a control signal of a low voltage and a signal, which indicates a reference potential of the control signal, are input to the plurality of terminals 353 provided on the side of the side 326 of the first connector 350, and a driving signal of a high voltage and a signal, which indicates a reference potential of the driving signal, are input to the plurality of terminals 353 provided on the side of the side 325 of the first connector 350.

Furthermore, the terminals, to which the ground signal GND is input, are located between the terminals 353 to which the print data signal SI1 for controlling the discharge of the ink, the change signal CHa, the latch signal LATa, the clock signal SCKa, and the temperature signal TH are respectively input. Specifically, the terminal 353-3, to which the ground signal GND is input, is located between the terminal 353-2, to which the temperature signal TH is input, and the terminal 353-4 to which the latch signal LATa is input. In addition, the terminal 353-5, to which the ground signal GND is input, is located between the terminal 353-4, to which the latch signal LATa is input, and the terminal 353-6 to which the clock signal SCKa is input. In addition, the terminal 353-7, to which the ground signal GND is input, is located between the terminal 353-6, to which the clock signal SCKa is input, and the terminal 353-8 to which the change signal CHa is input. In addition, the terminal 353-9, to which the ground signal GND is input, is located between the terminal 353-8, to which the change signal CHa is input, and the terminal 353-10 to which the print data signal SI1 is input.

As illustrated in FIG. 27, the driving signals COM1 to COM5 for driving the piezoelectric elements 60 and the reference voltage signals CGND1 to CGND5 are input to the terminal 363-1 to 363-10. In addition, the print data signals SI2 to SI5 for controlling the discharge of the ink, a low voltage signal VDD which is a signal of the low voltage, and the plurality of ground signals GND are input to the terminals 363-11 to 363-20 of the second connector 360. That is, the control signal of the low voltage and the signal, which indicates the reference potential of the control signal, are input to the plurality of terminals 363 provided on the side of the side 326 of the second connector 360, and the driving signal of the high voltage and the signal, which indicates the reference potential of the driving signal, are input to the plurality of terminals 363 provided on the side of the side 325 of the second connector 360.

As illustrated in FIG. 28, the driving signals COM6 to COM10 for driving the piezoelectric elements 60 and the reference voltage signals CGND6 to CGND10 are input to the terminals 373-1 to 373-10. In addition, the print data signal SI10 for controlling the discharge of the ink, the change signal CHb, the latch signal LATb, the clock signal SCKb, the abnormality signal XHOT, and the plurality of ground signals GND are input to the terminals 353-11 to 353-20. That is, the control signal of the low voltage and the signal, which indicates the reference potential of the control signal, are input to the plurality of terminals 373 provided on the side of the side 326 of the third connector 370, and the driving signal of the high voltage and the signal, which indicates the reference potential of the driving signal, are input to the plurality of terminals 373 provided on the side of the side 325 of the third connector 370.

Furthermore, the terminals, to which the ground signal GND is input, are provided between terminals 373 to which the print data signal SI10 for controlling the discharge of the ink, the change signal CHb, the latch signal LATb, the clock signal SCKb, and the abnormality signal XHOT are respectively input. Specifically, the terminal 373-13, to which the ground signal GND is input, is located between the terminal 373-12, to which the abnormality signal XHOT is input, and the terminal 373-14 to which the latch signal LATb is input. In addition, the terminal 373-15, to which the ground signal GND is input, is provided between the terminal 373-14, to which the latch signal LATb is input, and the terminal 373-16 to which the clock signal SCKb is input. In addition, the terminal 373-17, to which the ground signal GND is input, is provided between the terminal 373-16, to which the clock signal SCKb is input, and the terminal 373-18 to which the change signal CHb is input. In addition, the terminal 373-19, to which the ground signal GND is input, is provided between the terminal 373-18, to which the change signal CHb is input, and the terminal 373-20 to which the print data signal SI10 is input.

As illustrated in FIG. 29, the print data signals SI6 to SI9 for controlling the discharge of the ink and the plurality of ground signals GND are input to the terminals 383-1 to 383-9. In addition, a high voltage signal VHV, which is the signal of the high voltage, is input to the terminal 383-10. In addition, the driving signals COM6 to COM10 for driving the piezoelectric elements 60 and the reference voltage signals CGND6 to CGND10 are input to the terminals 383-11 to 383-20. That is, the control signal of the low voltage and the signal, which indicates the reference potential of the control signal, are input to the plurality of terminals 383 provided on the side of the side 326 of the fourth connector 380, and the driving signal of the high voltage and the signal, which indicates the reference potential of the driving signal, are input to the plurality of terminals 383 provided on the side of the side 325 of the fourth connector 380.

Figure 30:
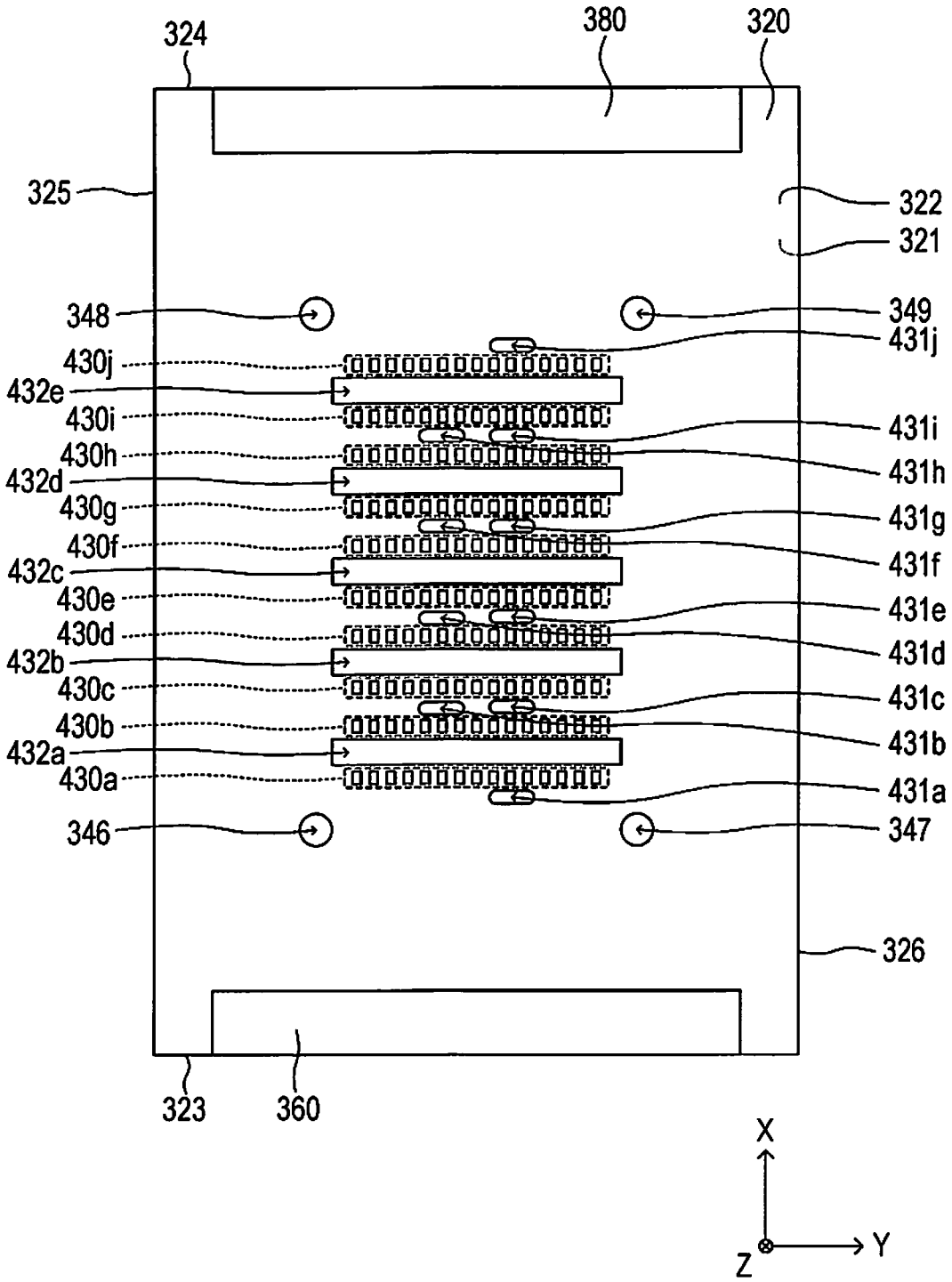
FIG. 30 is a plan diagram illustrating a case where a substrate is viewed from a surface of the third embodiment.
Figure 31:
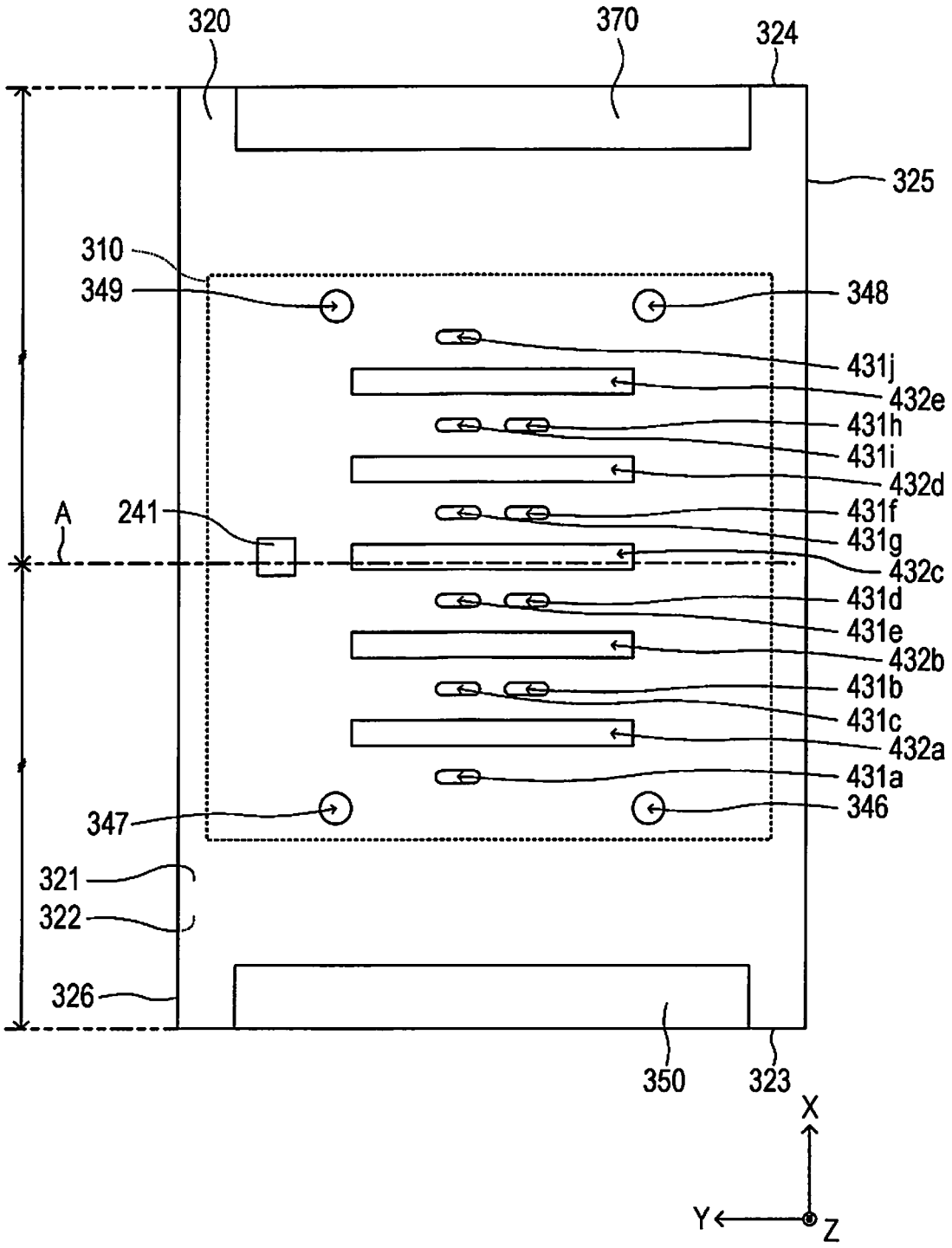
FIG. 31 is a plan diagram illustrating a case where the substrate is viewed from a surface of the third embodiment.

Subsequently, a configuration of the substrate 320 will be described with reference to FIGS. 30 and 31. FIG. 30 is a plan diagram illustrating a case where the substrate 320 of the third embodiment is viewed from the surface 322. In addition, FIG. 31 is a plan diagram illustrating a case where the substrate 320 of the third embodiment is viewed from the surface 321. Meanwhile, in FIG. 31, a location of the head 310 provided on the side of the surface 321 of the substrate 320 is illustrated using broken lines.

As illustrated in FIGS. 30 and 31, electrode groups 430*a* to 430*j* are provided on the surface 322 of the substrate 320. In addition, the substrate 320 is formed with ink supply path insertion holes 431*a* to 431*j* and FPC insertion holes 432*a* to 432*e*. The ink supply path insertion holes 431*a* to 431*j* and the FPC insertion holes 432*a* to 432*e* are through holes which pass through the surface 321 the surface 322 of the substrate 320. Meanwhile, configurations of the electrode groups 430*a* to 430*j*, the ink supply path insertion holes 431*a* to 431*j*, and the FPC insertion holes 432*a* to 432*e* are the same as those of the electrode groups 330*a* to 330*c*, the ink supply path insertion holes 331*a* to 331*f*, and the FPC insertion holes 332*a* to 332*c* of the first embodiment, only other than the numbers thereof provided in the substrate 320.

Each of the electrode groups 430*a* to 430*j* includes a plurality of electrodes provided in parallel along the Y direction. Furthermore, the electrode groups 430*a* to 430*j* faces a side of the side 324 from a side of the side 323 along the X direction, and are located in order of the electrode groups 430*a*, 430*b*, 430*c*, 430*d*, 430*e*, 430*f*, 430*g*, 430*h*, 430*i*, and 430*j*. A flexible wiring substrate 335 is coupled to each of the electrode groups 430*a* to 430*j*.

The FPC insertion hole 432*a* is located between the electrode group 430*a* and the electrode group 430*b* in the X direction. Furthermore, the flexible wiring substrate 335 electrically coupled to each of the electrode groups 430*a* and 430*b* is inserted into the FPC insertion hole 432*a*. The FPC insertion hole 432*b* is located between the electrode group 430*c* and the electrode group 430*d* in the X direction. Furthermore, the flexible wiring substrate 335 electrically coupled to each of the electrode groups 430*c* and 430*d* is inserted into the FPC insertion hole 432*b*. The FPC insertion hole 432*c* is located between the electrode group 430*e* and the electrode group 430*f* in the X direction. Furthermore, the flexible wiring substrate 335 electrically coupled to each of the electrode groups 430*e* and 430*f* is inserted into the FPC insertion hole 432*c*. The FPC insertion hole 432*d* is located between the electrode group 430*g* and the electrode group 430*h* in the X direction. Furthermore, the flexible wiring substrate 335 electrically coupled to each of the electrode groups 430*g* and 430*h* is inserted into the FPC insertion hole 432*d*. The FPC insertion hole 432*e* is located between the electrode group 430*i* and the electrode group 430*j* in the X direction. Furthermore, the flexible wiring substrate 335 electrically coupled to each of the electrode groups 430*i* and 430*j* is inserted into the FPC insertion hole 432*e*.

The ink supply path insertion hole 431*a* is located on the side of the side 323 of the electrode group 430*a* in the X direction. The ink supply path insertion holes 431*b* and 431*c* are located between the electrode group 430*b* and the electrode group 430*c* in the X direction, and are located in line along the Y direction such that the ink supply path insertion hole 431*b* is on the side of the side 325 and the ink supply path insertion hole 431*c* is on the side of the side 326. The ink supply path insertion holes 431*d* and 431*e* are located between the electrode group 430*d* and the electrode group 430*e* in the X direction, and are located in line along the Y direction such that the ink supply path insertion hole 431*d* is on the side of the side 325 and the ink supply path insertion hole 431*e* is on the side of the side 326. The ink supply path insertion holes 431*f* and 431*g* are located between the electrode group 430*f* and the electrode group 430*g* in the X direction, and are located in line along the Y direction such that the ink supply path insertion hole 431*f* is on the side of the side 325 and the ink supply path insertion hole 431*g* is on the side of the side 326. The ink supply path insertion holes 431*h* and 431*i* are located between the electrode group 430*h* and the electrode group 430*i* in the X direction, and are located in line along the Y direction such that the ink supply path insertion hole 431*h* is on the side of the side 325 and the ink supply path insertion hole 431*i* is on the side of the side 326. The ink supply path insertion hole 431*j* is located on the side of the side 324 of the electrode group 430*j* in the X direction.

Ink supply ports 661, which introduce the ink to the discharge sections 600 corresponding to each of the respective nozzle columns L1 to L10, are inserted into the respective ink supply path insertion holes 431*a* to 431*j* which are provided as above.

In addition, as illustrated in FIG. 31, the integrated circuit apparatus 241 is provided on the side of the surface 321 of the substrate 320. The integrated circuit apparatus 241 is the integrated circuit apparatus included in the diagnosis circuit 240 illustrated in FIG. 2, performs diagnosis of whether or not it is possible to normally discharge the ink from the nozzles 651 based on the latch signal LATa, the change signal CHa, the print data signal SI1, and the clock signal SCKa, which are input from the first connector 350, and performs diagnosis of whether or not it is possible to normally discharge the ink from the nozzles 651 based on the latch signal LATb, the change signal CHb, the print data signal SI10, and the clock signal SCKb, which are input from the third connector 370.

The integrated circuit apparatus 241 is provided on the side of the side 326 of the FPC insertion holes 432*a* to 432*f* between the side 323 and the side 324 on the side of the surface 321 of the substrate 320. In this case, it is preferable that the integrated circuit apparatus 241 is provided at a central part between the side 323 and the side 324. Here, the central part between the side 323 and the side 324 is not limited to a spot at which a distance from the side 323 is equal to a distance from the side 324. Specifically, when it is assumed that a line acquired by connecting dots at which the distance from the side 323 is equal to the distance from the side 324 is a virtual line A, the integrated circuit apparatus 241 may be located on a side of the virtual line A rather than the side 323, and may be located on the side of the virtual line A rather than the side 324. In other words, a shortest distance between the virtual line A and the integrated circuit apparatus 241 is shorter than a shortest distance between the side 323 and the integrated circuit apparatus 241, and a shortest distance between the virtual line A and the integrated circuit apparatus 241 is shorter than a shortest distance between the side 324 and the integrated circuit apparatus 241.

The liquid discharge apparatus 1, the liquid discharge system, and the print head 21 of the third embodiment configured as above may also acquire the same effects as in the liquid discharge apparatus 1, the liquid discharge system, and the print head 21 of the first embodiment.

4 Fourth Embodiment

Subsequently, a liquid discharge apparatus 1, a liquid discharge system, and a print head 21 of a fourth embodiment will be described. Meanwhile, when the liquid discharge apparatus 1, the liquid discharge system, and the print head 21 of the fourth embodiment are described, the same reference symbols are attached to the components which are the same as in the first embodiment, the second embodiment, and the third embodiment, and description thereof will not be repeated or simplified. The print head 21 of the fourth embodiment is different from the third embodiment in a fact that the diagnosis circuit 240 includes two integrated circuit apparatuses with respect to the print head 21 disclosed in the third embodiment.

Figure 32:
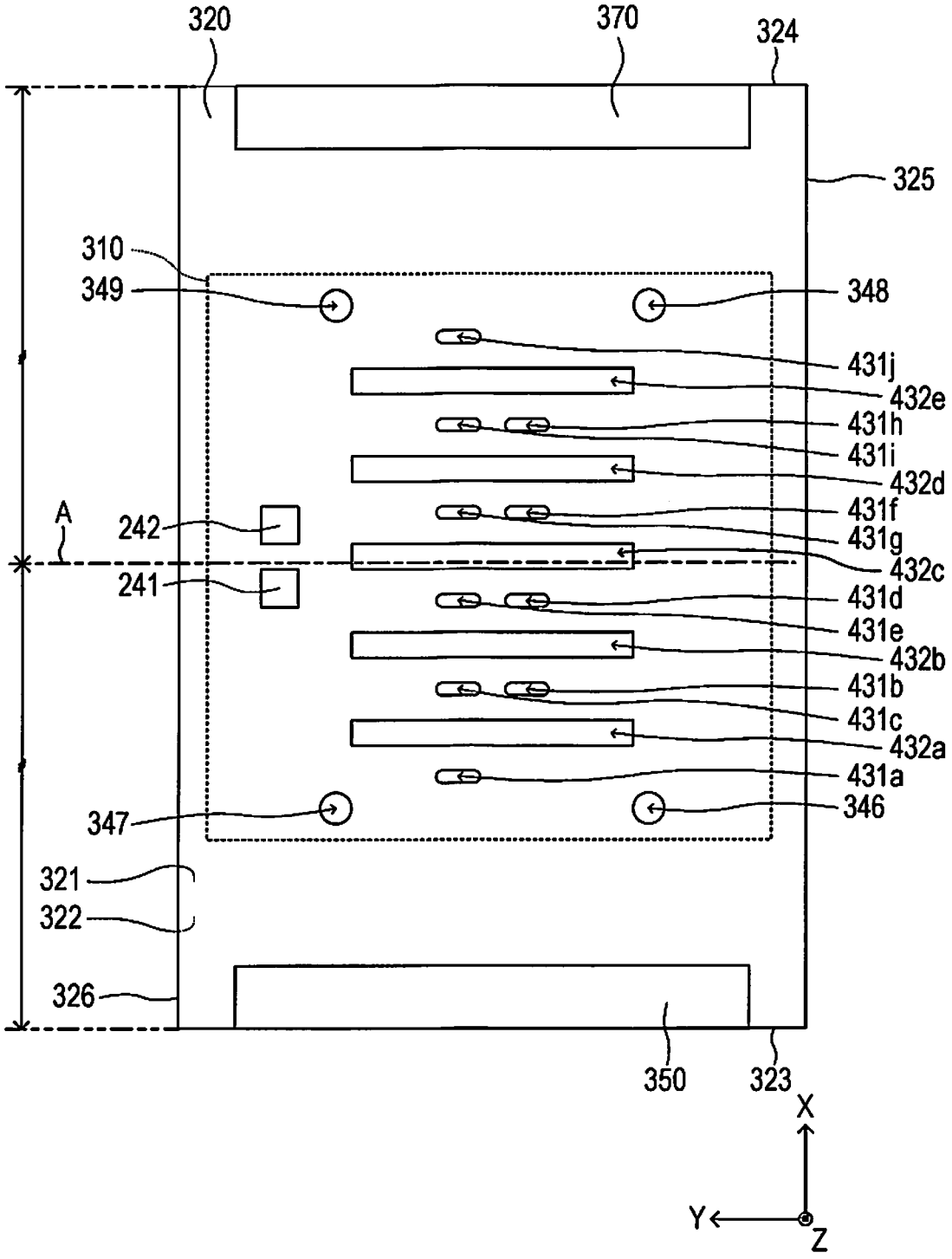
FIG. 32 is a plan diagram illustrating a case where a substrate is viewed from a surface of a fourth embodiment.

FIG. 32 is a plan diagram illustrating a case where a substrate 320 included in the print head 21 of the fourth embodiment is viewed from a surface 321. Two integrated circuit apparatuses 241 and 242 are provided in line along a Y direction on the surface 321 of the substrate 320 of the fourth embodiment.

A print data signal SI1, a change signal CHa, a latch signal LATa, and a clock signal SCKa are input from a first connector 350 to the integrated circuit apparatus 241. Furthermore, the integrated circuit apparatus 241 diagnoses whether or not it is possible for the print head 21 to normally discharge ink based on the print data signal SI1, the change signal CHa, the latch signal LATa, and the clock signal SCKa.

In addition, a print data signal SI10, a change signal CHb, a latch signal LATb, and a clock signal SCKb are input from a third connector 370 to the integrated circuit apparatus 242. Furthermore, the integrated circuit apparatus 242 diagnoses whether or not it is possible for the print head 21 to normally discharge the ink based on the print data signal SI10, the change signal CHb, the latch signal LATb, and the clock signal SCKb.

On a side of the surface 321 of the substrate 320, the integrated circuit apparatuses 241 and 242 are located on a side of a side 326 of FPC insertion holes 432*a* to 432*e* between a side 323 and a side 324, and are provided in line such that the integrated circuit apparatus 241 is on a side of the side 323 and the integrated circuit apparatus 242 is on a side of the side 324. Furthermore, the integrated circuit apparatuses 241 and 242 are located on the side of the side 326 of the FPC insertion holes 432*a* to 432*e* between the first connector 350 and the third connector 370, and the integrated circuit apparatuses 241 and 242 are provided in line such that the integrated circuit apparatus 241 is on the side of side 323 and the integrated circuit apparatus 242 is on the side of the side 324. In other words, the integrated circuit apparatus 241, which performs diagnosis of whether or not it is possible for the print head 21 to normally discharge ink based on various signals input from the first connector 350 provided along the side 323, is provided on the side of the side 323, and the integrated circuit apparatus 242, which performs the diagnosis of whether or not it is possible for the print head 21 to normally discharge ink based on various signals input from the third connector 370 provided along the side 324, is provided on the side of the side 324.

Specifically, it is preferable that the integrated circuit apparatuses 241 and 242 are provided at a central part between the side 323 and the side 324. Here, the central part between the side 323 and the side 324 is not limited to a spot at which a distance from the side 323 is equal to a distance from the side 324. Specifically, in a case where it is assumed that a line acquired by connecting dots at which the distance from the side 323 is equal to the distance from the side 324 is a virtual line A, the integrated circuit apparatus 241 may be located on a side of the virtual line A rather than the side 323 and may be located on the side of the virtual line A rather than the side 324. Further, the integrated circuit apparatus 242 may be located on the side of the virtual line A rather than the side 323 and may be located on the side of the virtual line A rather than the side 324. In other words, a shortest distance between the virtual line A and the integrated circuit apparatus 241 is shorter than a shortest distance between the side 323 and the integrated circuit apparatus 241, and the shortest distance between the virtual line A and the integrated circuit apparatus 241 is shorter than a shortest distance between the side 324 and the integrated circuit apparatus 241. Furthermore, a shortest distance between the virtual line A and the integrated circuit apparatus 242 is shorter than a shortest distance between the side 323 and the integrated circuit apparatus 242, and the shortest distance between the virtual line A and the integrated circuit apparatus 242 is shorter than a shortest distance between the side 324 and the integrated circuit apparatus 242.

The liquid discharge apparatus 1, the liquid discharge system, and the print head 21, which are configured as above, of the fourth embodiment, includes the two integrated circuit apparatuses 241 and 242. Furthermore, the integrated circuit apparatus 241 performs the diagnosis of whether or not it is possible for the print head 21 to normally discharge the ink based on the print data signal SI1, the change signal CHa, the latch signal LATa, and the clock signal SCKa, which are input from the first connector 350, and the integrated circuit apparatus 242 performs the diagnosis of whether or not it is possible for the print head 21 to normally discharge the ink based on the print data signal SI10, the change signal CHb, the latch signal LATb, and the clock signal SCKb which are input from the third connector 370. As above, in a configuration in which the signals input from the first connector 350 and the third connector 370 are detected using the two integrated circuit apparatuses 241 and 242 and in which the diagnosis of whether or not the normal discharge of the print head 21 is possible is performed, it is also possible to acquire the same effects as in the first embodiment, the second embodiment, and the third embodiment.

5 Modified Example

In the above-described liquid discharge apparatus 1, the driving signal output circuit 50 may include two driving circuits 50*a* and 50*b* which generate and output driving signals COMA and COMB having different waveforms.

Furthermore, for example, the driving signal COMA may be a waveform acquired by succeeding two trapezoid waveforms which causes an intermediate amount of ink to be discharged from the nozzle 651, and the driving signal COMB may be a waveform acquired by a trapezoid waveform which causes a small amount of ink to be discharged from the nozzle 651 and a trapezoid waveform which causes a vicinity of an opening section of the nozzle 651 to slightly vibrate. In this case, a driving signal selection circuit 200 may select any of the trapezoid waveforms included in the driving signal COMA and at least any of the trapezoid waveforms included in the driving signal COMB at a cycle Ta, and may output the selected trapezoid waveform as a driving signal VOUT.

That is, when the driving signal selection circuit 200 selects and combines a plurality of trapezoid waveforms included in each of the two driving signals COMA and COMB, the driving signal selection circuit 200 may generate and output the driving signal VOUT. Therefore, the number of combinations of the trapezoid waveforms, which are capable of being output as the driving signal VOUT, increases without making the cycle Ta long. Therefore, it is possible to increase a range of selection of a dot size of the ink which is discharged to the medium P. Accordingly, it is possible to increase grayscale of the dots formed on the medium P by the liquid discharge apparatus 1. That is, it is possible to improve print accuracy of the liquid discharge apparatus 1.

In addition, in a case where the driving signal output circuit 50 includes the two driving circuits 50*a* and 50*b* which output the driving signals COMA and COMB of different trapezoid waveforms, for example, the driving signal COMA may be a waveform by succeeding a trapezoid waveform which causes an intermediate amount of ink to be discharged from the nozzle 651, a trapezoid waveform which causes a small amount of ink to be discharged from the nozzle 651, and a trapezoid waveform which causes a vicinity of an opening section of the nozzle 651 to slightly vibrate, and the driving signal COMB may be a trapezoid waveform, which is different from the trapezoid waveform included in the driving signal COMA, and which is acquired by succeeding the trapezoid waveform which causes an intermediate amount of ink to be discharged from the nozzle 651, the trapezoid waveform which causes a small amount of ink to be discharged from the nozzle 651, and the trapezoid waveform which causes the vicinity of the opening section of the nozzle 651 to slightly vibrate. Furthermore, the driving signal COMA and the driving signal COMB are input to the driving signal selection circuits 200 which respectively correspond to different nozzle columns. Therefore, it is possible to supply the optimal driving signal VOUT to each individual nozzle column with respect to a case where the ink of different characteristics is supplied to each nozzle column formed in the print head 21 or a difference in a shape of the channel to which the ink is supplied. Therefore, it is possible to reduce dispersion of the dot size for each nozzle column, and it is possible to improve the print accuracy of the liquid discharge apparatus 1.

Hereinabove, the embodiments and the modified example are described. The present disclosure is not limited to the embodiments and the modified example, and various forms are possible in a scope without departing from the gist of the present disclosure. For example, it is possible to appropriately combine the above-described embodiments.

In addition, the present disclosure includes a configuration (for example, a configuration in which a function, a method, and a result are the same or a configuration in which an object and effects are the same) which is substantially the same as the configuration described in the embodiments and the modified example. In addition, the present disclosure includes a configuration in which a non-essential part of the configuration described in the embodiments and the modified example is replaced. In addition, the present disclosure includes a configuration which accomplishes the same effects as the configuration described in the embodiments and the modified example, or a configuration in which it is possible to accomplish the same object. In addition, the present disclosure includes a configuration in which a well-known technology is added to the configuration described in the embodiments and the modified example.

What is claimed is:

1. A liquid discharge system comprising:

a print head that discharges liquid; and a digital signal output circuit that outputs a digital signal to the print head, wherein the print head includes a supply port to which the liquid is supplied, a nozzle plate that includes a plurality of nozzles for discharging the liquid, a substrate that includes a first side and a second side, which are provided in parallel to each other, a third side and a fourth side, which are provided in parallel to each other, a first surface, and a second surface which is different from the first surface, and that has a shape in which the first side is orthogonal to the third side and the fourth side, and the second side is orthogonal to the third side and the fourth side, a connector that is provided on the first surface and to which the digital signal is input, and an integrated circuit that is provided on the first surface, that is electrically coupled to the connector, to which the digital signal is input through the connector, and that outputs an abnormality signal which indicates existence/non-existence of abnormality of the print head, the substrate is provided between the nozzle plate and the supply port, the connector is provided along the first side, the integrated circuit is provided in a place which is not adjacent to the connector, and a shortest distance between the supply port and the first surface is longer than a shortest distance between the supply port and the second surface.

2. The liquid discharge system according to claim 1, further comprising:

a carriage that reciprocates along a first direction, wherein the print head is mounted on the carriage, and the substrate is provided such that the first side and the second side are located along a second direction orthogonal to the first direction, and the third side and the fourth side are located along the first direction.

3. The liquid discharge system according to claim 1, wherein the supply port is located at a vertically upper part of the substrate.

4. The liquid discharge system according to claim 1, wherein the first surface faces a vertically lower part and the second surface faces a vertically upper part.

5. The liquid discharge system according to claim 1, wherein the first surface is orthogonal to a vertical direction.

6. The liquid discharge system according to claim 1, wherein a length of the first side is shorter than a length of the third side.

7. The liquid discharge system according to claim 1, wherein a shortest distance between a virtual line, which has an equal distance from the first side and the second side, and the integrated circuit is shorter than a shortest distance between the first side and the integrated circuit, and the shortest distance between the virtual line and the integrated circuit is shorter than a shortest distance between the second side and the integrated circuit.

8. The liquid discharge system according to claim 1, wherein the print head includes a fixing member that fixes the substrate, the substrate includes a fixing hole into which the fixing member is inserted, and at least a part of the integrated circuit overlaps the fixing member in a direction along the third side.

9. The liquid discharge system according to claim 1, wherein the print head includes a discharge module that includes the nozzle plate, the integrated circuit is located between the substrate and the discharge module, and the substrate and the discharge module are fixed by an adhesive.

10. The liquid discharge system according to claim 1, wherein the print head includes a plurality of flexible wiring substrates which are electrically coupled to the substrate, the substrate includes a plurality of FPC insertion holes into which the plurality of flexible wiring substrates are inserted, a width of each of the plurality of the FPC insertion holes in a direction along the first side is larger than a width in a direction along width in a direction along the third side, and the plurality of FPC insertion holes are located in line along the third side.

11. The liquid discharge system according to claim 10, wherein the integrated circuit is located other than between the plurality of FPC insertion holes in the direction along the third side.

12. The liquid discharge system according to claim 1, wherein the substrate includes a supply port insertion hole into which the supply port is inserted.

13. The liquid discharge system according to claim 1, wherein the integrated circuit is a surface-mount component.

14. The liquid discharge system according to claim 13, wherein the integrated circuit is electrically coupled to the substrate through a bump electrode.

15. The liquid discharge system according to claim 1, wherein the connector includes a fifth side, a sixth side which is orthogonal to the fifth side and is longer than the fifth side, and a plurality of terminals, the plurality of terminals being provided in line in a direction along the sixth side.

16. The liquid discharge system according to claim 15, wherein the connector is provided in the substrate such that the sixth side of the connector is parallel to the first side of the substrate.

17. A liquid discharge apparatus comprising:

a carriage that reciprocates along a first direction;

a print head that is mounted on the carriage; and a digital signal output circuit that outputs a digital signal to the print head, wherein the print head includes a supply port to which the liquid is supplied from the liquid accommodation container, a nozzle plate that includes a plurality of nozzles for discharging the liquid, a substrate that includes a first side and a second side, which are provided in parallel to each other, a third side and a fourth side, which are provided in parallel to each other, a first surface, and a second surface which is different from the first surface, and that has a shape in which the first side is orthogonal to the third side and the fourth side, and the second side is orthogonal to the third side and the fourth side, a connector that is provided on the first surface and to which the digital signal is input, and an integrated circuit that is provided on the first surface, that is electrically coupled to the connector, to which the digital signal is input through the connector, and that outputs an abnormality signal which indicates existence/non-existence of abnormality of the print head, the substrate is provided such that, between the nozzle plate and the supply port, the first side and the second side are located along a second direction orthogonal to the first direction and the third side and the fourth side are located along the first direction, the connector is provided along the first side, the integrated circuit is provided in a place which is not adjacent to the connector, and a shortest distance between the supply port and the first surface is longer than a shortest distance between the supply port and the second surface.

18. A print head comprising:

a supply port to which liquid is supplied;

a nozzle plate that includes a plurality of nozzles for discharging the liquid;

a substrate that includes a first side and a second side, which are provided in parallel to each other, a third side and a fourth side, which are provided in parallel to each other, a first surface, and a second surface which is different from the first surface, and that has a shape in which the first side is orthogonal to the third side and the fourth side, and the second side is orthogonal to the third side and the fourth side;

a connector that is provided on the first surface and to which the digital signal is input; and an integrated circuit that is provided on the first surface, that is electrically coupled to the connector, to which the digital signal is input through the connector, and that outputs an abnormality signal which indicates existence/non-existence of operation abnormality, wherein the substrate is provided between the nozzle plate and the supply port, the connector is provided along the first side, the integrated circuit is provided in a place which is not adjacent to the connector, and a shortest distance between the supply port and the first surface is longer than a shortest distance between the supply port and the second surface.

* * * * *